US008195472B2

(12) United States Patent
Crockett

(10) Patent No.: US 8,195,472 B2
(45) **Date of Patent: *Jun. 5, 2012**

(54) HIGH QUALITY TIME-SCALING AND PITCH-SCALING OF AUDIO SIGNALS

(75) Inventor: Brett Graham Crockett, Brisbane, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 52 days.

This patent is subject to a terminal disclaimer.

(21) Appl. No.: 12/605,940

(22) Filed: Oct. 26, 2009

(65) Prior Publication Data

US 2010/0042407 A1 Feb. 18, 2010

Related U.S. Application Data

(63) Continuation of application No. 10/474,387, filed as application No. PCT/US02/04317 on Feb. 12, 2002, now Pat. No. 7,610,205, which is a continuation-in-part of application No. 10/045,644, filed on Jan. 11, 2002, now abandoned, which is a continuation-in-part of application No. 09/922,394, filed on Aug. 2, 2001, now abandoned, which is a continuation of application No. 09/834,739, filed on Apr. 13, 2001, now abandoned, said application No. PCT/US02/04317 is a continuation-in-part of application No. 09/922,394, filed on Aug. 2, 2001, now abandoned, and a continuation-in-part of application No. 09/834,739, filed on Apr. 13, 2001, now abandoned.

(60) Provisional application No. 60/293,825, filed on May 25, 2001.

(51) Int. Cl.
*G10L 21/00* (2006.01)
*G10L 19/00* (2006.01)

(52) U.S. Cl. ..... 704/503; 704/200.1; 704/501; 704/504

(58) Field of Classification Search ..... 704/200.1, 704/500–504
See application file for complete search history.

(56) References Cited

U.S. PATENT DOCUMENTS 4,464,784 A 8/1984 Agnello
4,624,009 A 11/1986 Glenn et al.
(Continued)

FOREIGN PATENT DOCUMENTS

EP 0372155 A2 6/1990
(Continued)

OTHER PUBLICATIONS

U.S. Appl. No. 10/591,374, filed Aug. 31, 2006, Mark Franklin Davis—Pending claims in application.

(Continued)

*Primary Examiner* — Douglas Godbold

(57) ABSTRACT

In one alternative, an audio signal is analyzed using multiple psychoacoustic criteria to identify a region of the signal in which time scaling and/or pitch shifting processing would be inaudible or minimally audible, and the signal is time scaled and/or pitch shifted within that region. In another alternative, the signal is divided into auditory events, and the signal is time scaled and/or pitch shifted within an auditory event. In a further alternative, the signal is divided into auditory events, and the auditory events are analyzed using a psychoacoustic criterion to identify those auditory events in which the time scaling and/or pitch shifting processing of the signal would be inaudible or minimally audible. Further alternatives provide for multiple channels of audio.

11 Claims, 19 Drawing Sheets

U.S. PATENT DOCUMENTS

| | | | | | |
|---|---|---|---|---|---|
| 4,700,391 | A | | 10/1987 | Leslie, Jr. et al. | |
| 4,703,355 | A | | 10/1987 | Cooper | |
| 4,723,290 | A | | 2/1988 | Watanabe et al. | |
| 4,792,975 | A | | 12/1988 | MacKay | |
| 4,852,170 | A | | 7/1989 | Bordeaux | |
| 4,864,620 | A | | 9/1989 | Bialick | |
| 4,905,287 | A | | 2/1990 | Segawa | |
| RE33,535 | E | | 2/1991 | Cooper | |
| 5,023,912 | A | | 6/1991 | Segawa | |
| 5,040,081 | A | | 8/1991 | McCutchen | |
| 5,101,434 | A | | 3/1992 | King | |
| 5,175,769 | A | | 12/1992 | Hejna, Jr. et al. | |
| 5,202,761 | A | | 4/1993 | Cooper | |
| 5,216,744 | A | | 6/1993 | Alleyne et al. | |
| 5,235,646 | A | | 8/1993 | Wilde et al. | |
| 5,313,531 | A | | 5/1994 | Jackson | |
| 5,450,522 | A | | 9/1995 | Hermansky et al. | |
| 5,621,857 | A | | 4/1997 | Cole et al. | |
| 5,730,140 | A | | 3/1998 | Fitch | |
| 5,749,073 | A | | 5/1998 | Slaney | |
| 5,781,885 | A | | 7/1998 | Inoue et al. | |
| 5,828,994 | A | * | 10/1998 | Covell et al. | 704/211 |
| 5,842,172 | A | * | 11/1998 | Wilson | 704/503 |
| 5,862,228 | A | | 1/1999 | Davis | |
| 5,970,440 | A | | 10/1999 | Veldhuis et al. | |
| 6,002,776 | A | | 12/1999 | Bhadkamkar et al. | |
| 6,021,386 | A | | 2/2000 | Davis | |
| 6,049,766 | A | * | 4/2000 | Laroche | 704/216 |
| 6,108,622 | A | * | 8/2000 | Xue et al. | 704/212 |
| 6,163,614 | A | | 12/2000 | Chen | |
| 6,211,919 | B1 | | 4/2001 | Zink et al. | |
| 6,232,540 | B1 | * | 5/2001 | Kondo | 84/612 |
| 6,246,439 | B1 | | 6/2001 | Zink et al. | |
| 6,266,003 | B1 | | 7/2001 | Hoek | |
| 6,266,644 | B1 | * | 7/2001 | Levine | 704/503 |
| 6,360,202 | B1 | * | 3/2002 | Bhadkamkar et al. | 704/270 |
| 6,430,533 | B1 | | 8/2002 | Kolluru et al. | |
| 6,487,535 | B1 | * | 11/2002 | Smyth et al. | 704/500 |
| 6,490,553 | B2 | | 12/2002 | Van Thong et al. | |
| 6,519,567 | B1 | * | 2/2003 | Fujii | 704/503 |
| 6,718,309 | B1 | * | 4/2004 | Selly | 704/503 |
| 6,792,402 | B1 | * | 9/2004 | Chen | 704/200.1 |
| 6,801,898 | B1 | * | 10/2004 | Koezuka | 704/500 |
| 6,835,885 | B1 | * | 12/2004 | Kondo et al. | 84/612 |
| 7,092,774 | B1 | * | 8/2006 | Gifford et al. | 700/94 |
| 7,171,367 | B2 | * | 1/2007 | Chang | 704/503 |
| 7,283,954 | B2 | * | 10/2007 | Crockett et al. | 704/216 |
| 7,313,519 | B2 | | 12/2007 | Crockett | |
| 7,454,331 | B2 | | 11/2008 | Vinton et al. | |
| 7,461,002 | B2 | * | 12/2008 | Crockett et al. | 704/278 |
| 7,508,947 | B2 | | 3/2009 | Smithers | |
| 7,610,205 | B2 | | 10/2009 | Crockett | |
| 2001/0027393 | A1 | | 10/2001 | Touimi et al. | |
| 2001/0038643 | A1 | | 11/2001 | McParland | |
| 2002/0097882 | A1 | | 7/2002 | Greenberg et al. | |
| 2002/0116178 | A1 | | 8/2002 | Crockett | |
| 2002/0128822 | A1 | * | 9/2002 | Kahn | 704/200.1 |
| 2004/0024588 | A1 | | 2/2004 | Watson et al. | |
| 2004/0037421 | A1 | | 2/2004 | Truman | |
| 2004/0044525 | A1 | | 3/2004 | Vinton et al. | |
| 2004/0122662 | A1 | * | 6/2004 | Crockett | 704/200.1 |
| 2004/0133423 | A1 | | 7/2004 | Crockett | |
| 2004/0148159 | A1 | | 7/2004 | Crockett et al. | |
| 2004/0165730 | A1 | | 8/2004 | Crockett | |
| 2004/0172240 | A1 | | 9/2004 | Crockett et al. | |
| 2004/0184537 | A1 | | 9/2004 | Geiger et al. | |
| 2005/0078840 | A1 | | 4/2005 | Riedl | |
| 2006/0002572 | A1 | | 1/2006 | Smithers et al. | |
| 2006/0029239 | A1 | | 2/2006 | Smithers | |
| 2007/0092089 | A1 | | 4/2007 | Seefeldt et al. | |
| 2007/0140499 | A1 | | 6/2007 | Davis | |

FOREIGN PATENT DOCUMENTS

| | | | |
|---|---|---|---|
| EP | 0525544 | A2 | 2/1993 |
| EP | 0865026 | | 11/2004 |
| EP | 0608833 | A2 | 11/2008 |
| JP | H05-113797 | | 5/1993 |
| JP | H06-175693 | | 6/1994 |
| JP | 10074097 | | 3/1998 |
| JP | 10-145729 | | 5/1998 |
| WO | 91/19989 | | 12/1991 |
| WO | 91/20164 | | 12/1991 |
| WO | 96/27184 | | 9/1996 |
| WO | 97/01939 | | 1/1997 |
| WO | 99/33050 | | 7/1997 |
| WO | 98/20482 | | 5/1998 |
| WO | 9841978 | | 9/1998 |
| WO | 99/29114 | | 6/1999 |
| WO | 99/33050 | | 7/1999 |
| WO | 00/13172 | | 3/2000 |
| WO | 00/19414 | | 4/2000 |
| WO | 00/45378 | | 8/2000 |
| WO | 0103002 | | 1/2001 |
| WO | 02/015587 | | 2/2002 |
| WO | 02/15587 | | 2/2002 |
| WO | 02/084645 | | 10/2002 |
| WO | 02/093560 | | 11/2002 |
| WO | 02/097702 | | 12/2002 |
| WO | 02/097790 | | 12/2002 |
| WO | 02/097791 | | 12/2002 |
| WO | 03/069954 | | 8/2003 |
| WO | 03/090208 | | 10/2003 |
| WO | 2004019656 | | 3/2004 |
| WO | 2004/073178 | | 8/2004 |
| WO | 2004/111994 | | 12/2004 |
| WO | 2005086139 | | 9/2005 |
| WO | 2006/006977 | | 1/2006 |
| WO | 2006019719 | | 2/2006 |
| WO | 2006/113047 | | 10/2006 |
| WO | 2006/113062 | | 10/2006 |
| WO | 2006/132857 | | 12/2006 |
| WO | 2007/016107 | | 2/2007 |
| WO | 2007/127023 | | 11/2007 |

OTHER PUBLICATIONS

PCT/US2005/006359, filed Feb. 28, 2005—International Search Report and Written Opinion dated Jun. 6, 2005.

ATSC Standard: Digital Audio Compression (AC-3), Revision A, Doc A/52A, ATSC Standard, Aug. 20, 2001, pp. 1-140.

Schuijers, E., et al.; "Advances in Parametric Coding for High-Quality Audio," Preprints of Papers Presented at the AES Convention, Mar. 22, 2003, pp. 1-11, Amsterdam, The Netherlands.

European Patent Office—Sep. 28, 2007—Examination Report for Application No. 05 724 000.4-2225.

European Patent Office—Jan. 26, 2007—Communication pursuant to Article 96(2) EPC for Application No. 05 724 000.4-2218.

SG 200605858-0 Australian Patent Office Written Opinion dated Oct. 17, 2007 based on PCT Application filed Feb. 28, 2005.

U.S. Appl. No. 10/911,404, filed Aug. 3, 2004, Michael John Smithers—Oct. 5, 2006 Office Action.

U.S. Appl. No. 10/911,404, filed Aug. 3, 2004, Michael John Smithers—Jan. 5, 2007 Response to Office Action.

U.S. Appl. No. 10/911,404, filed Aug. 3, 2004, Michael John Smithers—Mar. 28, 2007 Office Action.

U.S. Appl. No. 10/911,404, filed Aug. 3, 2004, Michael John Smithers—Jun. 28, 2007 RCE and Response to Office Action.

U.S. Appl. No. 10/911,404, filed Aug. 3, 2004, Michael John Smithers—Aug. 10, 2007 Office Action.

U.S. Appl. No. 10/911,404, filed Aug. 3, 2004, Michael John Smithers—Dec. 7, 2007 Response to Office Action.

PCT/US2005/024630, filed Jul. 13, 2005—International Search Report and Written Opinion dated Dec. 1, 2005.

U.S. Appl. No. 11/999,159, filed Dec. 3, 2007, Alan Jeffrey Seefeldt, et al.—Pending claims in application.

Fielder, et al., "Introduction to Dolby Digital Plus, an Enhancement to the Dolby Digital Coding System," Audio Engineering Society Convention Paper, presented at the 117.sup.th Convention, pp. 1-29, Oct. 28-31, 2004, San Francisco, CA.

Hoeg, W., et al., "Dynamic Range Control (DRC) and Music/Speech Control (MSC) Programme-Associated Data Services for DAB," EBU Review—Technical, European Broadcasting Union. Brussels, BE, No. 261, Sep. 21, 1994, pp. 56-70.

Bregman, Albert S., "Auditory Scene Analysis—The Perceptual Organization of Sound," Massachusetts Institute of Technology, 1991, Fourth printer, 2001, Second MIT Press (Paperback ed.) 2.sup. nd , pp. 468-470.
Dattorro, J., "Effect Design Part I: Reverberator and Other Filters," 1997, J. Audio Eng. Soc., 45(9):660-684.
Dembo, A., et al., "Signal Synthesis from Modified Discrete Short-Time Transform," 1988, IEEE Trans Acoust., Speech, Signal Processing, ASSP 36(2):168-181.
Fairbanks, G., et al., "Method for Time or Frequency Compression-Expansion of Speech," 1954, IEEE Trans Audio and Electroacoustics, AU-2:7-12.
Griffin D., et al., "Multiband Excitation Vocoder," 1988, IEEE Trans. Acoust., Speech, Signal Processing, ASSP-36 (2):236-243.
Laroche, J. "Autocorrelation Method for High Quality Time/Pitch Scaling," 1993, Procs. IEEE Workshop Appl. of Signal Processing to Audio and Acoustics, Mohonk Mountain House, New Paltz, NY.
Laroche J., et al., "HNS: Speech Modification Based on a Harmonic + Noise Model," 1993a, Proc. IEEE ECASSP-93, Minneapolis, pp. 550-553.
Laroche, J., "Time and Pitch Scale Modification of Audio Signals," Chapter 7 of "Applications of Digital Signal Processing to Audio and Acoustics," 1998, edited by Mark Kahrs and Karlheinz Brandenburg, Kluwer Academic Publishers.
Lee, F., "Time Compression and Expansion of Speech by the Sampling Method," 1972, J. Audio Eng. Soc., 20 (9):738-742.
Lee, S., et al., "Variable Time-Scale Modification of Speech Using Transient Information," 1997, An IEEE Publication, pp. 1319-1322.
Lin, G.J., et al, "High Quality and Low Complexity Pitch Modification of Acoustic Signals," 1995, An IEEE Publication, pp. 2987-2990.
Makhoul, J., "Linear Predication: A tutorial Review," 1975, Proc. IEEE, 63(4):561-580.
Malah D., "Time-Domain Algorithms for Harmonic Bandwidth Reduction and Time Scaling of Speech Signals," 1979, IEEE Trans. on Acoustics, Speech, and Signal Processing ASSP-27(2):113-120.
Marques J.. et al., "Frequency-Varying Sinusoidal Modeling of Speech," 1989, IEEE Trans. on Acoustics, Speech and Signal Processing, ASSP-37(5):763-765.
Moorer, J. A., "The Use of the Phase Vocoder in Computer Music Applications," 1978, J. Audio Eng. Soc., 26(1).
Press, William H., et al., "Numerical Recipes in C, The Art of Scientific Computing," 1988, Cambridge University Press, NY, pp. 432-434.
Portnoff, R., "Time-Scale Modifications of Speech Based on Short-Time Fourier Analysis," 1981, IEEE Trans. Acoust., Speech, Signal Processing 29(3):374-390.
Quatierei T., et al., "Speech Transformations Based on a Sinusoidal Representation," 1986, IEEE Trans on Acoustics, Speech and Signal Processing, ASSP-34(6):1449-1464.
Roehrig, C., "Time and Pitch Scaling of Audio Signals," 1990, Proc. 89.sup.th AES Convention, Los Angeles, Preprint 2954 (E-I).
Roucos, S., et al, "High Quality Time-Scale Modification of Speech," 1985, Proc. IEEE ICASSP-85, Tampa, pp. 493-496.
Shanmugan, K. Sam, "Digital and Analog Communication Systems," 1979, John Wiley Sons, NY, pp. 278-280.
Schroeder, M., et al., "Band-Width Compression of Speech by Analytic-Signal Rooting," 1967, Proc. IEEE, 55:396-401.
Scott, R., et al., "Pitch-Synchronous Time Compression of Speech," 1972, Proceedings of the Conference for Speech Communication Processing, pp. 63-65.
Edmonds, et al., "Automatic Feature Extraction from Spectrograms for Acoustic-Phonetic Analysis," pp. 701-704, Lutchi Research Center, Loughborough University of Technology, Loughborough, U.K.
Klapuri, Anssi "Sound Onset Detection by Applying Psychoacoustic Knowledge" ICASSP, IEEE International Conference on Acoustics, Speech and Signal Processing—Proceedings 1999 IEEE, vol. 6, Mar. 15, 1999, pp. 3089-3092.
Scheirer, Eric D., "Tempo and Beat Analysis of Acoustic Musical Signals" The Journal of the Acoustical Society of America, American Institute of Physics for the Acoustical Society of America, New York, NY, US, vol. 103, No. 1, Jan. 1, 1998, pp. 588-601.
Masri, Paul, "Computer Modelling of Sound for Transformation and Synthesis of Musical Signals" Dec. 1, 1996, pp. 125-147.
PCT/US02/05999, filed Feb. 26, 2002—International Search Report dated Oct. 7, 2002.
Fishbach, Alon, Primary Segmentation of Auditory Scenes, IEEE, pp. 113-117, 1994.
Australian Patent Office—Mar. 9, 2007—Examiner's first report on application No. 2002252143.
Chinese Patent Office—Dec. 31, 2004—Notification of the First Office Action for Application No. 02810671.7.
Chinese Patent Office—Jul. 15, 2005—Notification of Second Office Action for Application No. 02810671.7.
Chinese Patent Office—Apr. 28, 2006—Notification of Third Office Action for Application No. 02810671.7.
Brandenburg, K., "MP3 and AAC Explained," Proceedings of the International AES Conference, 1999, pp. 99-110.
Carroll, Tim, "Audio Metadata: You can Get There from Here," Oct. 11, 2004, pp. 1-4, Retreived from the Internet: URL:http://tvtechnology.com/Features/audio.sub.-notes/f-TC-metadta-8.21.- 02.shtml.
Painted, T., et al., "Perceptual Coding of Digital Audio", Proceedings of the IEEE, New York, NY, vol. 88, No. 4, Apr. 2000, pp. 451-513.
Swanson, M. D., et al., "Multiresolution Video Watermarketing Using Perceptual Models and Scene Segmentation," Proceedings of the International conference on Image Processing, Santa Barbara, Ca., Oct. 26-29, 1997, Los Alamitos, CA IEEE Computer Society, US, vol. 2, Oct. 1997, pp. 558-561.
Todd, et al., "AC-3: Flexible Perceptual Coding for Audio Transmission and Storage," 96.sup.th Convention of the Audio Engineering Society, Preprint 3796, Feb. 1994, pp. 1-6.
Smith, et al., "Tandem-Free VoIP Conferencing: A Bridge to Next-Generation Networks," IEEE Communications Magazine, May 2003, pp. 136-145.
Riedmiller Jeffrey C., "Solving TV Loudness Problems Can You 'Accurately' Hear the Difference," Communications Technology, Feb. 2004.
Moore, B. C. J., et al., "A Model for the Predicition of Thresholds, Loudness and Partial Loudness," Journal of the Audio Engineering Society, New York, NY vol. 45, No. 4, Apr. 1, 1997, pp. 224-240.
Glasberg, B.R., et al., "A Model of Loudness Applicable to Time-Varying Sounds," Audio Engineering Society, New York, NY, vol. 50, No. 5, May 2002, pp. 331-342.
Hauenstein, M., "A Computationally Efficient Algorithm for Calculating Loudness Pattersn of Narrowband Speech," Acoustics, Speech and Signal Processing, 1997, IEEE International Conference, Munich, Germany, Apr. 21-24, 1997, Los Alamitos, CA USE, IEEE Comput. Soc. US Apr. 21, 1997, pp. 1311-1314.
Trappe, W., et al., "Key Distribution fro secure Multimedia Multicasts via Data Embedding," 2001 IEEE International Conferences on Acoustics, Speech and Signal Processing Proceedings, Salt Lake City UT, May 7-11, 2001 IEEE International Conference on Acoustics, Speech and Signal Processing, New York, NY, IEEE, US, vol. 1 of 6, May 7, 2001, pp. 1449-1452.
Foti, Frank, "DTV Audio Processing: Exploring the New Frontier," OMNIA, Nov. 1998, pp. 1-3.
Australian Patent Office—Feb. 26, 2007—Examiner's first report on application No. 2002307533.
Chinese Patent Office—May 13, 2005—Notification of First Office Action for Application No. 02809542.1.
Chinese Patent Office—Feb. 17, 2006—Notification of Second Office Action for Application No. 02809542.1.
European Patent Office—Dec. 19, 2005—Communication Pursuant to Article 96(2) for EP Application No. 02 769 666.5-2218.
Indian Patent Office—Jan. 3, 2007—First Examination Report for Application No. 1308/KOLNP/2003—J.
U.S. Appl. No. 10/478,397, filed Nov. 20, 2003, Brett G. Crockett—Feb. 27, 2007 Office Action.
U.S. Appl. No. 10/478,397, filed Nov. 20, 2003, Brett G. Crockett—May 29, 2007 Response to Office Action.
PCT/US02/05329, filed Feb. 22, 2002—International Search Report dated Oct. 7, 2002.

Edmonds, et al., "Automatic Feature Extraction from Spectrograms for Acoustic-Phonetic Analysis," pp. 701-704, Lutchi Research Center, Loughborough University of Technology, Loughborough, U.K., 1992.
Chinese Patent Office—Mar. 10, 2006—Notification of the First Office Action for Application No. 02810670.9.
U.S. Appl. No. 10/478,398, filed Nov. 20, 2003, Brett G. Crockett—Feb. 27, 2007 Office Action.
U.S. Appl. No. 10/478,398, filed Nov. 20, 2003, Brett G. Crockett—May 29, 2007 Response to Office Action.
U.S. Appl. No. 10/478,398, filed Nov. 20, 2003, Brett G. Crockett—Jul. 20, 2007 Office Action.
U.S. Appl. No. 10/478,398, filed Nov. 20, 2003, Brett G. Crockett—Oct. 19, 2007 Request for Continued Examination with attached IDS.
U.S. Appl. No. 10/478,398, filed Nov. 20, 2003, Brett G. Crockett—Jan. 30, 2008 Office Action.
PCT/US02/05806, filed Feb. 25, 2002—International Search Report dated Oct. 7, 2002.
Chinese Patent Office—Nov. 5, 2004—Notification of First Office Action for Application No. 02810672.5.
Chinese Patent Office—Aug. 26, 2005—Notification of Second Office Action for Application No. 02810672.5.
European Patent Office—Aug. 10, 2004—Communication pursuant to Article 96(2) EPC for Application No. 02 707896.3-1247.
European Patent Office—Dec. 16, 2005—Communication pursuant to Article 96(2) EPC for Application No. 02 707 896.3-1247.
Indian Patent Office—Oct. 10, 2006—First Examination Report for Application No. 01490/KOLNP/2003.
Indian Patent Office—May 29, 2007—Letter for Application No. 01490/KOLNP/2003.
Indian Patent Office—Aug. 10, 2007—Letter for Application No. 01490/KOLNP/2003.
Japanese Patent Office—Partial Translation of Office Action received Oct. 5, 2007.
U.S. Appl. No. 10/478,538, filed Nov. 20, 2003, Brett G. Crockett—Aug. 24, 2006 Office Action.
U.S. Appl. No. 10/478,538, filed Nov. 20, 2003, Brett G. Crockett—Nov. 24, 2006 Response to Office Action.
U.S. Appl. No. 10/478,538, filed Nov. 20, 2003, Brett G. Crockett—Feb. 23, 2007 Office Action.
U.S. Appl. No. 10/478,538, filed Nov. 20, 2003, Brett G. Crockett—Jun. 25, 2007 Response to Office Action.
U.S. Appl. No. 10/478,538, filed Nov. 20, 2003, Brett G. Crockett—Sep. 10, 2007 Office Action.
U.S. Appl. No. 10/478,538, filed Nov. 20, 2003, Brett G Crockett—Jan. 9, 2008—Response to Office Action.
Seneff, S., "System to Independently Modify Excitation and/or Spectrum of Speech Waveform without Explicit Pitch Extraction," 1982, IEEE Trans. Acoust., Speech, Signal Processing, ASSP-24:358-365.
Suzuki, R., et al., "Time-Scale Modification of Speech Signals Using Cross-Correlation Functions," 1992, IEEE Trans. on Consumer Electronics, 38(3):357-363.
Tan, Roland, K.C., "A Time-Scale Modification Algorithm Based on the Subband Time-Domain Technique for Broad-Band Signal Applications," May 2000, J. Audio Eng. Soc. vol. 48, No. 5, pp. 437-449.
Bristow-Johnson, Robert, "Detailed Analysis of a Time-Domain Formant-Corrected Pitch-Shifting Algorithm," May 1995, J. Audio Eng. Soc., vol. .43, No. 5, pp. 340-352.
George, E Bryan, et al., "Analysis-by-Synthesis/Overlap—Add Sinusoidal Modeling Applied to the Analysis and Synthesis of Musical Tones," Jun. 1992, J. Audio Eng. Soc., vol. 40, No. 6, pp. 497-515.
McAulay, Robert J., "Speech Analysis/Synthesis Based on a Sinusoidal Representation," Aug. 1986, IEEE Transactions on Acoustics, Speech and Signal Processing, vol. ASSP-34, No. 4, pp. 744-754.
Laroche, Jean. "Improved Phase Vocoder Time-Scale Modification of Audio," May 1999, IEEE Transactions on Speech and Audio Processing, vol. 7, No. 3, pp. 323-332.
Slyh, Raymond E., "Pitch and Time-Scale Modification of Speech: A Review of the Literature—Interim Report May 1994-May 1995," Armstrong Lab., Wright-Patterson AFB, OH, Crew Systems Directorate.
Audio Engineering Handbook, K. Blair Benson ed., McGraw Hill, San Francisco, CA 1988, pp. 1.40-1.42 and 4.8-4.10.
Tewfik, A.H., et al., "Enhanced Wavelet Based Audio Coder," Nov. 1, 1993, Signals, Systems and Computers, Conference Record of the 17.sup.th Asilomar Conference on Pacific Grove, CA, IEEE Comput. Soc pp. 896-900.
Vafin, R., et al., "Modifying Transients for Efficient Coding of Audio," May 2001, IEEE International Conference on Acoustics, Speech and Signal Processing, pp. 3285-3288, vol. 5.
Vafin, R., et al., Improved Modeling of Audio Signals by Modifying Transient Locations, Oct. 2001, Proceeding of the 2001 IEEE Workshop on the Applications of Signal Processing to Audio and Acoustics, pp. 143-146.
Karjalainen, M., et al., "Multi-Pitch and Periodcity Analysis Model for Sound Separation and Auditory Scene Analysis," Mar. 1999, Proc. ICASSP'99, pp. 929-932.
Levine, S .N., "Effects Processing on Audio Subband Data," 1996, Proc. Int. Computer Music Conf., HKUST, Hong Kong, pp. 328-331.
Levine, S. N., et al., "A Switched Parametric & Transform Audio Coder," Mar. 1999, Proc. ICASSP'99, pp. 985-988.
Mermelstein, P., et al., "Analysis by Synthesis Speech Coding with Generalized Pitch Prediction," Mar. 1999, Proc. ICASSP'99, pp. 1-4.
Pollard, M .P., et al., "Enhanced Shape—Invariant Pitch and Time-Scale Modification for Concatenative Speech Synthesis," Oct. 1996, Proc. Int. Conf. For Spoken Language Processing , ICLSP'96, vol. 3, pp. 1433-1436.
Verma, T. S., et al., An Analysis/Synthesis Tool for Transient Signals that Allows a Flexible Sines+Transients+Noise Model for Audio, May 1998, Proc. ICASSP'98, pp. 3573-3576.
Verma, T. S., et al., "Sinusoidal Modeling Using Frame-Based Perceptually Weighted Matching Pursuits," Mar. 1999 Proc. ICASSP'99, pp. 981-984.
Yim, S., et al., "Spectral Transformation for Musical Tones via Time Domain Filtering," Oct. 1997, Proc. 1997 IEEE Workshop on Applications of Signal Processing to Audio and Acoustics, pp. 141-144.
Edmonds, E. A., et al., "Automatic Feature Extraction from Spectrograms for Acoustic-Phonetic Analysis," 1992 vol. II, Conference B: Pattern Recognition Methodology and Systems, Proceedings, 11.sup.th 1APR International Conference on the Hague, Netherlands, USE, IEEE Computer Soc., Aug. 30, 1992, pp. 701-704.
Fishbach, Alon, "Primary Segmentation of Auditory Scenes," 12.sup.th IAPR International Conference on Pattern Recognition, Oct. 9-13, 1994, vol. III Conference C: Signal Processing, Conference D: Parallel Computing, IEEE Computer Soc., pp. 113-117.
Dolson, Mark, "The Phase Vocoder: A Tutorial," 1986, Computer Music Journal, 10(4):14-27.
Moulines, E., et al., "Pitch-Synchronous Waveform Processing Techniques for Text-to-Speech Synthesis Using Diphones," 1990, Speech Communication, 9(5/6):453-467.
Serra, X., et al., "Spectral Modeling Synthesis: A Sound Analysis/Synthesis System Based on a Deterministic Plus Stochastic Decomposition," 1990, In Proc. of Int. Computer Music Conf., pp. 281-284, San Francisco, CA.
Truax, Barry, "Discovering Inner Complexity: Time Shifting and Transposition with a Real-Time Granulation Technique," 1994, Computer Music J., 18(2):38-48.
Carroll, Tim, "Audio Metadata: You Can Get There from Here," Oct. 11, 2004, pp. 1-4, Retrieved from the Internet: URL:http://tvtechnology.com/features/audio.sub.-notes/f-TC-metadta-8.21.- 02.shtml.
Painter, T., et al., "Perceptual Coding of Digital Audio", Proceedings of the IEEE, New York, NY, vol. 88, No. 4, Apr. 2000, pp. 451-513.
Swanson, M. D., et al., "Multiresolution Video Watermarking Using Perceptual Models and Scene Segmentation," Proceedings of the International Conference on Image Processing, Santa Barbara, Ca, Oct. 26-29, 1997, Los Alamitos, CA IEEE Computer Society, US, vol. 2, Oct. 1997, pp. 558-561.
Todd, et al., "AC-3: Flexible Perceptual Coding for Audio Transmission and Storage," 96.sup.th Convention of the Audio Engineering Society, Preprint 3796, Feb. 1994, pp. 1-16.
Moore, B. C. J., et al., "A Model for the Prediction of Thresholds, Loudness and Partial Loudness," Journal of the Audio Engineering Society, New York, NY vol. 45, No. 4, Apr. 1, 1997, pp. 224-240.

Glasberg, B. R., et al., "A Model of Loudness Applicable to Time-Varying Sounds," Audio Engineering Society, New York, NY, vol. 50, No. 5, May 2002, pp. 331-342.
Hauenstein, M., "A Computationally Efficient Algorithm for Calculating Loudness Patterns of Narrowband Speech," Acoustics, Speech and Signal Processing, 1997, IEEE International Conference, Munich, Germany, Apr. 21-24, 1997, Los Alamitos, CA USE, IEEE Comput. Soc. US Apr. 21, 1997, pp. 1311-1314.
PCT/US02/04317, filed Feb. 12, 2002—International Search Report dated Oct. 15, 2002.
Laroche, Jean, "Autocorrelation Method for High-Quality Time/Pitch-Scaling," Telecom Paris, Departement Signal, 75634 Paris Cedex 13. France, email: laroche@sig.enst.fr, 1993.
Australian Patent Office—Feb. 19, 2007—Examiner's first report on application No. 2002248431.
Chinese Patent Office—Apr. 22, 2005—Notification of First Office Action for Application No. 02808144.7.
Chinese Patent Office—Dec. 9, 2005—Notification of Second Office Action for Application No. 02808144.7.
Malaysian Patent Office—Apr. 7, 2006—Substantive Examination Adverse Report—Section 30(1)/30(2)) for Application No. PI 20021371.
U.S. Appl. No. 10/476,347, filed Oct. 28, 2003, Brett Graham Crockett—Feb. 12, 2007 Office Action.
U.S. Appl. No. 10/476,347, filed Oct. 28, 2003, Brett Graham Crockett—May 14, 2007 Response to Office Action.
PCT/US02/12957, filed Apr. 25, 2002—International Search Report dated Aug. 12, 2002.
Vanfin, et al., "Modifying Transients for Efficient Coding of Audio," IEEE, pp. 3285-3288, Apr. 2001.
Vanfin, et al., "Improved Modeling of Audio Signals by Modifying Transient Locations," pp. W2001-W2001-4, Oct. 21-24, 2001, New Paltz, New York.
PCT/US2006/020882, filed May 26, 2006—International Search Report and Written Opinion dated Feb. 20, 2007.
Faller, Christof, "Coding of Spatial Audio Compatible with Different Playback Formats," Audio Engineering Society Convention Paper, presented at the 117.sup.th Convention, pp. 1-12, Oct. 28-31, 2004, San Francisco, CA.
Herre, et al., "MP3 Surround: Efficient and Compatible Coding of Multi-Channel Audio," Audio Engineering Society Convention Paper, presented at the 116.sup.th Convention, pp. 1-14, May 8-11, 2004, Berlin, Germany.
Fielder, et al., "Introduction to Dolby Plus, an Enhancement to the Dolby Digital Coding System," Audio Engineering Society Convention Paper, presented at the 117.sup.th Convention, pp. 1-29, Oct. 28-31, 2004, San Francisco, CA.
Herre, et al., "Spatial Audio Coding: Next-Generation Efficient and Compatible Coding of Multi-Channel Audio," Audio Engineering Society Convention Paper, presented at the 117.sup.th Convention, pp. 1-13, Oct. 28-31, 2004, San Francisco, CA.
Faller, Christof, "Parametric Coding of Spatial Audio," These No. 3062, pp. 1-164, (2004) Lausanne, EPFL.
Herre, et al., "The Reference Model Architecture for MPEG Spatial Audio Coding," Audio Engineering Society Convention Paper, presented at the 118.sup.th Convention, pp. 1-13, May 28-31, 2005, Barcelona, Spain.
Schuijers, et al., "Low Complexity Parametric Stereo Coding," Audio Engineering Society Convention Paper, presented at the 116.sup.th Convention, pp. 1-11, May 8-11, 2004, Berlin, Germany.
PCT/US2006/028874, filed Jul. 24, 2006—Alan Jeffrey Seefeldt and Mark Stuart Vinton—Pending claims in application.
PCT/US2007/008313, filed Mar. 30, 2007—International Search Report and Written Opinion dated Sep. 21, 2007.
Blesser, B., "An Ultraminiature Console Compression System with Maximum User Flexibility," presented Oct. 8, 1971 at the 41.sup.st Convention of the Audio Engineering Society, New York, AES May 1972 vol. 20, No. 4, pp. 297-302.
Hoeg, W., et al., "Dynamic Range Control (DRC) and Music/Speech Control (MSC) Programme-Associated Data Services for DAB" EBU Review—Technical, European Broadcasting Union. Brussels, BE, No. 261, Sep. 21, 1994, pp. 56-70.
Malaysian Patent Office—Apr. 7, 2006—Substantive Examination Adverse Report—Section 30(1) / 30(2)) for Application No. PI 20021371.
Indian Patent Office—Jan. 3, 2007—First Examination Report for Application No. 1308/KOLNP/2003-J.

* cited by examiner

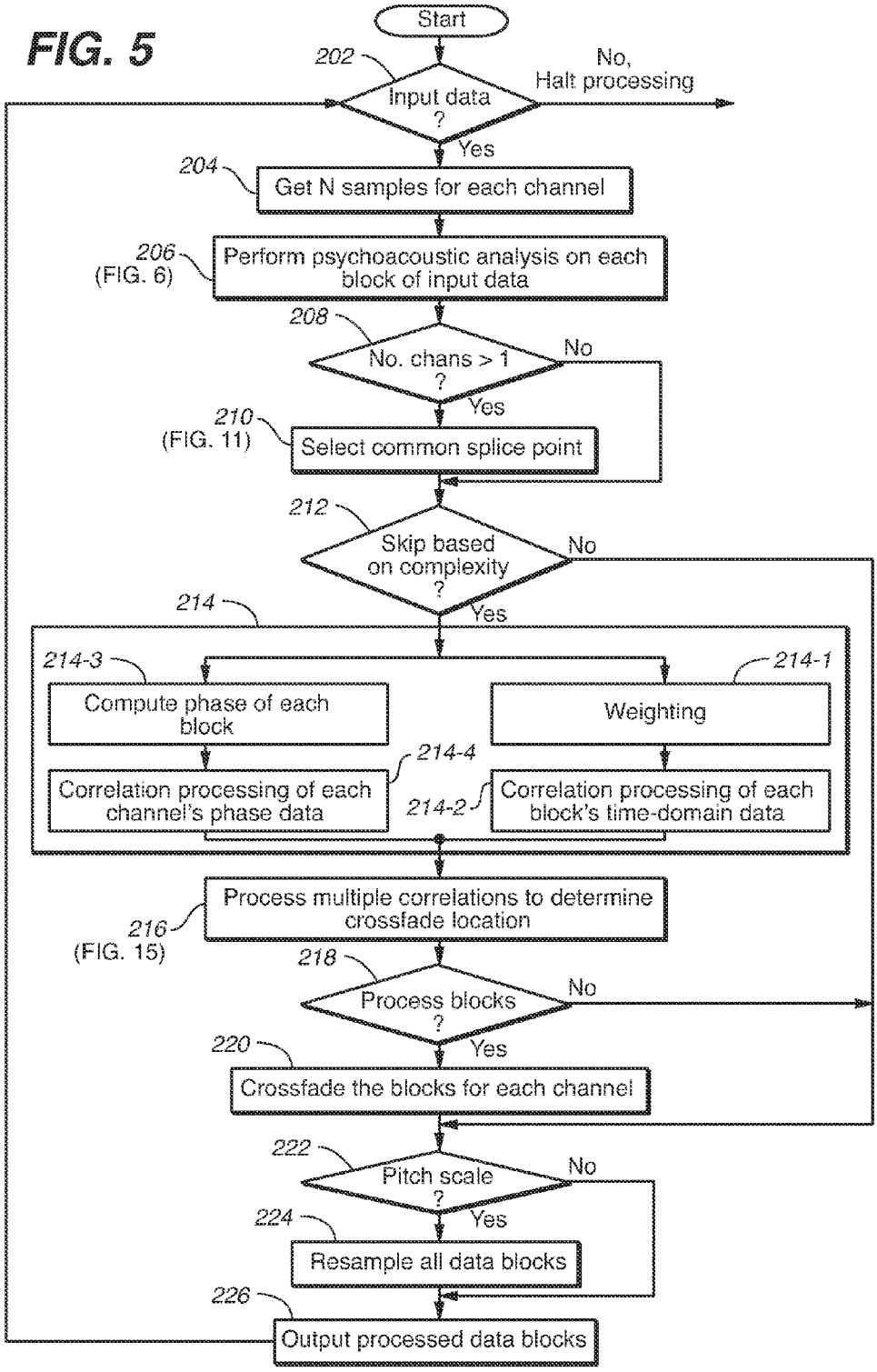
FIG. 5
Start
202
Input data ?
No, Halt processing
Yes
204
Get N samples for each channel
206 (FIG. 6)
Perform psychoacoustic analysis on each block of input data
208
No. chans > 1 ?
No
Yes
210 (FIG. 11)
Select common splice point
212
Skip based on complexity ?
No
Yes
214
214-3
Compute phase of each block
214-1
Weighting
214-4
Correlation processing of each channel's phase data
214-2
Correlation processing of each block's time-domain data
216 (FIG. 15)
Process multiple correlations to determine crossfade location
218
Process blocks ?
No
Yes
220
Crossfade the blocks for each channel
222
Pitch scale ?
No
Yes
224
Resample all data blocks
226
Output processed data blocks

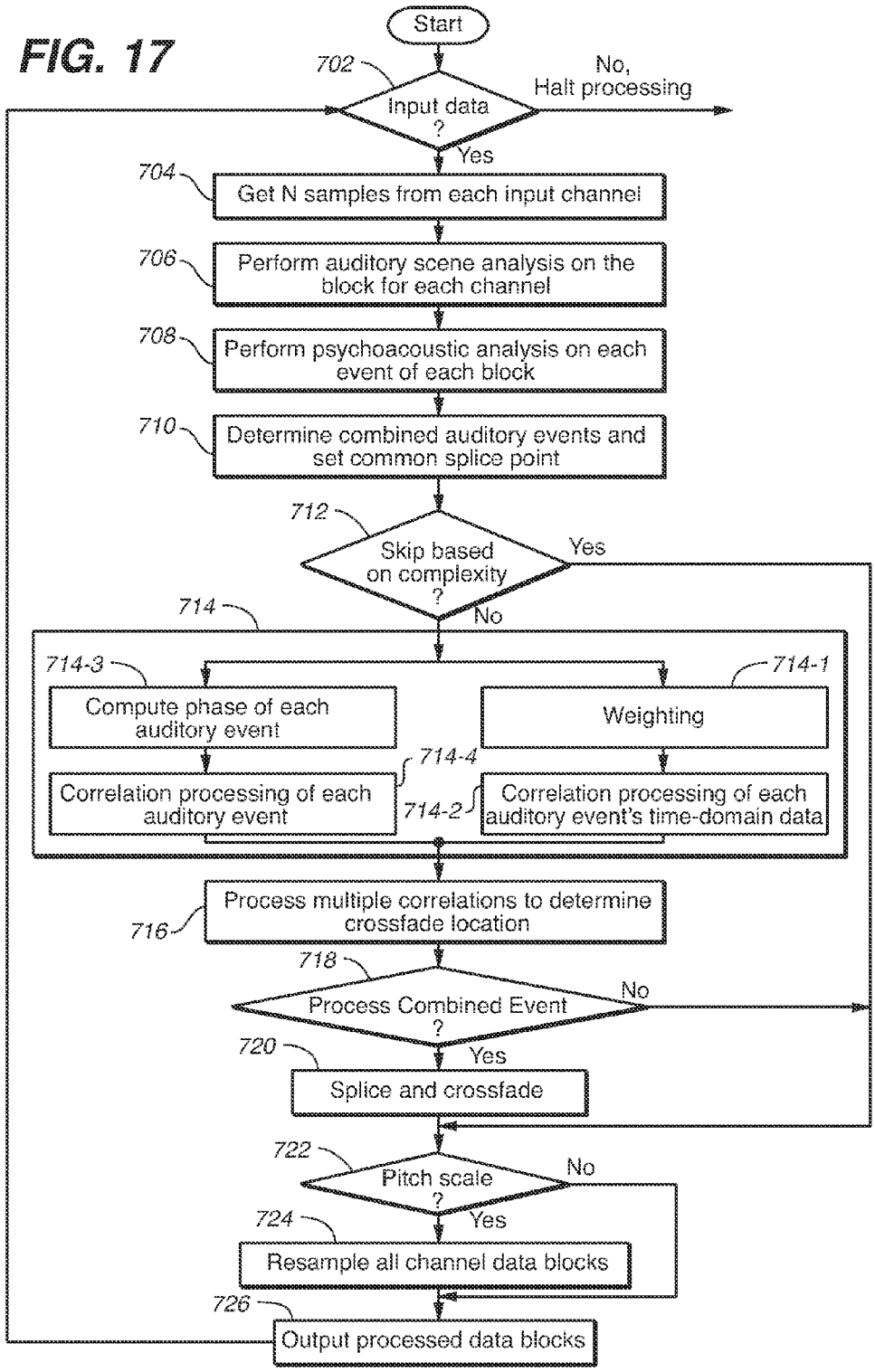
FIG. 17
Start
702
Input data ?
No, Halt processing
Yes
704
Get N samples from each input channel
706
Perform auditory scene analysis on the block for each channel
708
Perform psychoacoustic analysis on each event of each block
710
Determine combined auditory events and set common splice point
712
Skip based on complexity ?
Yes
No
714
714-3
Compute phase of each auditory event
714-1
Weighting
714-4
Correlation processing of each auditory event
714-2
Correlation processing of each auditory event's time-domain data
716
Process multiple correlations to determine crossfade location
718
Process Combined Event ?
No
Yes
720
Splice and crossfade
722
Pitch scale ?
No
Yes
724
Resample all channel data blocks
726
Output processed data blocks

HIGH QUALITY TIME-SCALING AND PITCH-SCALING OF AUDIO SIGNALS

CROSS REFERENCE TO RELATED APPLICATIONS

This application is a continuation of U.S. patent application Ser. No. 10/474,387 filed on Oct. 7, 2003, which is, in turn, a National Stage of PCT application PCT/US02/04317 filed on Feb. 12, 2002, which is, in turn, a continuation-in-part of U.S. patent application Ser. No. 10/045,644 filed on Jan. 11, 2002, which is, in turn, a continuation-in-part of U.S. patent application Ser. No. 09/922,394 filed on Aug. 2, 2001, and which is, in turn, a continuation of U.S. patent application Ser. No. 09/834,739, filed Apr. 13, 2001. PCT application PCT/US02/04317 also claims the benefit of U.S. Provisional Application Ser. No. 60/293,825 filed on May 25, 2001. PCT application PCT/US02/04317 is also a continuation-in-part of said U.S. patent application Ser. No. 09/922,394 filed on Aug. 2, 2001 and a continuation-in-part of said U.S. patent application Ser. No. 09/834,739, filed Apr. 13, 2001,

TECHNICAL FIELD

The present invention pertains to the field of psychoacoustic processing of audio signals. In particular, the invention relates to aspects of where and/or how to perform time scaling and/or pitch scaling (pitch shifting) of audio signals. The processing is particularly applicable to audio signals represented by samples, such as digital audio signals. The invention also relates to aspects of dividing audio into "auditory events," each of which tends to be perceived as separate.

BACKGROUND ART

Time scaling refers to altering the time evolution or duration of an audio signal while not altering the spectral content (perceived timbre) or perceived pitch of the signal (where pitch is a characteristic associated with periodic audio signals). Pitch scaling refers to modifying the spectral content or perceived pitch of an audio signal while not affecting its time evolution or duration. Time scaling and pitch scaling are dual methods of one another. For example, a digitized audio signal's pitch may be scaled up by 5% without affecting its time duration by increasing the time duration of the signal by time scaling it by 5% and then reading out the samples at a 5% higher sample rate (e.g., by resampling), thereby maintaining its original time duration. The resulting signal has the same time duration as the original signal but with modified pitch or spectral characteristics. As discussed further below, resampling may be applied but is not an essential step unless it is desired to maintain a constant output sampling rate or to maintain the input and output sampling rates the same.

There are many uses for a high quality method that provides independent control of the time and pitch characteristics of an audio signal. This is particularly true for high fidelity, multichannel audio that may contain wide ranging content from simple tone signals to voice signals and complex musical passages. Uses for time and pitch scaling include audio/video broadcast, audio/video postproduction synchronization and multi-track audio recording and mixing. In the audio/video broadcast and post production environment it may be necessary to play back the video at a different rate from the source material, resulting in a pitch-scaled version of the accompanying audio signal. Pitch scaling the audio can maintain synchronization between the audio and video while preserving the timbre and pitch of the original source material. In multi-track audio or audio/video postproduction, it may be required for new material to match the time-constrained duration of an audio or video piece. Time-scaling the audio can time-constrain the new piece of audio without modifying the timbre and pitch of the source audio.

DISCLOSURE OF THE INVENTION

In accordance with an aspect of the present invention, a method for time scaling and/or pitch shifting an audio signal is provided. The signal is analyzed using multiple psychoacoustic criteria to identify a region of the audio signal in which the time scaling and/or pitch shifting processing of the audio signal would be inaudible or minimally audible, and the signal is time scaled and/or pitch shifted within that region.

In accordance with a further aspect of the present invention, a method for time scaling and/or pitch shifting multiple channels of audio signals is provided. Each of the channels of audio signals is analyzed using at least one psychoacoustic criterion to identify regions in the channels of audio signals in which the time scaling and/or pitch shifting processing of the audio signals would be inaudible or minimally audible, and all of the multiple channels of audio signals are time scaled and/or pitch shifted during a time segment that is within an identified region in at least one of the channels of audio signals.

In accordance with a further aspect of the present invention, a method for time scaling and/or pitch shifting an audio signal is provided in which the audio signal is divided into auditory events, and the signal is time scaled and/or pitch shifted within an auditory event.

In accordance with yet another aspect of the present invention, a method for time scaling and/or pitch shifting a plurality of audio signal channels is provided in which the audio signal in each channel is divided into auditory events. Combined auditory events are determined, each having a boundary when an auditory event boundary occurs in any of the audio signal channels. All of the audio signal channels are time scaled and/or pitch shifted within a combined auditory event, such that time scaling and/or pitch shifting is within an auditory event in each channel.

In accordance with yet a further aspect of the present invention, a method for time scaling and/or pitch shifting an audio signal is provided in which the signal is divided into auditory events, and the auditory events are analyzed using a psychoacoustic criterion to identify those auditory events in which the time scaling and/or pitch shifting processing of the audio signal would be inaudible or minimally audible. Time-scaling and/or pitch shifting processing is done within an auditory event identified as one in which the time scaling and/or pitch shifting processing of the audio signal would be inaudible or minimally audible.

In accordance with yet another aspect of the present invention, a method for time scaling and/or pitch shifting multiple channels of audio signals is provided in which the audio signal in each channel is divided into auditory events. The auditory events are analyzed using at least one psychoacoustic criterion to identify those auditory events in which the time scaling and/or pitch shifting processing of the audio signal would be inaudible or minimally audible. Combined auditory events are determined, each having a boundary where an auditory event boundary occurs in the audio signal of any of the channels. Time-scaling and/or pitch shifting processing is done within a combined auditory event identified as one in which the time scaling and/or pitch shifting processing in the multiple channels of audio signals would be inaudible or minimally audible.

According to yet a further aspect of the invention, analyzing the audio signal using multiple psychoacoustic criteria includes analyzing the audio signal to identify a region of the audio signal in which the audio satisfies at least one criterion of a group of psychoacoustic criteria.

According to still yet a further aspect of the invention, the psychoacoustic criteria include one or more of the following: (1) the identified region of the audio signal is substantially premasked or postmasked as the result of a transient, (2) the identified region of the audio signal is substantially inaudible, (3) the identified region of the audio signal is predominantly at high frequencies, and (4) the identified region of the audio is a quieter portion of a segment of the audio signal in which a portion or portions of the segment preceding and/or following the region is louder. Some basic principles of psychoacoustic masking are discussed below.

An aspect of the invention is that the group of psychoacoustic criteria may be arranged in a descending order of the increasing audibility of artifacts (i.e., a hierarchy of criteria) resulting from time scaling and/or pitch scaling processing. According to another aspect of the invention, a region is identified when the highest-ranking psychoacoustic criterion (i.e., the criterion leading to the least audible artifacts) is satisfied. Alternatively, even if a criterion is satisfied, other criteria may be sought in order to identify one or more other regions in the audio that satisfies a criterion. The latter approach may be useful in the case of multichannel audio in order to determine the position of all possible regions satisfying any of the criteria, including those further down the hierarchy, so that there are more possible common splice points among the multiple channels.

Although aspects of the invention may employ other types of time scaling and/or pitch shifting processing (see, for example the process disclosed in published U.S. Pat. No. 6,266,003 B1, which patent is hereby incorporated by reference in its entirety), aspects of the present invention may advantageously employ a type of time scaling and/or pitch shifting processing in which:

a splice point is selected in a region of the audio signal, thereby defining a leading segment of the audio signal that leads the splice point in time, an end point spaced from the splice point is selected, thereby defining a trailing segment of the audio signal that trails the endpoint in time, and a target segment of the audio signal between the splice and end points, the leading and trailing segments are joined at the splice point, thereby shortening the time period of the audio signal (in the case of a digital audio signal represented by samples, decreasing the number of audio signal samples) by omitting the target segment when the end point is later in time (has a higher sample number) than said splice point, or lengthening the time period (increasing the number of samples) by repeating the target segment when the end point is earlier in time (has a lower sample number) than said splice point, and reading out the joined leading and trailing segments at a rate that yields a desired time scaling and/or pitch shifting.

The joined leading and trailing segments may be read out at a rate such that:

a time duration the same as the original time duration results in pitch shifting the audio signal, a time duration decreased by the same proportion as the relative change in the reduction in the number of samples, in the case of omitting the target segment, results in time compressing the audio signal, a time duration increased by the same proportion as the relative change in the increase in the number of samples, in the case of repeating the target segment, results in time expanding the audio signal, a time duration decreased by a proportion different from the relative change in the reduction in the number of samples results in time compressing and pitch shifting the audio signal, or a time duration increased by a proportion different from the relative change in the increase in the number of samples results in time expansion and pitch shifting the audio signal.

Whether a target segment is omitted (data compression) or repeated (data expansion), there is only one splice point and one splice. In the case of omitting the target segment, the splice is where the splice point and end point of the omitted target segment are joined together or spliced. In the case of repeating a target segment, there is still only a single splice—the splice is where the end of the first rendition of the target segment (the splice point) meets the start of the second rendition of the target segment (the end point). For the case of reducing the number of audio samples (data compression), for criteria other than premasking or postmasking, it may be desirable that the end point is within the identified region (in addition to the splice point, which should always be within the identified region). For the case of compression in which the splice point is premasked or postmasked by a transient the end point need not be within the identified region. For other cases (except when processing takes place within an auditory event, as described below), it is preferred that the end point be within the identified region so that nothing is omitted or repeated that might be audible. In the case of increasing the number of audio samples (data expansion), the end point in the original audio preferably is within the identified region of the audio signal. As described below, possible splice point locations have an earliest and a latest time and possible end point locations have an earliest and latest time. When the audio is represented by samples within a block of data in a buffer memory, the possible splice point locations have minimum and maximum locations within the block, which represent earliest and a latest possible splice point times, respectively and the end point also has minimum and maximum locations within the block, which represent earliest and latest end point times, respectively.

In processing multichannel audio, it is desirable to maintain relative amplitude and phase relationships among the channels, in order not to disturb directional cues. Thus, if a target segment of audio in one channel is to be omitted or repeated, the corresponding segments (having the same sample indices) in other channels should also be omitted or repeated. It is therefore necessary to find a target segment substantially common to all channels that permits inaudible splicing in all channels.

Definitions

Throughout this document, the term "data compression" refers to reducing the number of samples by omitting a segment, leading to time compression, and the term "data expansion" refers to increasing the number of samples by repeating a segment, leading to time expansion. An audio "region", "segment", and "portion" each refer to a representation of a finite continuous portion of the audio from a single channel that is conceptually between any two moments in time. Such a region, segment, or portion may be represented by samples having consecutive sample or index numbers. "Identified region" refers to a region, segment or portion of audio identified by psychoacoustic criteria and within which the splice point, and usually the end point, will lie. "Correlation processing region" refers to a region, segment or portion of audio over which correlation is performed in the search for an end point or a splice point and an end point. "Psychoacoustic criteria" may include criteria based on time domain masking, frequency domain masking, and/or other psychoacoustic factors. As noted above, the "target segment" is that portion of audio that is removed, in the case of data compression, or repeated, in the case of data expansion.

Masking

Aspects of the present invention take advantage of human hearing and, in particular, the psychoacoustic phenomenon known as masking. Some simplified masking concepts may be appreciated by reference to FIG. 1 and the following discussion. The solid line 10 in FIG. 1 shows the sound pressure level at which sound, such as a sine wave or a narrow band of noise, is just audible, that is, the threshold of hearing. Sounds at levels above the curve are audible; those below it are not. This threshold is clearly very dependent on frequency. One is able to hear a much softer sound at say 4 kHz than at 50 Hz or 15 kHz. At 25 kHz, the threshold is off the scale: no matter how loud it is, one cannot hear it.

Consider the threshold in the presence of a relatively loud signal at one frequency, say a 500 Hz sine wave at 12. The modified threshold 14 rises dramatically in the immediate neighborhood of 500 Hz, modestly somewhat further away in frequency, and not at all at remote parts of the audible range.

This rise in the threshold is called masking. In the presence of the loud 500 Hz sine wave signal (the "masking signal" or "masker"), signals under this threshold, which may be referred to as the "masking threshold", are hidden, or masked, by the loud signal. Further away, other signals can rise somewhat in level above the no-signal threshold, yet still be below the new masked threshold and thus be inaudible. However, in remote parts of the spectrum in which the no-signal threshold is unchanged, any sound that was audible without the 500 Hz masker will remain just as audible with it. Thus, masking is not dependent upon the mere presence of one or more masking signals; it depends upon where they are spectrally. Some musical passages, for example, contain many spectral components distributed across the audible frequency range, and therefore give a masked threshold curve that is raised everywhere relative to the no-signal threshold curve. Other musical passages, for example, consist of relatively loud sounds from a solo instrument having spectral components confined to a small part of the spectrum, thus giving a masked curve more like the sine wave masker example of FIG. 1.

Masking also has a temporal aspect that depends on the time relationship between the masker(s) and the masked signal(s). Some masking signals provide masking essentially only while the masking signal is present ("simultaneous masking"). Other masking signals provide masking not only while the masker occurs but also earlier in time ("backward masking" or "premasking") and later in time ("forward masking" or "postmasking"). A "transient", a sudden, brief and significant increase in signal level, may exhibit all three "types" of masking: backward masking, simultaneous masking, and forward masking, whereas, a steady state or quasi-steady-state signal may exhibit only simultaneous masking. In the context of the present invention, advantage should not be taken of the simultaneous masking resulting from a transient because it is undesirable to disturb a transient by placing a splice coincident or nearly coincident with it.

Audio transient data has long been known to provide both forward and backward temporal masking. Transient audio material "masks" audible material both before and after the transient such that the audio directly preceding and following is not perceptible to a listener (simultaneous masking by a transient is not employed to avoid repeating or disrupting the transient). Pre-masking has been measured and is relatively short and lasts only a few msec (milliseconds) while post-masking can last longer than 50 msec. Both pre- and post-transient masking may be exploited in connection with aspects of the present invention although postmasking is generally more useful because of its longer duration.

One aspect of the present invention is transient detection. In a practical implementation described below, subblocks (portions of a block of audio samples) are examined. A measure of their magnitudes is compared to a smoothed moving average representing the magnitude of the signal up to that point. The operation may be performed separately for the whole audio spectrum and for high frequencies only, to ensure that high-frequency transients are not diluted by the presence of larger lower frequency signals and, hence, missed. Alternatively, any suitable known way to detect transients may be employed.

A splice may create a disturbance that results in artifacts having spectral components that decay with time. The spectrum (and amplitude) of the splicing artifacts depends on: (1) the spectra of the signals being spliced (as discussed further below, it is recognized that the artifacts potentially have a spectrum different from the signals being spliced), (2) the extent to which the waveforms match when joined together at the splice point (avoidance of discontinuities), and (3) the shape and duration of the crossfade where the waveforms are joined together at the splice point. Crossfading in accordance with aspects of the invention is described further below. Correlation techniques to assist in matching the waveforms where joined are also described below. According to an aspect of the present invention, it is desirable for the splicing artifacts to be masked or inaudible or minimally audible. The psychoacoustic criteria contemplated by aspects of the present invention include criteria that should result in the artifacts being masked, inaudible, or minimally audible. Inaudibility or minimal audibility may be considered as types of masking. Masking requires that the artifacts be constrained in time and frequency so as to be below the masking threshold of the masking signal(s) (or, in the absence of a masking signal(s), below the no-signal threshold of audibility, which may be considered a form of masking). The duration of the artifacts is well defined, being, to a first approximation, essentially the length (time duration) of the crossfade. The slower the crossfade, the narrower the spectrum of the artifacts but the longer their duration.

Some general principles as to rendering a splice inaudible or minimally audible may be appreciated by considering a continuum of rising signal levels. Consider the case of splicing low-level signals that provide little or no masking. A well-performed splice (i.e., well-matched waveforms with minimal discontinuity) will introduce artifacts somewhat lower in amplitude, probably below the hearing threshold, so no masking signal is required. As the levels are raised, the signals begin to act as masking signals, raising the hearing threshold. The artifacts also increase in magnitude, so that they are above the no-signal threshold, except that the hearing threshold has also been raised (as discussed above in connection with FIG. 1).

Ideally, in accordance with an aspect of the present invention, for a transient to mask the artifacts, the artifacts occur in the backward masking or forward masking temporal region of the transient and the amplitude of every artifact's spectral component is below the masking threshold of the transient at every instant in time. However, in practical implementations, not all spectral components of the artifacts may be masked at all instants of time.

Ideally, in accordance with another aspect of the present invention, for a steady state or quasi-steady-state signal to mask the artifacts, the artifacts occur at the same time as the masking signal (simultaneous masking) and every spectral component is below the masking threshold of the steady-state signal at every instant in time.

There is a further possibility in accordance with yet another aspect of the present invention, which is that the amplitude of the spectral components of the artifacts is below the no-signal threshold of human audibility. In this case, there need not be any masking signal although such inaudibility may be considered to be a masking of the artifacts.

In principle, with sufficient processing power and/or processing time, it is possible to forecast the time and spectral characteristics of the artifacts based on the signals being spliced in order to determine if the artifacts will be masked or inaudible. However, to save processing power and time, useful results may be obtained by considering the magnitude of the signals being spliced in the vicinity of the splice point (particularly within the crossfade), or, in the case of a steady-state or quasi-steady-state predominantly high-frequency identified region in the signal, merely by considering the frequency content of the signals being spliced without regard to magnitude.

The magnitudes of artifacts resulting from a splice are in general smaller than or similar to those of the signals being spliced. However, it is not, in general, practical to predict the spectrum of the artifacts. If a splice point is within a region of the audio signal below the threshold of human audibility, the resulting artifacts, although smaller or comparable in magnitude, may be above the threshold of human audibility, because they may contain frequencies where the ear is more sensitive (has a lower threshold). Hence, in assessing audibility, it is preferable to compare signal amplitudes with a fixed level, the threshold of hearing at the ear's most sensitive frequency (around 4 kHz), rather than with the true frequency-dependent threshold of hearing. This conservative approach ensures that the processing artifacts will be below the actual threshold of hearing wherever they appear in the spectrum. In this case, the length of the crossfade should not affect audibility, but it may be desirable to use a relatively short crossfade in order to allow the most room for data compression or expansion.

The human ear has a lack of sensitivity to discontinuities in predominantly high-frequency waveforms (e.g., a high-frequency click, resulting from a high-frequency waveform discontinuity, is more likely to be masked or inaudible than is a low-frequency click). In the case of high-frequency waveforms, the components of the artifacts will also be predominantly high frequency and will be masked regardless of the signal magnitudes at the splice point (because of the steady-state or quasi-steady-state nature of the identified region, the magnitudes at the splice point will be similar to those of the signals in the identified region that act as maskers). This may be considered as a case of simultaneous masking. In this case, although the length of the crossfade probably does not affect the audibility of artifacts, it may be desirable to use a relatively short crossfade in order to allow the most room for data compression or expansion processing.

If the splice point is within a region of the audio signal identified as being masked by a transient (i.e., either by premasking or postmasking), the magnitude of each of the signals being spliced, taking into account the applied crossfading characteristics, including the crossfading length, determines if a particular splice point will be masked by the transient. The amount of masking provided by a transient decays with time. Thus, in the case of premasking or post masking by a transient, it is desirable to use a relatively short crossfade, leading to a greater disturbance but one that lasts for a shorter time and that is more likely to lie within the time duration of the premasking or postmasking.

When the splice point is within a region of the audio signal that is not premasked or postmasked as a result of a transient, an aspect of the present invention is to choose the quietest sub-segment of the audio signal within a segment of the audio signal (in practice, the segment may be a block of samples in a buffer memory). In this case, the magnitude of each of the signals being spliced, taking into account the applied crossfading characteristics, including the crossfading length, determines the extent to which the artifacts caused by the splicing disturbance will be audible. If the level of the sub-segment is low, the level of the artifact components will also be low. Depending on the level and spectrum of the low sub-segment, there may be some simultaneous masking. In addition, the higher-level portions of the audio surrounding the low-level sub-segment may also provide some temporal premasking or postmasking, raising the threshold during the crossfade. The artifacts may not always be inaudible, but will be less audible than if the splice had been performed in the louder regions. Such audibility may be minimized by employing a longer crossfade length and matching well the waveforms at the splice point. However, a long crossfade limits the length and position of the target segment, since it effectively lengthens the passage of audio that is going to be altered and forces the splice and/or end points to be further from the ends of a block (in a practical case in which the audio samples are divided into blocks). Hence, the maximum crossfade length is a compromise.

Auditory Scene Analysis

Although employing psychoacoustic analysis is useful in reducing undesirable audible artifacts in a process to provide time and/or pitch scaling, reductions in undesirable audible artifacts may also be achieved by dividing audio into time segments, which may be referred to as "events" or "auditory events", each of which tends to be perceived as separate, and by performing time-scaling and/or pitch scaling processing within the events. The division of sounds into units perceived as separate is sometimes referred to as "auditory event analysis" or "auditory scene analysis" ("ASA"). Although psychoacoustic analysis and auditory scene analysis may be employed independently as aids in reducing undesirable artifacts in a time and/or pitch scaling process, they may be advantageously employed in conjunction with each other.

Providing time and/or pitch scaling in conjunction with (1) psychoacoustic analysis alone, (2) auditory scene analysis alone, and (3) psychoacoustic and auditory scene analysis in conjunction with each other are all aspects of the present invention. Further aspects of the present invention include the employment of psychoacoustic analysis and/or auditory scene analysis as a part of time and/or pitch scaling of types other than those in which segments of audio are deleted or repeated. For example, the processes for time scale and/or pitch modification of audio signals disclosed in published U.S. Pat. No. 6,266,003 B1 may be improved by employing the publication's processing techniques only to audio segments that satisfy one or more of the psychoacoustic criteria disclosed herein and/or only to audio segments each of which do not exceed an auditory event.

An extensive discussion of auditory scene analysis is set forth by Albert S. Bregman in his book *Auditory Scene Analysis—The Perceptual Organization of Sound*, Massachusetts Institute of Technology, 1991, Fourth printing, 2001, Second MIT Press paperback edition.) In addition, U.S. Pat. No. 6,002,776 to Bhadkamkar, et al, Dec. 14, 1999 cites publications dating back to 1976 as "prior art work related to sound separation by auditory scene analysis." However, the Bhadkamkar, et al patent discourages the practical use of auditory scene analysis, concluding that "[t]echniques involving auditory scene analysis, although interesting from a scientific point of view as models of human auditory processing, are currently far too computationally demanding and specialized to be considered practical techniques for sound separation until fundamental progress is made."

In accordance with aspects of the present invention, a computationally efficient process for dividing audio into temporal segments or "auditory events" that tend to be perceived as separate is provided.

Bregman notes in one passage that "[w]e hear discrete units when the sound changes abruptly in timbre, pitch, loudness, or (to a lesser extent) location in space." (*Auditory Scene Analysis—The Perceptual Organization of Sound*, supra at page 469). Bregman also discusses the perception of multiple simultaneous sound streams when, for example, they are separated in frequency.

In order to detect changes in timbre and pitch and certain changes in amplitude, the auditory event detection process according to an aspect of the present invention detects changes in spectral composition with respect to time. When applied to a multichannel sound arrangement in which the channels represent directions in space, the process according to an aspect of the present invention also detects auditory events that result from changes in spatial location with respect to time. Optionally, according to a further aspect of the present invention, the process may also detect changes in amplitude with respect to time that would not be detected by detecting changes in spectral composition with respect to time. Performing time-scaling and/or pitch-scaling within an auditory event is likely to lead to fewer audible artifacts because the audio within an event is reasonably constant, is perceived to be reasonably constant, or is an audio entity unto itself (e.g., a note played by an instrument).

In its least computationally demanding implementation, the process divides audio into time segments by analyzing the entire frequency band (full bandwidth audio) or substantially the entire frequency band (in practical implementations, band limiting filtering at the ends of the spectrum are often employed) and giving the greatest weight to the loudest audio signal components. This approach takes advantage of a psychoacoustic phenomenon in which at smaller time scales (20 msec and less) the ear may tend to focus on a single auditory event at a given time. This implies that while multiple events may be occurring at the same time, one component tends to be perceptually most prominent and may be processed individually as though it were the only event taking place. Taking advantage of this effect also allows the auditory event detection to scale with the complexity of the audio being processed. For example, if the input audio signal being processed is a solo instrument, the auditory events that are identified will likely be the individual notes being played. Similarly for an input voice signal, the individual components of speech, the vowels and consonants for example, will likely be identified as individual audio elements. As the complexity of the audio increases, such as music with a drumbeat or multiple instruments and voice, the auditory event detection identifies the most prominent (i.e., the loudest) audio element at any given moment. Alternatively, the "most prominent" audio element may be determined by taking hearing threshold and frequency response into consideration.

Optionally, according to further aspects of the present invention, at the expense of greater computational complexity, the process may also take into consideration changes in spectral composition with respect to time in discrete frequency bands (fixed or dynamically determined or both fixed and dynamically determined bands) rather than the full bandwidth. This alternative approach would take into account more than one audio stream in different frequency bands rather than assuming that only a single stream is perceptible at a particular time.

Even a simple and computationally efficient process according to an aspect of the present invention for segmenting audio has been found usefully to identify auditory events and, when employed with time and/or pitch modification techniques, to reduce audible artifacts.

An auditory event detecting process of the present invention may be implemented by dividing a time domain audio waveform into time intervals or blocks and then converting the data in each block to the frequency domain, using either a filter bank or a time-frequency transformation, such as the FFT. The amplitude of the spectral content of each block may be normalized in order to eliminate or reduce the effect of amplitude changes. Each resulting frequency domain representation provides an indication of the spectral content (amplitude as a function of frequency) of the audio in the particular block. The spectral content of successive blocks is compared and changes greater than a threshold may be taken to indicate the temporal start or temporal end of an auditory event.

In order to minimize the computational complexity, only a single band of frequencies of the time domain audio waveform may be processed, preferably either the entire frequency band of the spectrum (which may be about 50 Hz to 15 kHz in the case of an average quality music system) or substantially the entire frequency band (for example, a band defining filter may exclude the high and low frequency extremes).

The degree to which the frequency domain data needs to be normalized gives an indication of amplitude. Hence, if a change in this degree exceeds a predetermined threshold, that too may be taken to indicate an event boundary. Event start and end points resulting from spectral changes and from amplitude changes may be ORed together so that event boundaries resulting from either type of change are identified.

In practice, the auditory event temporal start and stop point boundaries necessarily will each coincide with a boundary of the blocks into which the time domain audio waveform is divided. There is a trade off between real-time processing requirements (as larger blocks require less processing overhead) and resolution of event location (smaller blocks provide more detailed information on the location of auditory events).

In the case of multiple audio channels, each representing a direction in space, each channel may be treated independently and the resulting event boundaries for all channels may then be ORed together. Thus, for example, an auditory event that abruptly switches directions will likely result in an "end of event" boundary in one channel and a "start of event" boundary in another channel. When ORed together, two events will be identified. Thus, the auditory event detection process of the present invention is capable of detecting auditory events based on spectral (timbre and pitch), amplitude and directional changes.

As a further option, but at the expense of greater computational complexity, instead of processing the spectral content of the time domain waveform in a single band of frequencies, the spectrum of the time domain waveform prior to frequency domain conversion may be divided into two or more frequency bands. Each of the frequency bands may then be converted to the frequency domain and processed as though it were an independent channel in the manner described above. The resulting event boundaries may then be ORed together to define the event boundaries for that channel. The multiple frequency bands may be fixed, adaptive, or a combination of fixed and adaptive. Tracking filter techniques employed in audio noise reduction and other arts, for example, may be employed to define adaptive frequency bands (e.g., dominant simultaneous sine waves at 800 Hz and 2 kHz could result in two adaptively-determined bands centered on those two frequencies).

Other techniques for providing auditory scene analysis may be employed to identify auditory events in various aspects of the present invention.

In practical embodiments set forth herein, audio is divided into fixed length sample blocks. However, the principles of the various aspects of the invention do not require arranging the audio into sample blocks, nor, if they are, of providing blocks of constant length (blocks may be of variable length, each of which is essentially the length of an auditory event). When the audio is divided into blocks, a further aspect of the invention, in both single channel and multichannel environments, is not to process certain blocks.

Other aspects of the invention will be appreciated and understood as the detailed description of the invention is read and understood.

DESCRIPTION OF THE DRAWINGS

FIG. 5 is a flow chart setting forth a time and pitch-scaling process according to an aspect of the present invention in which psychoacoustic analysis is performed.

FIG. 15 includes idealized waveforms showing the results of phase correlations in each of five audio channels and the results of time-domain correlations in each of five channels. The waveforms represent blocks of audio data samples. The horizontal axes are samples representing time and the vertical axes are normalized amplitude.

FIG. 17 is a flow chart setting forth a time and pitch-scaling process according to an aspect of the present invention in which both psychoacoustic analysis and auditory scene analysis are performed.

BEST MODE FOR CARRYING OUT THE INVENTION

Figure 1:
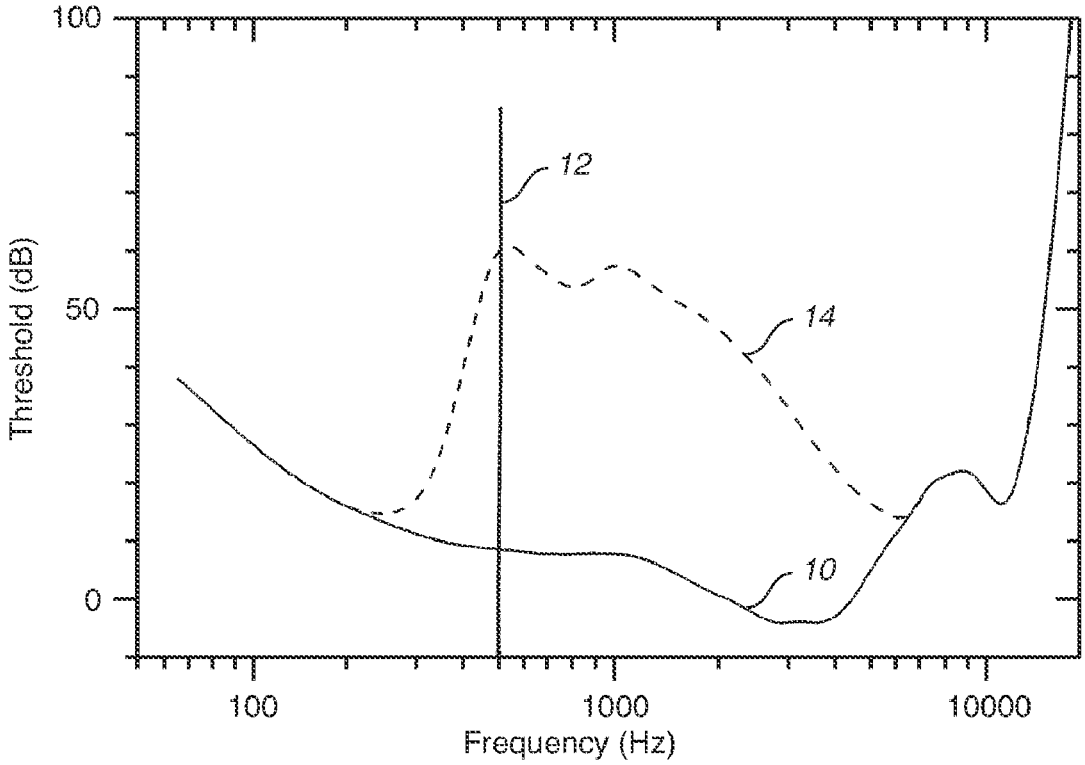
FIG. 1 is an idealized plot of a human hearing threshold in the presence of no sounds (solid line) and in the presence of a 500 Hz sine wave (dashed lines). The horizontal scale is frequency in Hertz (Hz) and the vertical scale is in decibels (dB) with respect to 20 μPa.
Figure 2A:
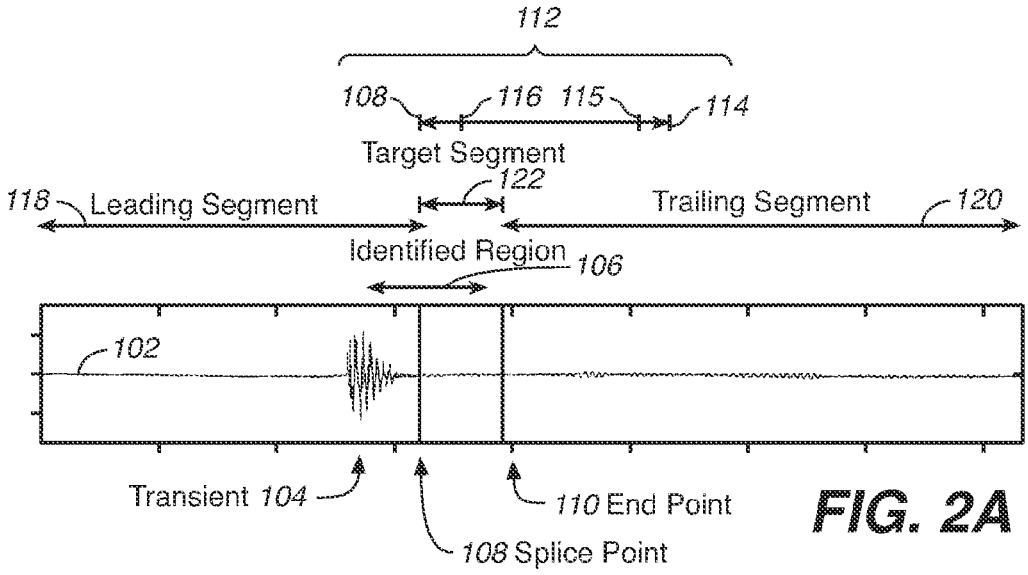
FIGS. 2A and 2B are schematic conceptual representations illustrating the concept of data compression by removing a target segment. The horizontal axis represents time.
Figure 2B:
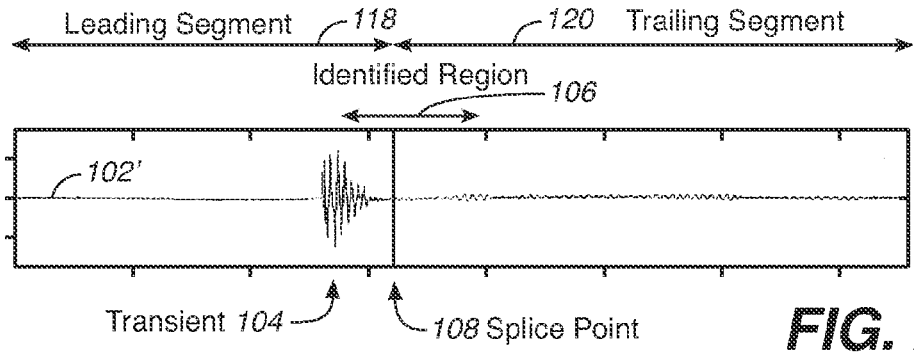
Figure 2C:
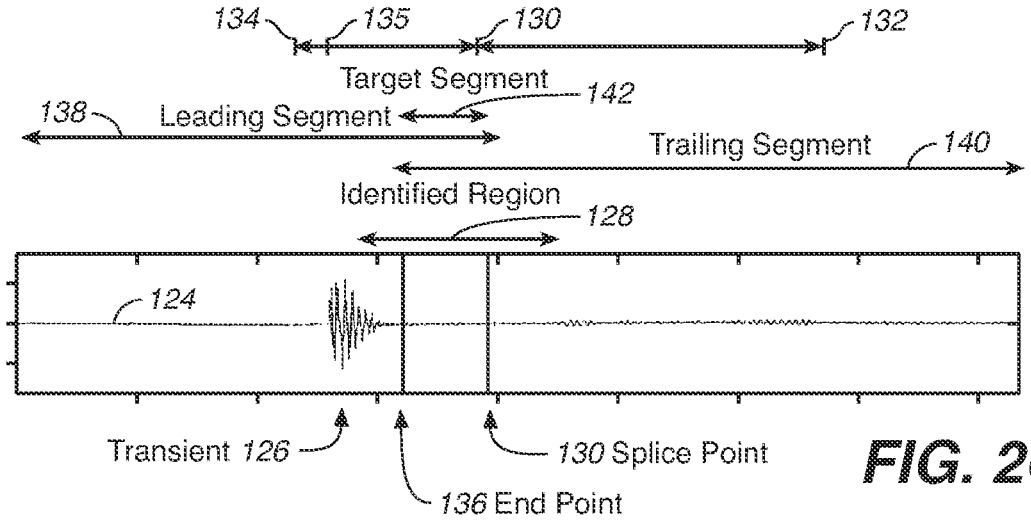
FIGS. 2C and 2D are schematic conceptual representations illustrating the concept of data expansion by repeating a target segment. The horizontal axis represents time.
Figure 2D:
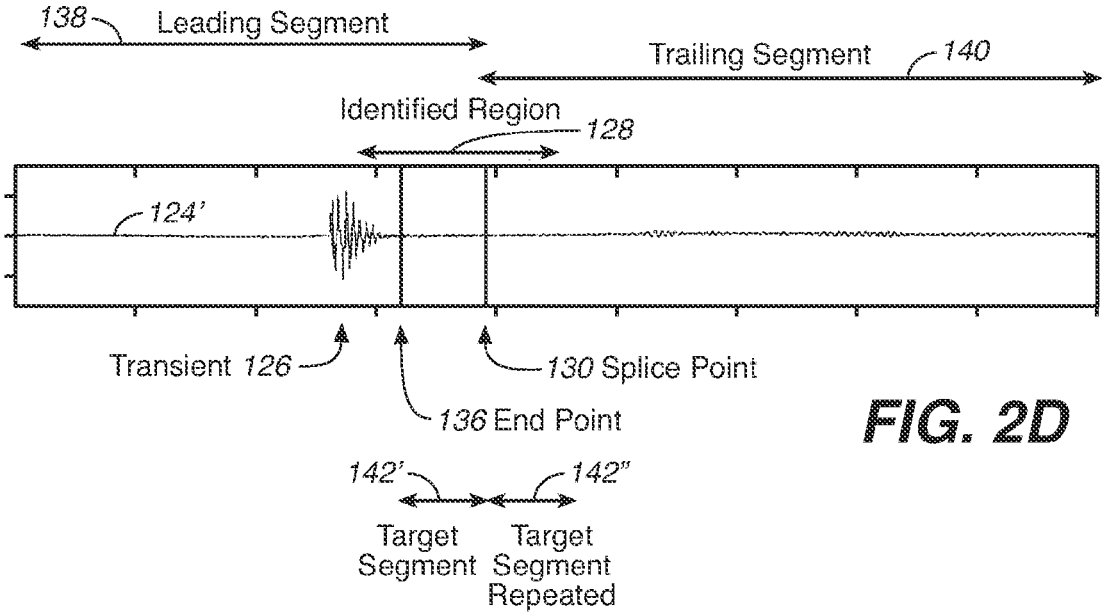

FIGS. 2A and 2B illustrate schematically the concept of data compression by removing a target segment, while FIGS. 2C and 2D illustrate schematically the concept of data expansion by repeating a target segment. In practice, the data compression and data expansion processes are applied to data in one or more buffer memories, the data being samples representing an audio signal.

Although the identified regions in FIGS. 2A through 2D satisfy the criterion that they are postmasked as the result of a signal transient, the principles underlying the examples of FIGS. 2A through 2D also apply to identified regions that satisfy other psychoacoustic criteria, including the other three mentioned above.

Referring to FIG. 2A, illustrating data compression, audio 102 has a transient 104 that results in a portion of the audio 102 being a psychoacoustically postmasked region 106 constituting the "identified region". The audio is analyzed and a splice point 108 is chosen to be within the identified region 106. As explained further below in connection with FIGS. 3A and 3B, if the audio is represented by a block of data in a buffer, there is a minimum or earliest splice point location (i.e., if the data is represented by samples, it has a low sample or index number) and a maximum or latest splice point location (i.e., if the data is represented by samples, it has a high sample or index number) within the block. The location of the splice point is selected within the range of possible splice point locations from the minimum splice point location to the maximum splice location and is not critical, although in most cases it is desirable to locate the splice point at or near the minimum or earliest splice point location in order to maximize the size of the target segment. A default splice point location, a short time after the beginning of the identified region (such as 5 ms, for example) may be employed. An alternative method that may provide a more optimized splice point location is described below.

Analysis continues on the audio and an end point 110 is chosen. In one alternative, the analysis includes an autocorrelation of the audio 102 in a region 112 from the splice point 108 forward (toward higher sample or index numbers) up to a maximum processing point location 115. In practice, the maximum end point location is earlier (has a lower sample or index number) than the maximum processing point by a time (or a time-equivalent number of samples) equal to half a crossfade time, as explained further below. In addition, as explained further below, the autocorrelation process seeks a correlation maximum between a minimum end point location 116 and the maximum end point location 114 and may employ time-domain correlation or both time-domain correlation and phase correlation. A way to determine the maximum and minimum end point locations is described below. For time compression, end point 110, determined by the autocorrelation, is at a time subsequent to the splice point 108 (i.e., if the audio is represented by samples, it has a higher sample or index number). The splice point 108 defines a leading segment 118 of the audio that leads the splice point (i.e., if the data is represented by samples, it has lower sample numbers or indices than the splice point). The end point 110 defines a trailing segment 120 that trails the end point (i.e., if the data is represented by samples, it has higher sample numbers or indices than the end point). The splice point 108 and the end point 110 define the ends of a segment of the audio, namely the target segment 122.

For data compression, the target segment is removed and in FIG. 2B the leading segment is joined, butted or spliced together with the trailing segment at the splice point preferably using crossfading (not shown in this figure), the splice point remaining within the identified region 106. Thus, the crossfaded splice "point" may be characterized as a splice "region". Components of the splicing artifacts remain principally within the crossfade, which is within the identified region 106, minimizing the audibility of the data compression. In FIG. 2B, the compressed data is identified by reference numeral 102'.

Throughout the various figures the same reference numeral will be applied to like elements, while reference numerals with prime marks will be used to designate related, but modified elements.

Referring to FIG. 2C, illustrating data expansion, audio 124 has a transient 126 that results in a portion of the audio 124 being a psychoacoustically postmasked region 128 constituting the "identified region". In the case of data expansion, the audio is analyzed and a splice point 130 is also chosen to be within the identified region 128. As explained further below, if the audio is represented by a block of data in a buffer, there is a minimum splice point location and a maximum splice point location within the block. The audio is analyzed both forwards (higher sample numbers or indices, if the data is represented by samples) and backwards (lower sample numbers or indices, if the data is represented by samples) from the splice point in order to locate an end point. This forward and backward searching is performed to find data before the splice point that is most like the data at and after the splice point that will be appropriate for copying and repetition. More specifically, the forward searching is from the splice point 130 up to a first maximum processing point location 132 and the backward searching is performed from the splice point 130 back to a second maximum processing point location 134. The two maximum processing locations may be, but need not be, spaced the same number of samples away from the splice point 130. As explained further below, the two signal segments from the splice point to the maximum search point location and maximum end point location, respectively, are cross-correlated in order to seek a correlation maximum. The cross correlation may employ time-domain correlation or both time-domain correlation and phase correlation. In practice, the maximum end point location 135 is later (has a higher sample or index number) than the second maximum processing point 134 by a time (or time equivalent number of samples) equal to half a crossfade time, as explained further below.

Contrary to the data compression case of FIGS. 2A and 2B, the end point 136, determined by the cross correlation, is at a time preceding the splice point 130 (i.e., if the audio is represented by samples, it has a lower sample or index number). The splice point 130 defines a leading segment 138 of the audio that leads the splice point (i.e., if the audio is represented by samples, it has lower sample numbers or indices than the splice point). The end point 136 defines a trailing segment 140 that trails the end point (i.e., if the audio is represented by samples, it has higher sample numbers or indices than the end point). The splice point 130 and the end point 136 define the ends of a segment of the audio, namely the target segment 142. Thus, the definitions of splice point, end point, leading segment, trailing segment, and target segment are the same for the case of data compression and the case of data expansion. However, in the data expansion case, the target segment is part of both the leading segment and the trailing segment (hence it is repeated), whereas in the data compression case, the target segment is part of neither (hence it is deleted).

In FIG. 2D, the leading segment is joined together with the target segment at the splice point, preferably using crossfading (not shown in this figure), causing the target segment to be repeated in the resulting audio 124'. In this case of data expansion, end point 136 should be within the identified region 128 of the original audio (thus placing all of the target segment in the original audio within the identified region). The first rendition 142' of the target segment (the part which is a portion of the leading segment) and the splice point 130 remain within the masked region 128. The second rendition 142" of the target segment (the part which is a portion of the trailing segment) is after the splice point 130 and may, but need not, extend outside the masked region 128. However, this extension outside the masked region has no audible effect because the target segment is continuous with the trailing segment in both the original audio and in the time-expanded version.

Preferably, a target segment should not include a transient in order to avoid omitting the transient, in the case of compression, or repeating the transient, in the case of expansion. Hence, the splice and end points should be on the same side of the transient such that both are earlier than (i.e., if the audio is represented by samples, they have lower sample or index numbers) or later than (i.e., if the audio is represented by samples, they have higher sample or index numbers) the transient.

Another aspect of the present invention is that the audibility of a splice may be further reduced by choice of crossfade shape and by varying the shape and duration of the crossfade in response to the audio signal. Further details of crossfading are set forth below in connection with FIG. 10 and its description. In practice, the crossfade time may slightly affect the placement of the extreme locations of the splice point and end point, as is explained further below.

Figure 3A:
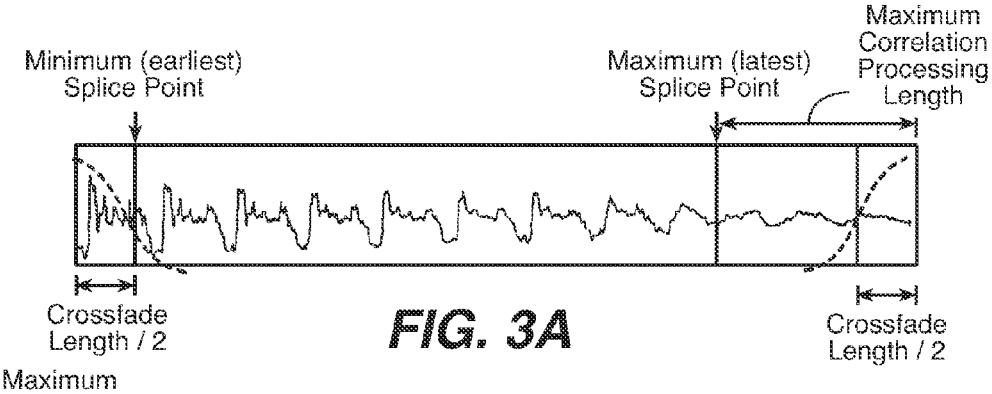
FIG. 3A is a schematic conceptual representation of a block of audio data represented by samples, showing the minimum splice point location and the maximum splice point location in the case of data compression. The horizontal axis is samples and represents time. The vertical axis is normalized amplitude.
Figure 3B:
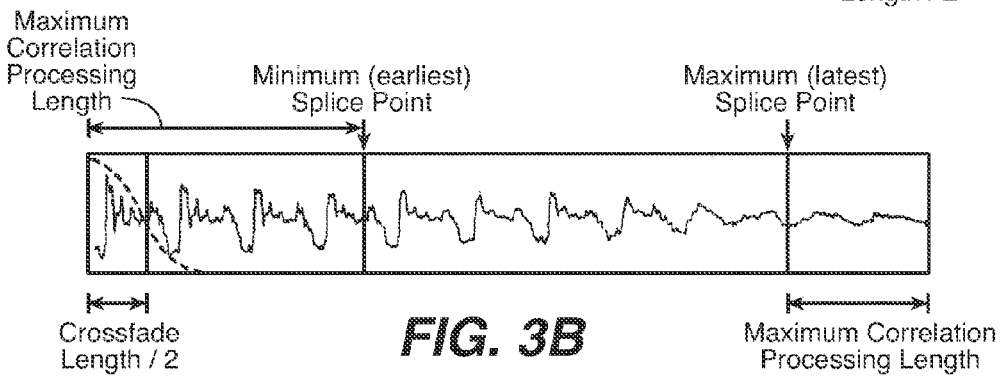
FIG. 3B is a schematic conceptual representation of a block of audio data represented by samples, showing the minimum splice point location and maximum splice point location in the case of data expansion. The horizontal axis is samples and represents time. The vertical axis is normalized amplitude.

FIGS. 3A and 3B set forth examples of determining the minimum and maximum splice point locations within a block of samples representing the input audio for compression (FIG. 3A) and for expansion (FIG. 3B). The minimum (earliest) splice point location has a lower sample or index number than the maximum (latest) splice point location. The minimum and maximum location of the splice points with respect to the ends of the block for data compression and data expansion are related variously to the length of the crossfade used in splicing and the maximum length of the correlation processing region. Determination of the maximum length of the correlation processing region is explained further in connection with FIG. 4. For time scale compression, the correlation processing region is the region of audio data after the splice point used in autocorrelation processing to identify an appropriate end point. For time scale expansion, there are two correlation processing regions, which may be, but need not be, of equal length, one before and one after the splice point. They define the two regions used in cross-correlation processing to determine an appropriate end point.

Every block of audio data has a minimum splice point location and a maximum splice point location. As show in FIG. 3A, the minimum splice point location with respect to the end of the block, representing the earliest time in the case of compression, is limited by half the length of the crossfade because the audio data around the splice point is crossfaded around the end point. Similarly, for time scale compression, the maximum splice point location with respect to the end of the block, representing the latest time in the case of compression, is limited by the maximum correlation processing length (the maximum end point location is "earlier" than the end of the maximum processing length by half the crossfade length).

FIG. 3B outlines the determination of the minimum and maximum splice point locations for time scale expansion. The minimum splice point location with respect to the end of the block, representing the earliest time for time scale expansion, is related to the maximum length of the correlation processing region in a manner similar to the determination of the maximum splice point for time scale compression (the minimum end point location is "later" than the end of the maximum correlation process length by half the crossfade length). The maximum splice point location with respect to the end of the block, representing the latest time for time scale expansion, is related only to the maximum correlation processing length. This is because the data following the splice point for time scale expansion is used only for correlation processing and an end point will not be located after the maximum splice point location.

Although FIGS. 3A and 3B are described with respect to a block of input data, the same principles apply to setting maximum and minimum end points with respect to any subset of the input data (i.e., a group of successive samples) that is treated separately, including an auditory event, as discussed further below.

Figure 4:
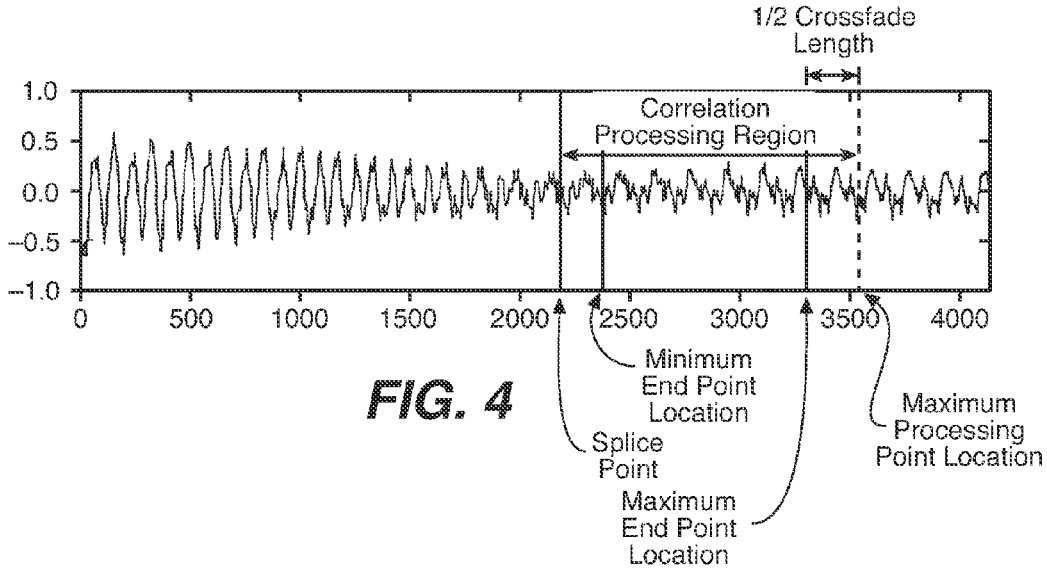
FIG. 4 is a schematic conceptual representation of a block of audio data represented by samples, showing the splice point, the minimum end point location, the maximum end point location, the correlation processing region, and the maximum processing point location. The horizontal axis is samples and represents time. The vertical axis is normalized amplitude.

As shown in FIG. 4, for the case of time scale compression, the region used for correlation processing is located after the splice point. The splice point and the maximum processing point location define the length of the correlation processing region. The locations of the splice point and maximum processing point shown in FIG. 4 are arbitrary examples. The minimum end point location indicates the minimum sample or index value after the splice point that the end point may be located. Similarly, the maximum end point location indicates the maximum sample or index value after the splice point that the end point may be located. The maximum end point location is "earlier" than the maximum processing point location by half the crossfade length. Once the splice point has been selected, the minimum and maximum end point locations control the amount of data that may be used for the target segment and may be assigned default values (usable values are 7.5 and 25 msec, respectively). Alternatively, the minimum and maximum end point locations may be variable so as to change dynamically depending on the audio content and/or the desired amount of time scaling (the minimum end point may vary based on the desired time scale rate). For example, for a signal whose predominant frequency component is 50 Hz and is sampled at 44.1 kHz, a single period of the audio waveform is approximately 882 samples in length (or 20 msec). This indicates that the maximum end point location should result in a target segment of sufficient length to contain at least one cycle of the audio data. In any case, the maximum processing point can be no later than the end of the processing block (4096 samples, in this example, or, as explained below, when auditory events are taken into consideration, no later than the end of an auditory event). Similarly, if the minimum end point location is chosen to be 7.5 msec after the splice point and the audio being processed contains a signal that generally selects an end point that is near the minimum end point location, then the maximum percentage of time scaling is dependent upon the length of each input data block. For example, if the input data block size is 4096 samples (or about 93 msec at a 44.1 kHz sample rate), then a minimum target segment length of 7.5 msec would result in a maximum time scale rate of 7.5/93=8% if the minimum end point location were selected. The minimum end point location for time scale compression may be set to 7.5 msec (331 samples for 44.1 kHz) for rates less than 7% change and set equal to:

```
Minimum end point location=((time_scale_rate-
    1.0)*block size);
```

where time_scale_rate is >1.0 for time scale compression (1.10=10% increase in rate of playback), and the block size is currently 4096 samples at 44.1 kHz. These examples show the benefit of allowing the minimum and maximum end point locations to vary depending upon the audio content and the desired time scale percentage. In any case, the minimum end point should not be so large or near the maximum end point as to unduly limit the search region.

A further aspect of the invention is that in order to further reduce the possibility of an audible splice, a comparison technique may be employed to match the signal waveforms at the splice point and the end point so as to lessen the need to rely on masking or inaudibility. A matching technique that constitutes a further aspect of the invention is seeking to match both the amplitude and phase of the waveforms that are joined at the splice. This in turn may involve correlation, as mentioned above, which also is an aspect of the invention. Correlation may include compensation for the variation of the ear's sensitivity with frequency.

As described in connection with FIGS. 2A-2D, the data compression or expansion technique employed in aspects of the present invention deletes or repeats sections of audio. In a first alternative mentioned above, the splice point location is selected using general, pre-defined system parameters based on the length of the crossfade or the desired distance of the splice point location from signal components such as transients and/or by taking into account certain other signal conditions. More detailed analysis of the audio (e.g., correlation) is performed around the somewhat arbitrary splice point to determine the end point.

In accordance with a second alternative, splice point and end point locations are selected in a more signal-dependent manner. Windowed data around a series of trial splice point locations are correlated against data in a correlation processing region to select a related trial end point location. The trial splice point location having the strongest correlation among all the trial splice point location is selected as the final splice point and a trial end point is located substantially at the location of strongest correlation. Although, in principle, the spacing between trial splice points may be only one sample, to reduce processing complexity the trial splice points may be more widely spaced. The width of the crossfade region is a suitable increment for trial splice points, as described below. This alternative method of choosing splice point and end point locations applies both to data compression and to data expansion processing. Although this alternative for selecting splice and end point locations is described in more detail below in connection with an aspect of the invention that employs auditory scene analysis, it may also be employed with a first described embodiment of the invention, which employs psychoacoustic analysis.

Psychoacoustic Analysis Embodiment

A flow chart setting forth a single channel or multichannel time-scaling and/or pitch-scaling process according to aspects of the present invention involving psychoacoustic analysis is shown in FIG. 5. A flow chart setting forth a single channel or multichannel time-scaling and/or pitch-scaling process according to aspects of the invention involving both psychoacoustic analysis and auditory event analysis is shown in FIG. 17, which is described below. Other aspects of the invention form portions or variations of the FIG. 5 and FIG. 17 processes. The processes may be used to perform real-time pitch scaling and non-real-time pitch and time scaling. A low-latency time-scaling process cannot operate effectively in real time since it would have to buffer the input audio signal to play it at a different rate thereby resulting in either buffer underflow or overflow—the buffer would empty at a different rate than input data is received.

Input Data 202 (FIG. 5)

Referring to FIG. 5, the first step, decision step 202 ("Input data?") determines whether digitized input audio data is available for data compression or data expansion processing. The source of the data may be a computer file or a block of input data, which may be stored in a real-time input buffer, for example. If data is available, data blocks of N time synchronous samples, representing time-concurrent segments, are accumulated by step 204 ("Get N samples for each channel") one block for each of the input channels to be data compression or data expansion processed (the number of channels being greater than or equal to 1). The number of input data samples, N, used by the process may be fixed at any reasonable number of samples, thereby dividing the input data into blocks. In principle, the processed audio may be digital or analog and need not be divided into blocks.

FIG. 5 will be discussed in connection with a practical embodiment of aspects of the invention in which the input data for each audio channel is data compression or data expansion processed in blocks of 4096 samples, which corresponds to about 93 msec of input audio at a sampling rate of 44.1 kHz. It will be understood that the aspects of the invention are not limited to such a practical embodiment. As noted above, the principles of the various aspects of the invention do not require arranging the audio into sample blocks, nor, if they are, of providing blocks of constant length. However, to minimize complexity, a fixed block length of 4096 samples (or some other power of two number of samples) is useful for three primary reasons. First, it provides low enough latency to be acceptable for real-time processing applications. Second, it is a power-of-two number of samples, which is useful for fast Fourier transform (FFT) analysis. Third, it provides a suitably large window size to perform a useful psychoacoustic analysis of the input signal.

In the following discussions, the input signal is assumed to be data with amplitude values in the range [−1,+1].

Psychoacoustic Analysis 206 (FIG. 5)

Following input data blocking, psychoacoustic analysis 206 ("Perform psychoacoustic analysis on each block of input data") is performed on the block of input data for each channel. In the case of multiple channels, the psychoacoustic analysis 206 and subsequent steps may be performed in parallel for all channels or seriatim, channel by channel (while providing appropriate storage of each channel's data and the analysis of each). Although parallel processing requires greater processing power, it may be preferred for real-time applications. The description of FIG. 5 assumes that the channels are processed in parallel.

Figure 6:
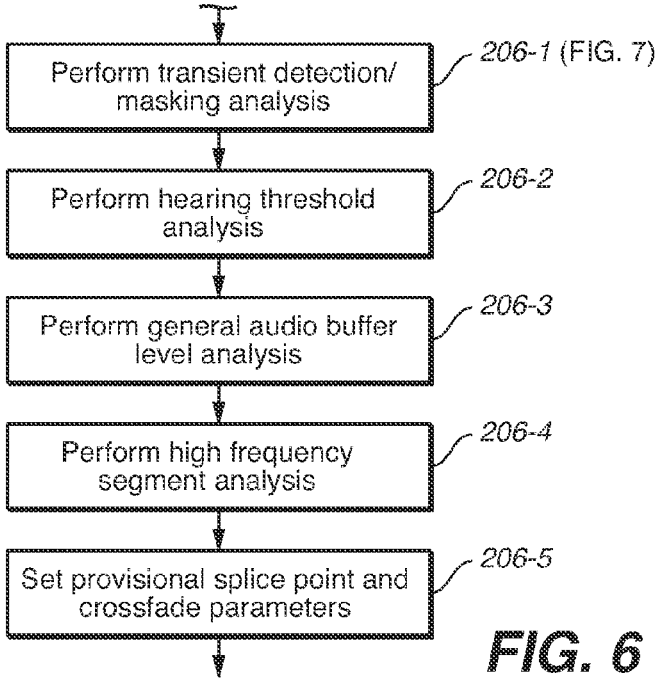
FIG. 6 is a flow chart showing details of the psychoacoustic analysis step 206 of FIG. 5.

Further details of step 206 are shown in FIG. 6. Analysis 206 may identify one or more regions in the block of data for each channel satisfying a psychoacoustic criterion (or, for some signal conditions, it may identify no such regions in a block), and also determines a potential or provisional splice point location within each of the identified regions. If there is only one channel, subsequent step 210 ("Select common splice point") is skipped and a provisional splice point location from one of the regions identified in step 206 may be used (preferably the "best" region in the block is chosen in accordance with a hierarchy of criteria). For the multichannel case, step 210 re-examines the identified regions, identifies common overlapped regions, and chooses a best common splice point location in such common overlapped regions, which splice point may be, but is not necessarily, a provisional splice point location identified in the psychoacoustic analysis step 206.

The employment of psychoacoustic analysis to minimize audible artifacts in the time and/or pitch scaling of audio is an aspect of the present invention. Psychoacoustic analysis may include applying one or more of the four criteria described above or other psychoacoustic criteria that identify segments of audio that would suppress or minimize artifacts arising from splicing waveforms therein or otherwise performing time and/or pitch scaling therein.

In the FIG. 5 process described herein, there may be multiple psychoacoustically identified regions in a block, each having a provisional splice point. Nevertheless, in one alternative embodiment it is preferred that a maximum of one psychoacoustically identified region in each block of input data, in the case of a single channel, is selected for data compression or expansion processing, and a maximum of one overlap of psychoacoustically identified regions, in the case of multiple channels, in each set of time-concurrent blocks of input data (one block for each channel) is selected for data compression or expansion processing. Preferably, the psychoacoustically "best" (for example, in accordance with a hierarchy such as the one described herein) identified region or overlap of identified regions is selected when there are multiple identified regions or multiple overlaps of identified regions in the block or blocks of input data, respectively.

Alternatively, more than one identified region or overlaps of identified regions in each block or set of blocks of time concurrent input data, respectively, may be selected for processing, in which case those selected are preferably the best ones psychoacoustically (for example, in accordance with a hierarchy such as the one described herein) or, alternatively, every identified event may be selected.

Instead of placing a provisional splice point in every identified region, in the case of a single channel, the splice point (in this case it would not be "provisional", it would be the actual splice point) may be placed in an identified region after the region is selected for processing. In the case of multiple channels, provisional splice points may be placed in identified regions only after they are determined to be overlapping.

In principle, the identification of provisional splice points is unnecessary when there are multiple channels inasmuch as it is preferred to select a common splice point in an overlapping region, which common splice point is typically different from each of the provisional splice points in the individual channels. However, as an implementation detail, the identification of provisional splice points is useful because it permits operation with either a single channel, which requires a provisional splice point (it becomes the actual splice point), or multiple channels, in which case the provisional splice points may be ignored.

FIG. 6 is a flow chart of the operation of the psychoacoustic analysis process 206 of FIG. 5. The psychoacoustic analysis process 206 is composed of five general processing substeps. The first four are psychoacoustic criteria analysis substeps arranged in a hierarchy such that an audio region satisfying the first substep or first criterion has the greatest likelihood of a splice (or other time shifting or pitch shifting processing) within the region being inaudible or minimally audible, with subsequent criteria having less and less likelihood of a splice within the region being inaudible or minimally audible.

Figure 8:
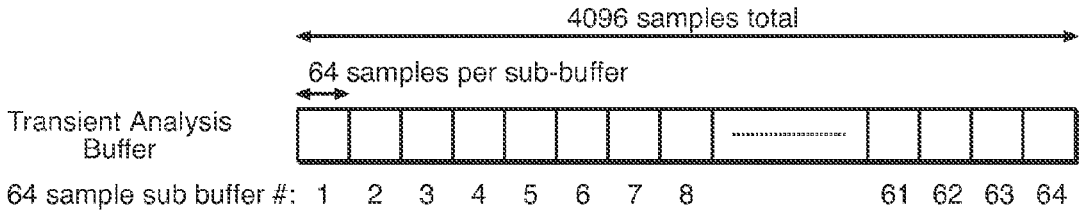
FIG. 8 is a schematic conceptual representation of a block of data samples in a transient analysis buffer. The horizontal axis is samples in the block.

The psychoacoustic criteria analysis of each of the substeps may employ a psychoacoustic subblock having a size that is one-sixty-fourth the size of the input data block. In this example, the psychoacoustic subblocks are approximately 1.5 msec (or 64 samples at 44.1 kHz) as shown in FIG. 8. While the size of the psychoacoustic subblocks need not be 1.5 msec, this size was chosen for a practical implementation because it provides a good trade off between real-time processing requirements (larger subblock sizes require less psychoacoustic processing overhead) and resolution of a segment satisfying a psychoacoustic criterion (smaller subblocks provide more detailed information on the location of such segments). In principle, the psychoacoustic subblock size need not be the same for each type of psychoacoustic criteria analysis, but in practical embodiments for, ease of implementation, this is preferred.

Transient Detection 206-1 (FIG. 6)

Process 206-1 analyzes the data block for each channel and determines the location of audio signal transients, if any. The temporal transient information is used in masking analysis and selecting the location of a provisional splice point (the last substep in the psychoacoustic analysis process of this example). As discussed above, it is well known that transients introduce temporal masking (hiding audio information both before and after the occurrence of transients).

Figure 7:
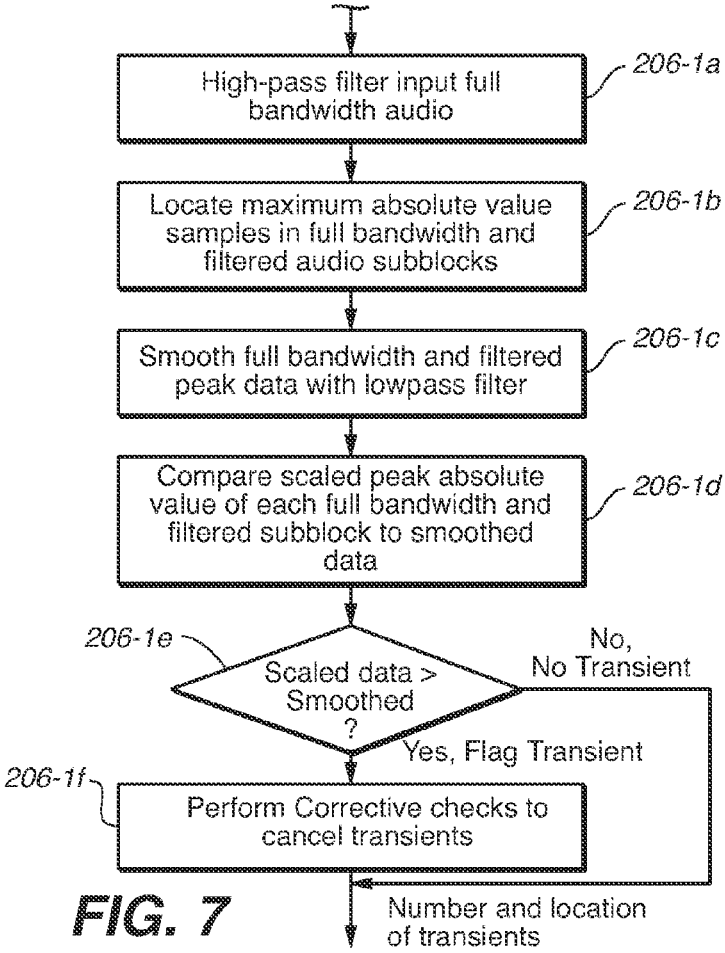
FIG. 7 is a flowchart showing details of the transient detection substep of the transient analysis step.

As shown in the flowchart of FIG. 7, the first sub-substep 206-1*a* ("High-pass filter input full bandwidth audio) in the transient detection substep 206-1 is to filter the input data block (treating the block contents as a time function). The input block data is high-pass filtered, for example with a second order IIR high-pass filter with a 3 dB cutoff frequency of approximately 8 kHz. The cutoff frequency and filter characteristics are not critical. Filtered data along with the original unfiltered data is then used in the transient analysis. The use of both full bandwidth and high-pass filtered data enhances the ability to identify transients even in complex material, such as music. The "full bandwidth" data may be band limited, for example, by filtering the extreme high and low frequencies. The data may also be high-pass filtered by one or more additional filters having other cutoff frequencies. High-frequency transient components of a signal may have amplitudes well below stronger lower frequency components but may still be highly audible to a listener. Filtering the input data isolates the high-frequency transients and makes them easier to identify.

In the next sub-substep 206-1*b* ("Locate maximum absolute value samples in full bandwidth and filtered audio subblocks"), both the full range and filtered input blocks may be processed in subblocks of approximately 1.5 msec (or 64 samples at 44.1 kHz) as shown in FIG. 8 in order to locate the maximum absolute value samples in the full bandwidth and filtered audio subblocks The third sub-substep 206-1*c* ("Smooth full bandwidth and filtered peak data with low pass filter") of transient detection substep 206-1 is to perform a low-pass filtering or leaky averaging of the maximum absolute data values contained in each 64-sample subblock (treating the data values as a time function). This processing is performed to smooth the maximum absolute data and provide a general indication of the average peak values in the input block to which the actual sub-block maximum absolute data value can be compared.

The fourth sub-substep 206-1*d* ("Compare scaled peak absolute value of each full bandwidth and filtered subblock to smoothed data") of transient detection processing 206-1 compares the peak in each subblock to the corresponding number in the array of smoothed, moving average peak values to determine whether a transient exists. While a number of methods exist to compare these two measures, the approach set forth below allows tuning of the comparison by use of a scaling factor that has been set to perform optimally as determined by analyzing a wide range of audio signals.

In decision sub-step 206-1*e* ("Scaled data>Smoothed?"), The peak value in the $k^{th}$ subblock is multiplied by a scaling value and compared to the $k^{th}$ value of the computed smoothed, moving average peak values. If a subblock's scaled peak value is greater than the moving average value, a transient is flagged as being present. The presence and location of the transient within the subblock is stored for follow-on processing. This operation is performed both to the unfiltered and filtered data. A subblock flagged as a transient or a string of contiguous subblocks flagged as a transient indicate the presence and location of a transient. This information is employed in other portions of the process to indicate, for example, where premasking and postmasking is provided by the transient and where data compression or expansion should be avoided in order to keep from disturbing the transient (see, for example, substep 310 of FIG. 6).

Following transient detection, several corrective checks are made in sub-substep 206-1*f* ("Perform corrective checks to cancel transients") to determine whether the transient flag for a 64-sample subblock should be cancelled (reset from TRUE to FALSE). These checks are performed to reduce false transient detections. First, if either the full range or high-frequency peak values fall below a minimum peak value then the transient is cancelled (to eliminate low level transients that would provide little or no temporal masking). Secondly, if the peak in a subblock triggers a transient but is not significantly larger than the previous subblock, which also would have triggered a transient flag, then the transient in the current subblock is cancelled. This reduces a smearing of the information on the location of a transient. For each audio channel, the number of transients and their locations are stored for later use in the psychoacoustic analysis step.

The invention is not limited to the particular transient detection just described. Other suitable transient detection schemes may be employed.

Hearing Threshold Analysis 206-2 (FIG. 6)

Referring again to FIG. 6, the second step 206-2 in the psychoacoustic analysis process, the hearing threshold analysis, determines the location and duration of audio segments that have low enough signal strength that they can be expected to be at or below the hearing threshold. As discussed above, these audio segments are of interest because the artifacts introduced by time scaling and pitch shifting are less likely to be audible in such regions.

As discussed above, the threshold of hearing is a function of frequency (with lower and higher frequencies being less audible than middle frequencies). In order to minimize processing for real-time processing applications, the hearing threshold model for analysis may assume a uniform threshold of hearing (where the threshold of hearing in the most sensitive range of frequency is applied to all frequencies). This conservative assumption makes allowance for a listener to turn up the playback volume louder than is assumed by the hearing sensitivity curve and reduces the requirement of performing frequency dependent processing on the input data prior to low energy processing.

The hearing threshold analysis step processes unfiltered audio and may also process the input in approximately 1.5 msec subblocks (64 samples for 44.1 kHz input data) and may use the same smoothed, moving average calculation described above. Following this calculation, the smoothed, moving average value for each subblock is compared to a threshold value to determine whether the subblock is flagged as being an inaudible subblock. The location and duration of each below-hearing-threshold segment in the input block is stored for later use in this analysis step. A string of contiguous flagged subblocks of sufficient length may constitute an identified region satisfying the below hearing threshold psychoacoustic criterion. A minimum length (time period) may be set so as to assure that the identified region is sufficiently long as to be a useful location for a splice point or both a splice point and an end point. If only one region is to be identified in the input block, it is useful to identify only the longest contiguous string of flagged subblocks.

High-Frequency Analysis 206-3 (FIG. 6)

The third substep 206-3, the high-frequency analysis step, determines the location and length of audio segments that contain predominantly high-frequency audio content. High-frequency segments, above approximately 10-12 kHz, are of interest in the psychoacoustic analysis because the hearing threshold in quiet increases rapidly above approximately 10-12 kHz and because the ear is less sensitive to discontinuities in a predominantly high-frequency waveform than to discontinuities in waveforms predominantly of lower frequencies. While there are many methods available to determine whether an audio signal consists mostly of high-frequency energy, the method described here provides good detection results and minimizes computational requirements. Nevertheless, other methods may be employed. The method described does not categorize a region as being high frequency if it contains both strong low frequency content and high-frequency content. This is because low frequency content is more likely to generate audible artifacts when data compression or data expansion processed.

The high-frequency analysis step may also process the input block in 64-sample subblocks and it may use the zero crossing information of each subblock to determine whether it contains predominantly high-frequency data. The zero-crossing threshold (i.e., how many zero crossings exist in a block before it is labeled a high-frequency audio block) may be set so that it corresponds to a frequency in the range of approximately 10 to 12 kHz. In other words, a subblock is flagged as containing high-frequency audio content if it contains at least the number of zero crossings corresponding to a signal in the range of about 10 to 12 kHz signal (a 10 kHz signal has 29 zero crossings in a 64-sample subblock with a 44.1 kHz sampling frequency). As in the case of the hearing threshold analysis, a string of contiguous flagged subblocks of sufficient length may constitute an identified region satisfying the high-frequency content psychoacoustic criterion. A minimum length (time period) may be set so as to assure that the identified region is sufficiently long as to be a useful location for a splice point or both a splice point and an end point. If only one region is to be identified in the input block, it is useful to identify only the longest contiguous string of flagged subblocks.

Audio Level Analysis 206-4 (FIG. 6)

Figure 9:
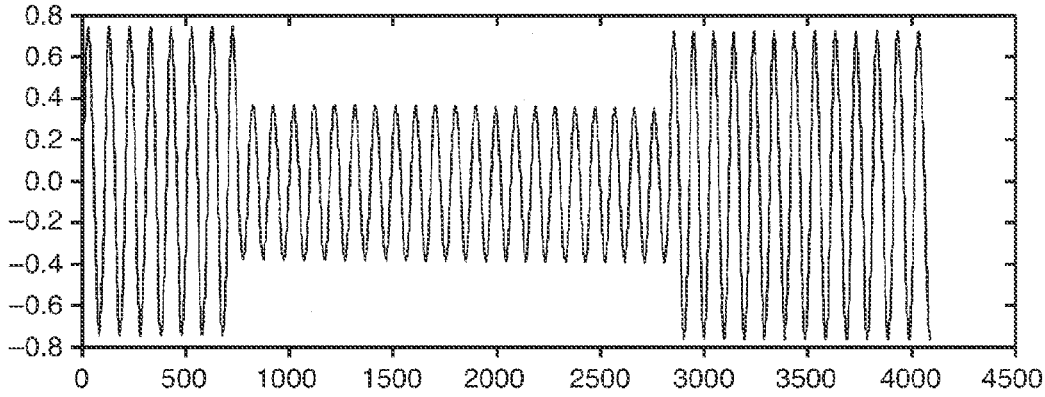
FIG. 9 is a schematic conceptual representation showing an audio block analysis example in which a 450 Hz sine wave has a middle portion 6 dB lower in level than its beginning and ending sections in the block. The horizontal axis is samples representing time and the vertical axis is normalized amplitude.

The fourth substep 206-4 in the psychoacoustic analysis process, the audio data block level analysis, analyzes the input data block and determines the location of the audio segments of lowest signal strength (amplitude) in the input data block. The audio level analysis information is used if the current input block contains no psychoacoustic masking events that can be exploited during processing (for example, if the input is a steady state signal that contains no transients or audio segments below the hearing threshold). In this case, the time-scaling processing preferably favors the lowest level or quietest segments of the input block's audio (if there are any such segments) based on the rationale that lower level segments of audio result in low level or inaudible splicing artifacts. A simple example using a 450 Hz tone (sine wave) is shown below in FIG. 9. The tonal signal shown in FIG. 9 contains no transients, below hearing threshold or high-frequency content. However, the middle portion of the signal is 6 dB lower in level than the beginning and ending sections of the signal in the block. It is believed that focusing attention of the quieter, middle section rather than the louder end sections minimizes the audible data compression or data expansion processing artifacts.

While the input audio block may be separated into any number of audio level segments of varying lengths, it has been found suitable to divide the block into three equal parts so that the audio data block level analysis is performed over the first, second and final third portions of the signal in each block to seek one portion or two contiguous portions that are quieter than the remaining portion(s). Alternatively, in a manner analogous to the subblock analysis of the blocks for the below hearing threshold and high-frequency criteria, the subblocks may be ranked according to their peak level with the longest contiguous string of the quietest of them constituting the quietest portion of the block. In either case, this substep provides as an output an identified region satisfying the quietest region psychoacoustic criterion. Except in an unusual signal condition, such as, for example, a constant amplitude signal throughout the block under analysis, this last psychoacoustic analysis, general audio level, will always provide a "last resort" identified region. As in the case of the substeps just described, a minimum length (time period) may be set so as to assure that the identified region is sufficiently long as to be a useful location for a splice point or both a splice point and an end point.

Setting Provisional Splice Point and Crossfade Parameters 206-5 (FIG. 6)

The final substep 206-5 ("Set Provisional Splice Point and Crossfade Parameters") in the psychoacoustic analysis process of FIG. 6 uses the information gathered from the previous steps to select the psychoacoustically-best identified region in the input block and to set the splice point and the crossfade length within that identified region.

Setting Crossfade Parameters

Figure 10:
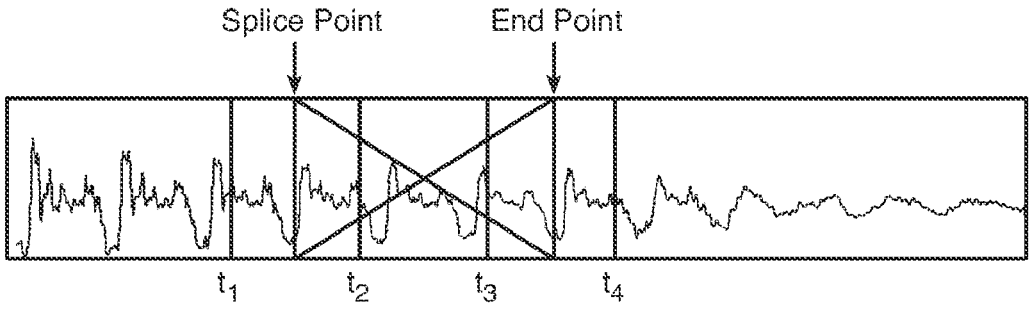
FIG. 10 is a schematic conceptual representation of how crossfading may be implemented, showing an example of data segment splicing using a nonlinear crossfading shaped in accordance with a Hanning window. The horizontal scale represents time and the vertical scale is amplitude.

As mentioned above, crossfading is used to minimize audible artifacts. FIG. 10 illustrates conceptually how to apply crossfading. The resulting crossfade straddles the splice point where the waveforms are joined together. In FIG. 10, the dashed line starting before the splice point shows a non-linear downward fade from a maximum to a minimum amplitude applied to the signal waveform, being half way down at the splice point. The fade across the splice point is from time $t_1$ to $t_2$. The dashed line starting before the end point shows a complementary non-linear upward fade from a minimum to a maximum amplitude applied to the signal waveform, being half way up at the end point. The fade across the end point is from time $t_3$ to $t_4$. The fade up and fade down are symmetrical and sum to unity (Hanning and Kaiser-Bessel windows have that property; thus, if the crossfades are shaped in the manner of such windows, this requirement will be satisfied). The time duration from $t_1$ to $t_2$ is the same as from $t_3$ to $t_4$. In this time compression example, it is desired to discard the data between the splice point and end point (shown crossed out). This is accomplished by discarding the data between the sample representing $t_2$ and the sample representing $t_3$. Then, the splice point and end point are (conceptually) placed on top of each other so that the data from $t_1$ to $t_2$ and $t_3$ to $t_4$ sum together, resulting in a crossfade consisting of the complementary up fade and down fade characteristics.

In general, longer crossfades mask the audible artifacts of splicing better than shorter crossfades. However, the length of a crossfade is limited by the fixed size of the input data block. Longer crossfades also reduce the amount of data that can be used for time scaling processing. This is because the crossfades are limited by the block boundaries (and/or by auditory event boundaries, when auditory events are taken into consideration) and data before and after the current data block (and/or the current auditory event, when auditory events are taken into consideration) may not be available for use in data compression or data expansion processing and crossfading. However, the masking properties of transients can be used to shorten the length of the crossfade because some or all of the audible artifacts resulting from a shorter crossfade are masked by the transient.

While the crossfade length may be varied in response to audio content, a suitable default crossfade length is 10 msec because it introduces minimal audible splicing artifacts for a wide range of material. Transient postmasking and premasking may allow the crossfade length to be set somewhat shorter, for example, 5 msec. However, when auditory events are taken into account, crossfades longer than 10 msec may be employed under certain conditions.

Setting Provisional Splice Point

If a transient signal is present as determined by substep 206-1 of FIG. 6, the provisional splice point preferably is located in the block within the temporal masking region before or after the transient, depending upon the transient location in the block and whether time expansion or compression processing is being performed, to avoid repeating or smearing the transient (i.e., preferably, no portion of the transient should be within the crossfade). The transient information is also used to determine the crossfade length. If more than one transient is present such that there are more than one usable temporal masking regions, the best masking region (taking into account, for example, its location in the block, its length and its strength) may be chosen as the identified region into which the provisional splice point is placed.

If no signal transients are present, the set provisional splice point and crossfade parameters substep 206-5 analyzes the hearing threshold segment, high frequency, and audio level analyses results of substeps 206-2, 206-3, and 206-4 in search of a psychoacoustically identified region in which to locate a provisional splice point. If one or more low level, at or below the hearing threshold segments exist, a provisional splice point is set within the one such segment or the best such segment, (taking into account, for example, its location within the block and its length). If no below hearing threshold segments are present, the step searches for high-frequency segments in the data block and sets a provisional splice point within the one such segment or the best such segment, taking into account, for example, its location within the block and its length. If no high-frequency segments are found, the step then searches for any low level audio segments and sets a provisional splice point within the one or the best (taking into account, for example, its location within the block and its length) such segment. Consequently, there will be only one identified region in which a provisional splice point is placed in each input block. As noted above, in rare cases, there may be no segments in a block that satisfy a psychoacoustic criterion, in which case, there will be no provisional splice points in the block.

Alternatively, as mentioned above prior to the discussion of the psychoacoustic analysis details, instead of selecting only one region in each input block that satisfies a psychoacoustic criterion and (optionally) placing a provisional splice point in that identified region, more than one region that satisfies a psychoacoustic criteria may be selected and a (optionally) provisional splice point placed in each of them. There are several ways this may be accomplished. For example, even if a region is identified that satisfies one of the higher ranking psychoacoustic criteria and a provisional splice point is (optionally) placed in it, one or more additional identified regions in the particular input block, having a lesser ranking in the psychoacoustic hierarchy, may be chosen and a provisional splice point placed in each of them. Another way is that if multiple regions satisfying the same psychoacoustic criterion are found in a particular block, more than one of those regions may be selected (and a provisional splice point placed in each) provided that each such additional identified regions is usable (taking into account, for example, its length and position in the block). Another way is to select every identified region whether or not there are other identified regions in that subblock and regardless of which psychoacoustic criterion is satisfied by the identified region and, optionally, to place a provisional splice point in each. Multiple identified regions in each block may be useful in finding a common splice point among multiple channels as described further below.

Thus, the psychoacoustic analysis process of FIG. 6 (step 206 of FIG. 5) identifies regions within input blocks according to the psychoacoustic criteria and, within each of those regions, it (optionally) locates a provisional splice point. It also provides an identification of the criterion used to identify the provisional splice point (whether, for example, masking as a result of a transient, hearing threshold, high frequency, lowest audio level) and the number and locations of transients in each input block, all of which are useful in determining a common splice point when there are multiple channels and for other purposes, as described further below.

Selecting a Common Multichannel Splice Point 210 (FIG. 5)

As stated above, the psychoacoustic analysis process of FIG. 6 is applied to every channel's input block. Referring again to FIG. 5, if more than one audio channel is being processed, as determined by decision step 208 ("No. chans>1?"), it is likely that the provisional splice points, if placed as an option in step 206, will not be coincident across the multiple channels (for example, some or all channels may contain audio content unrelated to other channels). The next step 210 ("Select common splice point") uses the information provided by the psychoacoustic analysis step 206 to identify overlapping identified regions in the multiple channels such that a common splice point may be selected in each of the time-concurrent blocks across the multiple channels.

Although, as an alternative, a common splice point, such as the best overall splice point, may be selected from among the one or more provisional splice points in each channel optionally determined by step 206 of FIG. 5, it is preferred to choose a potentially more optimized common splice point within identified regions that overlap across the channels, which splice point may be different from all of the provisional splice points determined by step 206 of FIG. 5.

Conceptually, the identified regions of each channel are ANDed together to yield a common overlapped segment. Note that in some cases, there may be no common overlapped segment and in others, when the alternative of identifying more than one psychoacoustic region in a block is employed, there may be more than one common overlapped segment. The identified regions of different channels may not precisely coincide, but it is sufficient that they overlap so that a common splice point location among channels may be chosen that is within an identified region in every channel. The multichannel splice processing selection step selects only a common splice point for each channel and does not modify or alter the position or content of the data itself.

A ranking of overlapped regions, in accordance, for example, with the hierarchy of psychoacoustic criteria, may be employed to choose one or more best overlapped regions for processing in the case of multiple overlapped regions. Although the identified regions of different channels need not result from the same psychoacoustic criterion, the distribution of criterion types among the channels affects the quality of the overlapped region (highest quality resulting in the least audibility when processing is performed in that overlapped region). The quality of an overlapped region may be ranked, taking into account the psychoacoustic criterion satisfied in the respective channels. For example, an overlapped region in which the identified region in every channel satisfies the "postmasking as a result of a transient" criterion, may be ranked highest. An overlapped region in which every channel but one satisfies the "postmasking as a result of a transient"

criterion and the other channel satisfies the "below hearing threshold" criterion may be ranked next, etc. The details of the ranking scheme are not critical.

Alternatively, a common region across multiple channels may be selected for processing even if there are overlapping psychoacoustically identified regions only with respect to some, but not all, of the channels. In that case, the failure to satisfy a psychoacoustic criterion in one or more channels preferably should be likely to cause the least objectionable audible artifacts. For example, cross-channel masking may mean that some channels need not have a common overlapping identified region; e.g., a masking signal from another channel may make it acceptable to perform a splice in a region in which a splice would not be acceptable if the channel were listened to in isolation.

A further variation on selecting a common splice point is to select the provisional splice point of one of the channels as the common splice point based on determining which one of the individual provisional splice points would cause the least objectionable artifacts if it were the common splice point.

Skipping

As a part of step 210 (FIG. 5), the ranking of an overlapped region may also be used to determine if processing within a particular overlapped region should be skipped. For example, an overlapped region in which all of the identified regions satisfy only the lowest ranking criterion, the "quietest portion" criterion, might be skipped. In certain cases, it may not be possible to identify a common overlap of identified regions among the channels for a particular set of time-concurrent input blocks, in which case a skip flag is set for that set of blocks as part of step 210. There may also be other factors for setting a skip flag. For example, if there are multiple transients in one or more channels so that there is insufficient space for data compression or data expansion processing without deleting or repeating a transient or if there otherwise is insufficient space for processing, a skip flag may be set.

It is preferred that a common splice point (and common end point) among the time-concurrent blocks is selected when deleting or repeating audio segments in order to maintain phase alignment among multiple channels. This is particularly important for two channel processing where psychoacoustic studies suggest that shifts in the stereo image can be perceived with as little as 10 μs (microseconds) difference between the two channels, which corresponds to less than 1 sample at a sampling rate of 44.1 kHz. Phase alignment is also important in the case of surround-encoded material. The phase relationship of surround-encoded stereo channels should be maintained or the decoded signal will be degraded.

Nevertheless, in some cases, it may be feasible to process multichannel data such that all channels are not perfectly sample aligned (i.e., to process channels with unaligned and independent splice point and end point locations for at least some of the channels). For example, it may be useful to align the splice points and end points of L, C, R (left, center and right) channels (for cinema or DVD signals) and process separately aligned LS and RS (left surround and right surround) channels. Information could be shared among the processing steps of the process of FIG. 5 such that the slight phase discrepancies in processing can be adjusted on a block-to-block basis to minimize the differences.

Examples of Multichannel Splice Point Selection

Figure 11:
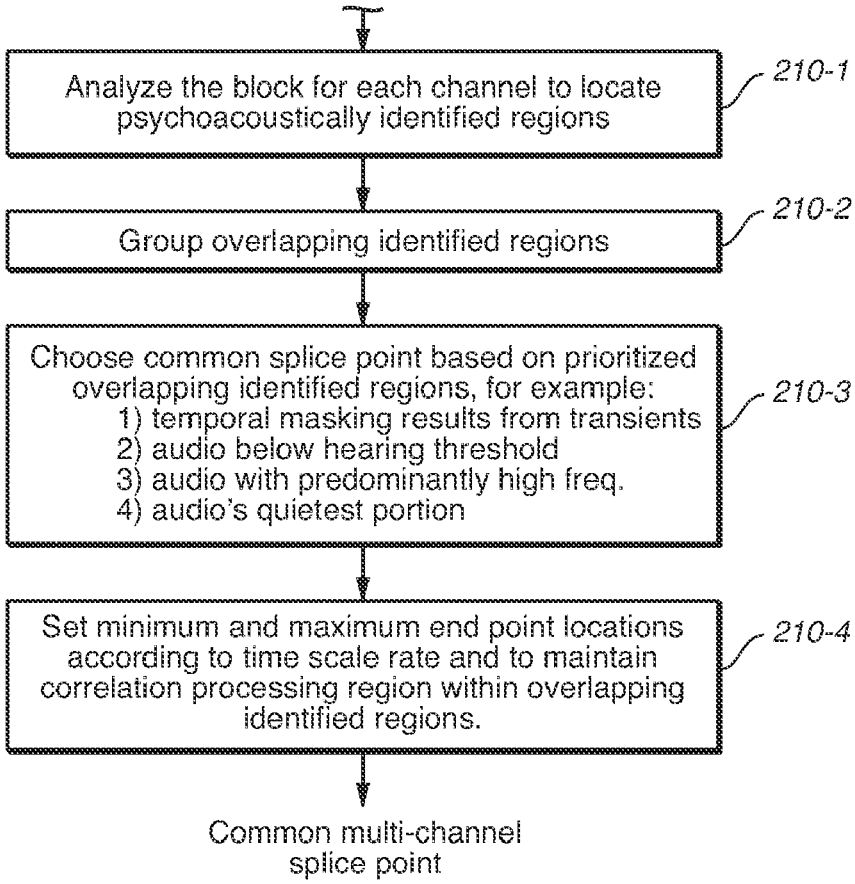
FIG. 11 is a flowchart showing details of the multichannel splice point selection step 210 of FIG. 5.

FIG. 11 shows details of the multichannel splice point selection analysis step 210 of FIG. 5. The first processing step 210-1 ("Analyze the block for each channel to locate psychoacoustically identified regions") analyzes the input block for each channel to locate the regions that were identified using psychoacoustic analysis, as described above. Processing step 210-2 ("Group overlapping identified regions") groups overlapping portions of identified regions (it ANDs together identified regions across the channels). Next, processing step 210-3 ("Choose common splice point based on prioritized overlapping identified regions . . . ") chooses a common splice point among the channels. In the case of multiple overlapping identified regions, the hierarchy of the criteria associated with each of the overlapping identified regions may be employed in ranking the overlaps of identified regions, preferably in accordance with the psychoacoustical hierarchy, as mentioned above. Cross-channel masking effects may also be taken into account ranking multiple overlaps of identified regions. Step 210-3 also takes into account whether there are multiple transients in each channel, the proximity of the transients to one another and whether time compression or expansion is being performed. The type of processing (compression or expansion) also is important in that it indicates whether the end point is located before or after the splice point (explained in connection with FIGS. 2A-D).

Figure 12:
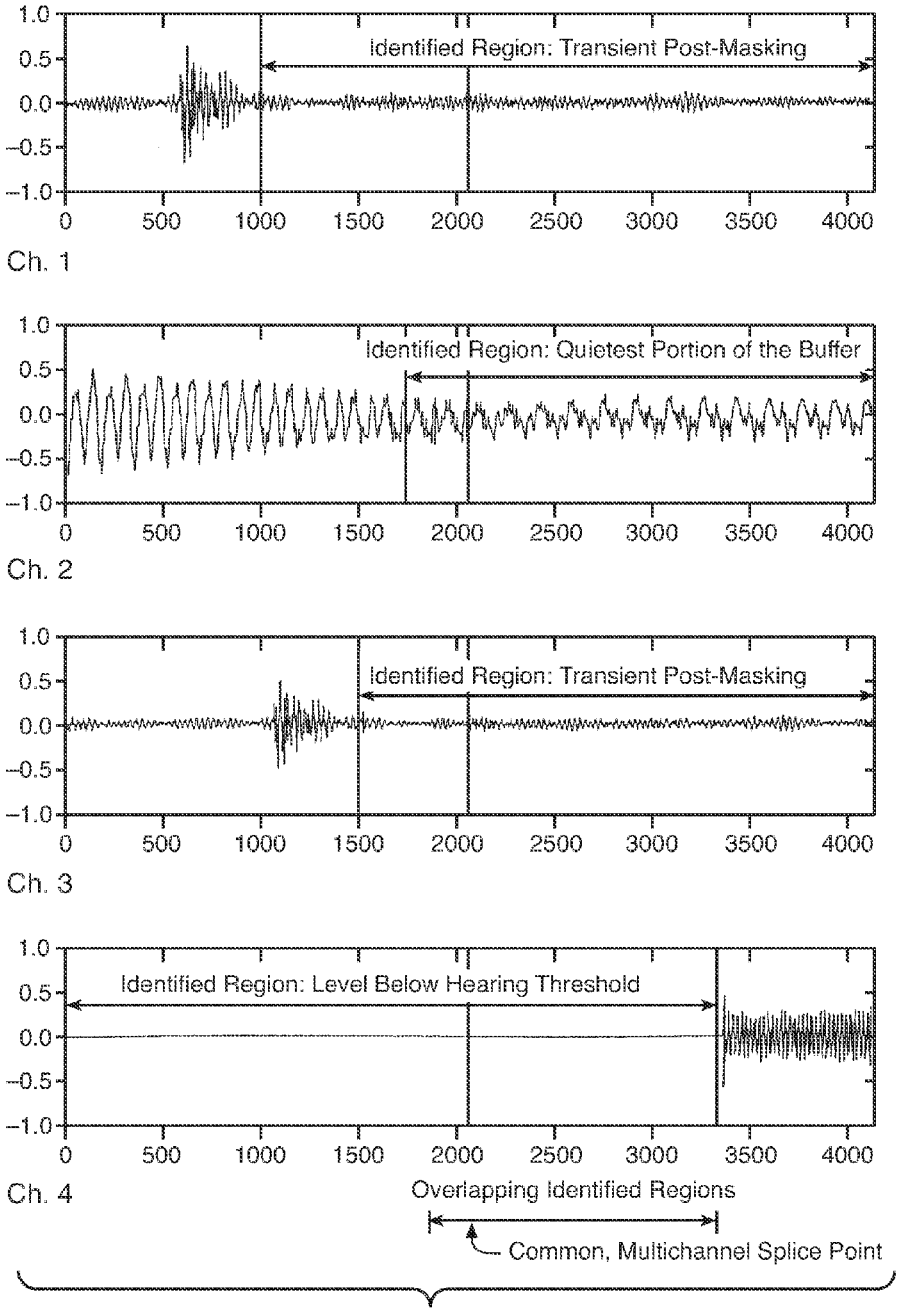
FIG. 12 is a series of idealized waveforms in four audio channels representing blocks of audio data samples, showing an identified region in each channel, each satisfying a different criterion, and showing an overlap of identified regions in which a common multichannel splice point may be located. The horizontal axis is samples and represents time. The vertical axis is normalized amplitude.

FIG. 12 shows an example of selecting a common multichannel splice point for the case of time scale compression using the regions identified in the individual channel's psychoacoustic processing as being appropriate for performing data compression or data expansion processing. Channels 1 and 3 in FIG. 12 both contain transients that provide a significant amount of temporal post masking as shown in the diagram. The audio in Channel 2 in FIG. 12 contains audio with a quieter portion that may be exploited for data compression or data expansion processing and is contained in roughly the second half of the audio block for Channel 2. The audio in Channel 4 contains a portion that is below the threshold of hearing and is located in roughly the first 3300 samples of the data block. The legend at the bottom of FIG. 12 shows the overlapping identified regions that provide a good overall region in which data compression or data expansion processing can be performed in each of the channels with minimal audibility. The provisional splice point in each of the identified regions may be ignored and a common splice point chosen in the common overlapping portion of the identified regions. Preferably, the common splice point is located slightly after the start of the common overlapping portion (there is only one common overlapping region in this example), as shown in FIG. 12, to prevent the crossfade from transitioning between identified regions and to maximize the size of the potential target segment.

Selecting the End Point Location

Referring again to FIG. 11, once a common splice point has been identified in step 210-3, processing step 210-4 ("Set minimum and maximum end point locations . . . ") sets minimum and maximum end point locations according to a time scaling rate (i.e., the desired ratio of data compression or expansion) and to maintain the correlation processing region within the overlapping portion of the identified regions. Alternatively, instead of taking the time scaling rate and identified region size into consideration prior to correlation, before the target segment length is known, the minimum and maximum end point locations may be determined by default values, such as the respective 7.5 and 25 msec values mentioned above. Step 210-4 outputs the common multichannel splice point for all channels (shown in FIG. 12) along with minimum and maximum end point locations. Step 210-4 may also output crossfade parameter information provided by substep 206-5 (FIG. 6) of step 206 (FIG. 5). The maximum end point location is important for the case where multiple inter-channel or cross-channel transients exist. The splice point preferably is set such that data compression or data expansion processing occurs between transients. In setting the end point location correctly (and thus, ultimately, the target segment length, which is determined by the splice point location, end point location, and crossfade length), it may be necessary to consider other transients in connection with the data compression or data expansion processing in the same or other channels.

Block Processing Decision 212 (FIG. 5)

Referring again to FIG. 5, the next step in processing, is the input block processing decision 212 ("Skip based on complexity?"). This step checks to determine whether the processing skip flag has been set by step 210. If so, the current block of data is not processed.

Correlation Processing 214 (FIG. 5)

If it is decided that the current input data block is to be processed, then, as shown in correlation step 214 of FIG. 5, two types of correlation processing may be provided with respect to each such data block. Correlation processing of the data block's time domain information is provided by substeps 214-1 ("Weighting") and 214-2 ("Correlation processing of each block's time-domain data"). Correlation processing of the input signals' phase information is provided by substeps 214-3 ("Compute phase of each block") and 214-4 ("Correlation processing of each block's phase data"). Using the combined phase and time-domain information of the input block data provides a higher quality time scaling result for signals ranging from speech to complex music than using time-domain information alone. Alternatively, only the time-domain information may be processed and used if diminished performance is deemed acceptable. Details of the correlation processing are set forth below, after the following explanation of some underlying principles.

Figure 13:
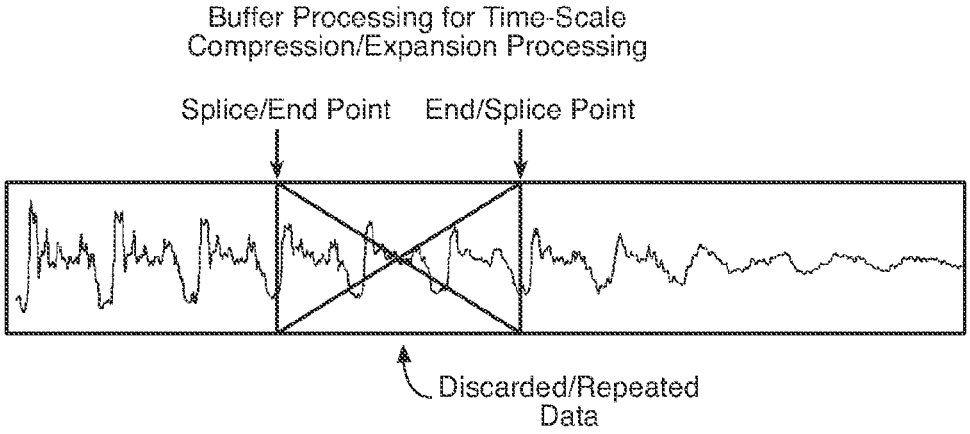
FIG. 13 shows the time-domain information of a highly periodic portion of an exemplary speech signal. An example of well-chosen splice and end points that maximize the similarity of the data on either side of the discarded data segment are shown. The horizontal scale is samples representing time and the vertical scale is amplitude.

As discussed above and shown in FIGS. 2A-D, the time scaling according to aspects of the present invention works by discarding or repeating segments of the input blocks. If, in accordance with a first alternative embodiment, the splice and end point locations are chosen such that, for a given splice point, the end point maximally maintains signal periodicity, audible artifacts will be reduced. An example of well-chosen splice and end processing point locations that maximize periodicity is presented in FIG. 13. The signal shown in FIG. 13 is the time-domain information of a highly periodic portion of a speech signal.

Once a splice point is determined, a method for determining an appropriate end point location is needed. In doing so, it is desirable to weight the audio in a manner that has some relationship to human hearing and then perform correlation. The correlation of a signal's time-domain amplitude data provides an easy-to-use estimate of the periodicity of a signal, which is useful in selecting an end point location. Although the weighting and correlation can be accomplished in the time domain, it is computationally efficient to do so in the frequency domain. A Fast Fourier Transform (FFT) can be used to compute efficiently an estimate of a signal's power spectrum that is related to the Fourier transform of a signal's correlation. See, for example, Section 12.5 "Correlation and Autocorrelation Using the FFT" in *Numerical Recipes in C, The Art of Scientific Computing* by William H. Press, et al, Cambridge University Press, New York, 1988, pp. 432-434.

An appropriate end point location is determined using the correlation data of the input data block's phase and time-domain information. For time compression, the autocorrelation of the audio between the splice point location and the maximum processing point is used (see FIGS. 2A, 3A, 4). The autocorrelation is used because it provides a measure of the periodicity of the data and helps determine how to remove an integral number of cycles of the predominant frequency component of the audio. For time expansion, the cross correlation of the data before and after the splice point location is computed to evaluate the periodicity of the data to be repeated to increase the duration of the audio (see FIGS. 2C, 3B, 4).

The correlation (autocorrelation for time compression or cross correlation for time expansion) is computed beginning at the splice point and terminating at either the maximum processing length as returned by previous processes (where the maximum processing length is the maximum end point location plus half the crossfade length if there is a crossfade after the end point) or a global maximum processing length (a default maximum processing length).

The frequency weighted correlation of the time-domain data may be computed in substep 214-1 for each input channel data block. The frequency weighting is done to focus the correlation processing on the most sensitive frequency ranges of human hearing and is in lieu of filtering the time-domain data prior to correlation processing. While a number of different weighted loudness curves are available, one suitable one is a modified B-weighted loudness curve. The modified curve is the standard B-weighted curve computed using the equation:

$$Rb(f) = \frac{12200^2 * f^3}{(f^2 + 20.6^2)(f^2 + 12200^2)((f^2 + 158.5^2)^{0.5})}$$

with the lower frequency components (approximately 97 Hz and below) set equal to 0.5.

Low-frequency signal components, even though inaudible, when spliced may generate high-frequency artifacts that are audible. Hence, it is desirable to give greater weight to low-frequency components than is given in the standard, unmodified B-weighting curve.

Following weighting, in the process 214-2, the time-domain correlation may be computed as follows:

1) form an L-point sequence (a power of 2) by augmenting x(n) with zeros,
2) compute the L point FFT of x(n),
3) multiply the complex FFT result by the conjugate of itself, and
4) compute the L-point inverse FFT.

where x(n) is the digitized time-domain data contained in the input data block representing the audio samples in the correlation processing region in which n denotes the sample or index number and the length L is a power of two greater than the number of samples in that processing.

As mentioned above, weighting and correlation may be efficiently accomplished by multiplying the signals to be correlated in the frequency domain by a weighted loudness curve. In that case, an FFT is applied before weighting and correlation, the weighting is applied during the correlation and then the inverse FFT is applied. Whether done in the time domain or frequency domain, the correlation is then stored for processing by the next step.

As shown in FIG. 5, the instantaneous phase of each input channel's data block is computed in substep 214-3, where the instantaneous phase is defined as $$\text{phase}(n)=\arctan(\text{imag}(\text{analytic}(x(n))/\text{real}(\text{analytic}(x(n))))$$

where x(n) is the digitized time-domain data contained in the input data block representing the audio samples in the correlation processing region in which n denotes the sample or index number.

The function analytic( ) represents the complex analytic version of x(n). The analytic signal can be created by taking the Hilbert transform of x(n) and creating a complex signal where the real part of the signal is x(n) and the imaginary part of the signal is the Hilbert transform of x(n). In this implementation, the analytic signal may be efficiently computed by taking the FFT of the input signal x(n), zeroing out the negative frequency components of the frequency domain signal and then performing the inverse FFT. The result is the complex analytic signal. The phase of x(n) is computed by taking the arctangent of the imaginary part of the analytic signal divided by the real part of the analytic signal. The instantaneous phase of the analytic signal of x(n) is used because it contains important information related to the local behavior of the signal, which helps in the analysis of the periodicity of x(n).

Figure 14:
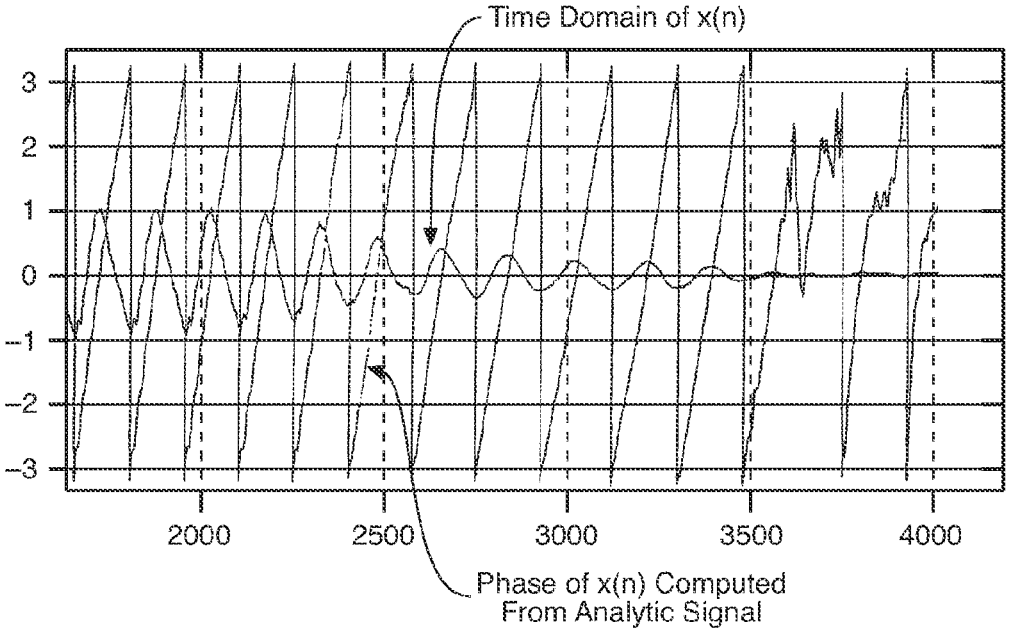
FIG. 14 is an idealized depiction of waveforms, showing the instantaneous phase of a speech signal, in radians, superimposed over a time-domain signal, x(n). The horizontal scale is samples and the vertical scale is both normalized amplitude and phase (in radians).

FIG. 14 shows the instantaneous phase of a speech signal, in radians, superimposed over the time-domain signal, x(n). An explanation of "instantaneous phase" is set forth in section 6.4.1 ("Angle Modulated Signals") in *Digital and Analog Communication Systems* by K. Sam Shanmugam, John Wiley & Sons, New York 1979, pp. 278-280. By taking into consideration both phase and time domain characteristics, additional information is obtained that enhances the ability to match waveforms at the splice point. Minimizing phase distortion at the splice point tends to reduce undesirable artifacts.

The time-domain signal x(n) is related to the instantaneous phase of the analytic signal of x(n) as follows:

negative going zero crossing of $x(n)=+\pi/2$ in phase positive going zero crossing of $x(n)=-\pi/2$ in phase local max of $x(n)=0$ in phase local min of $x(n)=\pm\pi$ in phase These mappings, as well as the intermediate points, provide information that is independent of the amplitude of x(n). Following the calculation of the phase for each channel's data, the correlation of the phase information for each channel is computed in step 214-4 and stored for later processing.

Figure 15:
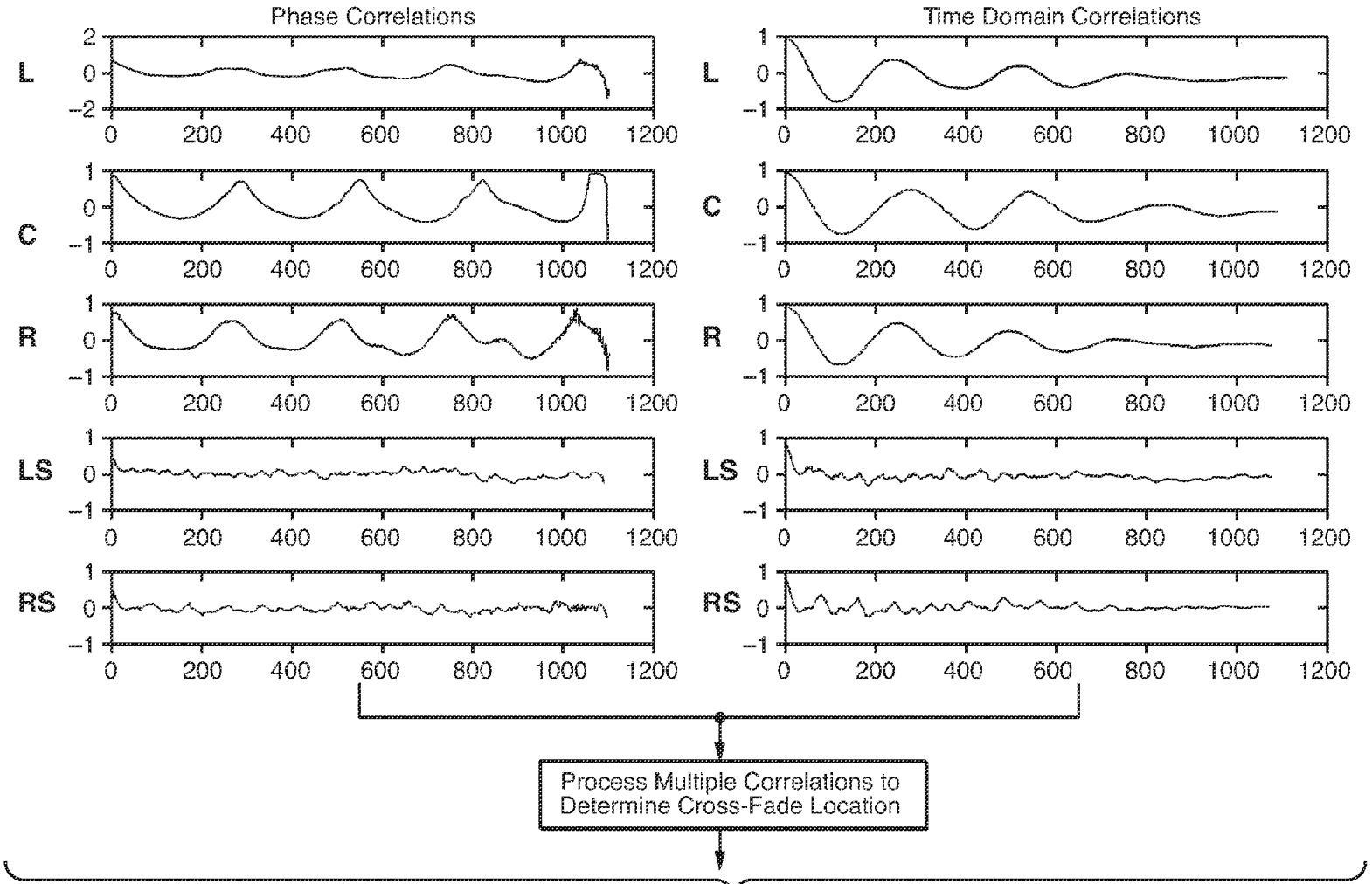
FIG. 15 is a flow chart showing details of the correlation steps 214 of FIG. 5.
Figure 16:
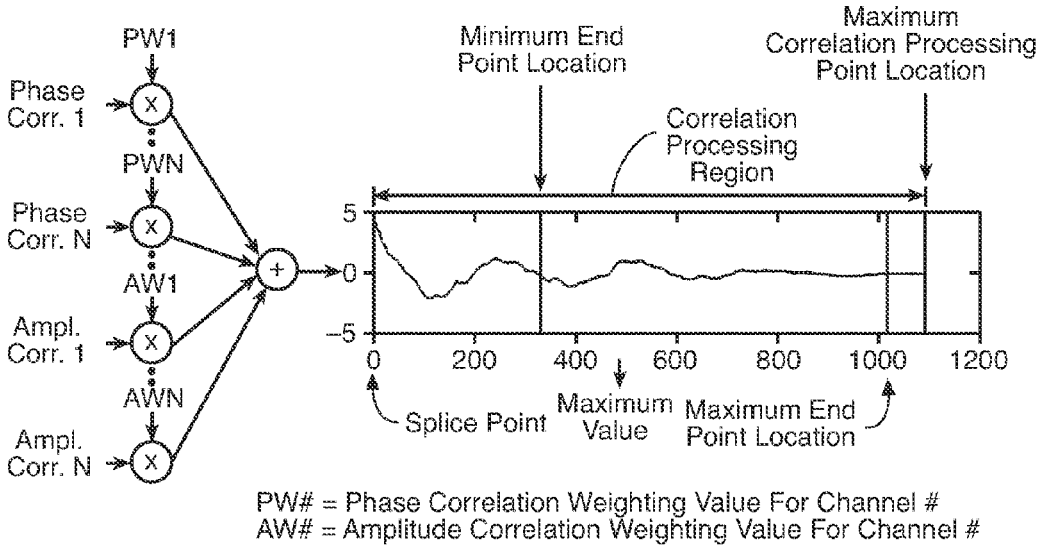
FIG. 16 is a schematic conceptual representation that has aspects of a block diagram and a flow chart and which also includes an idealized waveform showing an additive-weighted-correlations analysis-processing example. The horizontal axis of the waveform is samples representing time and the vertical axis is normalized amplitude.

Multiple Correlation Processing (216, FIG. 5, FIG. 15, FIG. 16)

Once the phase and time-domain correlations have been computed for each input channel's data block, the correlation-processing step 216 of FIG. 5 ("Process multiple correlations to determine crossfade location"), as shown in more detail in FIG. 15, processes them. FIG. 15 shows the phase and time-domain correlations for five (Left, Center, Right, Left Surround and Right Surround) input channels containing music. The correlation processing step, shown conceptually in FIG. 16, accepts the phase and time-domain correlation for each channel as inputs, multiplies each by a weighting value and then sums them to form a single correlation function that represents all inputs of all the input channels' time-domain and phase correlation information. In other words, the FIG. 16 arrangement might be considered a super-correlation function that sums together the ten different correlations to yield a single correlation. The waveform of FIG. 16 shows a maximum correlation value, constituting a desirable common end point, at about sample 500, which is between the minimum and maximum end point locations. The splice point is at sample 0 in this example. The weighting values may be chosen to allow specific channels or correlation type (time-domain versus phase, for example) to have a dominant role in the overall multichannel analysis. The weighting values may also be chosen to be functions of the correlation function sample points that would accentuate signals of certain periodicity over others. A very simple, but usable, weighting function is a measure of relative loudness among the channels. Such a weighting minimizes the contribution of signals that are so low in level that they may be ignored. Other weighting functions are possible. For example, greater weight may be given to transients. The purpose of the "super correlation" combined weighting of the individual correlations is to seek as good a common end point as possible. Because the multiple channels may be different waveforms, there is no one ideal solution nor is there one ideal technique for seeking a common end point. An alternative process for seeking an optimized pair of splice and end point locations is described below.

The weighted sum of each correlation provides useful insight into the overall periodic nature of the input blocks for all channels. The resulting overall correlation is searched in the correlation processing region between the splice point and the maximum correlation processing location to determine the maximum value of the correlation.

Process Blocks Decision Step 218 (FIG. 5)

Returning to the description of FIG. 5, the block processing decision step 218 ("Process Blocks?") compares how much the data has been time scaled compared with the requested amount of time scaling. For example, in the case of compression, the decision step keeps a cumulative tracking of how much compression has been performed compared to the desired compression ratio. The output time scaling factor varies from block to block, varying a slight amount around the requested time scaling factor (it may be more or less than the desired amount at any given time). If only one common overlapping region is allowed in each time-coincident ("current") block (a set of input data blocks representing time-coincident audio segments, a block for each channel), the block processing decision step compares the requested time scaling factor to the output time scaling factor, and makes a decision as to whether to process the current input data block. The decision is based on the length of the target segment in the common overlapping region, if any, in the current block. For example, if a time scaling factor of 110% is requested and the output scaling factor is below the requested scaling factor, the current input blocks are processed. Otherwise the current blocks are skipped. If more than one common overlapping region is allowed in a time-concurrent set of input data blocks, the block processing decision step may decide to process one overlapping region, more than one overlapping region or to skip the current blocks. Alternatively, other criteria for processing or skipping may be employed. For example, instead of basing the decision of whether to skip the current block on whether the current accumulated expansion or compression is more than a desired degree, the decision may be based on whether processing the current block would change the accumulated expansion or compression toward the desired degree even if the result after processing the current block is still in error in the opposite direction.

Crossfade Processing 220 (FIG. 5)

Following the determination of the splice and end point locations and the decision as to whether to process the block, each channel's data block is processed by the Crossfade block step 220 of FIG. 5 ("Crossfade the block for each channel"). This step accepts each channel's data block, the common splice point, the end common point and the crossfade information.

Referring again to FIG. 10, a crossfade of suitable shape is applied to the input data and the two segments are spliced together, omitting (as in FIG. 10) or repeating the target segment. The length of the crossfade preferably is a maximum of 10 msec, but it may be shorter depending on the crossfade parameters determined in previous analysis steps. However, when auditory events are taken into account, longer crossfades may be employed under certain conditions, as discussed below. Non-linear crossfades, for instance in accordance with the shape of half a Hanning window, may result in less audible artifacts than linear (straight-line) crossfades, particularly for simple single-frequency signals such as tones and tone sweeps because a Hanning window does not have the discontinuities of slope of a straight-line crossfade. Other shapes, such as that of a Kaiser-Bessel window, may also provide satisfactory results, provided the rising and falling crossfades cross at 50% and sum to unity over the whole of the crossfade duration.

Pitch Scaling Processing 222 (FIG. 5)

Following the crossfade processing, a decision step 222 of FIG. 5 ("Pitch scale") is checked to determine whether pitch shifting (scaling) is to be performed. As discussed above, time scaling cannot be done in real-time due to buffer underflow or overflow. However, pitch scaling can be performed in real-time because of the operation of the "resampling" step 224 ("Resample all data blocks"). The resampling step reads out the samples at a different rate. In a digital implementation with a fixed output clock, this is accomplished by resampling. Thus, the resampling step 224 resamples the time scaled input signal resulting in a pitch-scaled signal that has the same time evolution or duration as the input signal but with altered spectral information. For real-time implementations, the resampling may be performed with dedicated hardware sample-rate converters to reduce the computation in a DSP implementation. It should be noted that resampling is required only if it is desired to maintain a constant output sampling rate or to maintain the input sampling rate and the output sampling rate the same. In a digital system, a constant output sampling rate or equal input/output sampling rates are normally required. However, if the output of interest were converted to the analog domain, a varying output sampling rate would be of no concern. Thus, resampling is not a necessary part of any of the aspects of the present invention.

Following the pitch scale determination and possible resampling, all processed input data blocks are output in step 226 ("Output processed data blocks") either to a file, for non-real time operation, or to an output data block for real-time operation. The process then checks for additional input data and continues processing.

Psychoacoustic Analysis and Auditory Scene Analysis Embodiment

An embodiment of a multichannel time and/or pitch scaling process employing both psychoacoustic analysis and auditory scene analysis in accordance with aspects of the present invention is shown in FIG. 17. Although the process is described in an environment in which the input signals are one or more channels of digital audio represented by samples and in which consecutive samples in each channel are divided into blocks of 4096 samples, these implementation details are not critical. In principle, the processed audio may be digital or analog and need not be divided into blocks.

Referring to FIG. 17, the first step, decision step 702 ("Input data?") determines whether digitized input audio data is available for data compression or data expansion processing. The source of the data may be a computer file or a block of input data, which may be stored in a real-time input buffer, for example. If data is available, data blocks of N time synchronous samples, representing time-concurrent segments, are accumulated by step 704 ("Get N samples for each channel") one block for each of the input channels to be data compression or data expansion processed (the number of channels being greater than or equal to 1). The number of input data samples, N, used by the process may be fixed at any reasonable number of samples, thereby dividing the input data into blocks. In principle, the processed audio may be digital or analog and need not be divided into blocks.

FIG. 17 will be discussed in connection with a practical embodiment of aspects of the invention in which the input data for each audio channel is data compression or data expansion processed in blocks of 4096 samples, which corresponds to about 93 msec of input audio at a sampling rate of 44.1 kHz. It will be understood that the aspects of the invention are not limited to such a practical embodiment. As noted above, the principles of the various aspects of the invention do not require arranging the audio into sample blocks, nor, if they are, of providing blocks of constant length. However, to minimize complexity, a fixed block length of 4096 samples (or some other power of two number of samples) is useful for three primary reasons. First, it provides low enough latency to be acceptable for real-time processing applications. Second, it is a power-of-two number of samples, which is useful for fast Fourier transform (FFT) analysis. Third, it provides a suitably large window size to perform useful auditory scene and psychoacoustic analyses of the input signal.

In the following discussions, the input signals are assumed to be data with amplitude values in the range [−1,+1].

Auditory Scene Analysis 706 (FIG. 17)

Following audio input data blocking, the contents of each channel's data block are divided into auditory events, each of which tends to be perceived as separate ("Perform auditory scene analysis on the block for each channel") (step 706). In the case of multiple channels, the auditory scene analysis 706 and subsequent steps may be performed in parallel for all channels or seriatim, channel by channel (while providing appropriate storage of each channel's data and the analysis of each). Although parallel processing requires greater processing power, it may be preferred for real-time applications. The description of FIG. 17 assumes that the channels are processed in parallel.

Auditory scene analysis may be accomplished by the auditory scene analysis (ASA) process discussed above. Although one suitable process for performing auditory scene analysis is described herein, the invention contemplates that other useful techniques for performing ASA may be employed. Because an auditory event tends to be perceived as reasonably constant, the auditory scene analysis results provide important information useful in performing high quality time and pitch scaling and in reducing the introduction of audible processing artifacts. By identifying and, subsequently, processing auditory events individually, audible artifacts that may be introduced by the time and pitch scaling processing may be greatly reduced.

Figure 18:
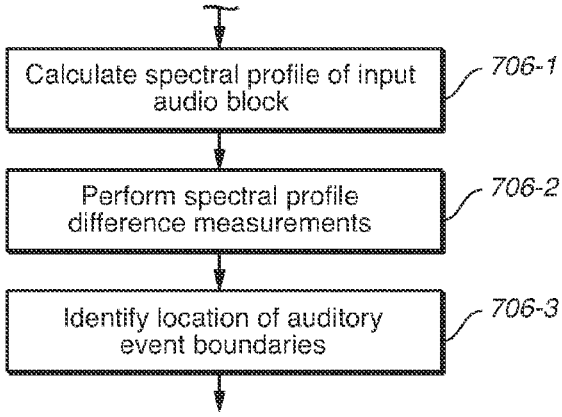
FIG. 18 is a flow chart showing details of the auditory scene analysis step 706 of the process of FIG. 17.

FIG. 18 outlines a process in accordance with techniques of the present invention that may be used in the auditory scene analysis step of FIG. 17. The ASA step is composed of three general processing substeps. The first substep 706-1 ("Calculate spectral profile of input audio block") takes the N sample input block, divides it into subblocks and calculates a spectral profile or spectral content for each of the subblocks. Thus, the first substep calculates the spectral content of successive time segments of the audio signal. In a practical embodiment, described below, the ASA subblock size is one-eighth the size (e.g., 512 samples) of the input data block size (e.g., 4096 samples). In the second substep 706-2, the differences in spectral content from subblock to subblock are determined ("Perform spectral profile difference measurements"). Thus, the second substep calculates the difference in spectral content between successive time segments of the audio signal. In the third substep 706-3 ("Identify location of auditory event boundaries"), when the spectral difference between one spectral-profile subblock and the next is greater than a threshold, the subblock boundary is taken to be an auditory event boundary. Thus, the third substep sets an auditory event boundary between successive time segments when the difference in the spectral profile content between such successive time segments exceeds a threshold. As discussed above, a powerful indicator of the beginning or end of a perceived auditory event is believed to be a change in spectral content.

In this embodiment, auditory event boundaries define auditory events having a length that is an integral multiple of spectral profile subblocks with a minimum length of one spectral profile subblock (512 samples in this example). In principle, event boundaries need not be so limited. Note also that the input block size limits the maximum length of an auditory event unless the input block size is variable (as an alternative to the practical embodiments discussed herein, the input block size may vary, for example, so as to be essentially the size of an auditory event).

Figure 19:
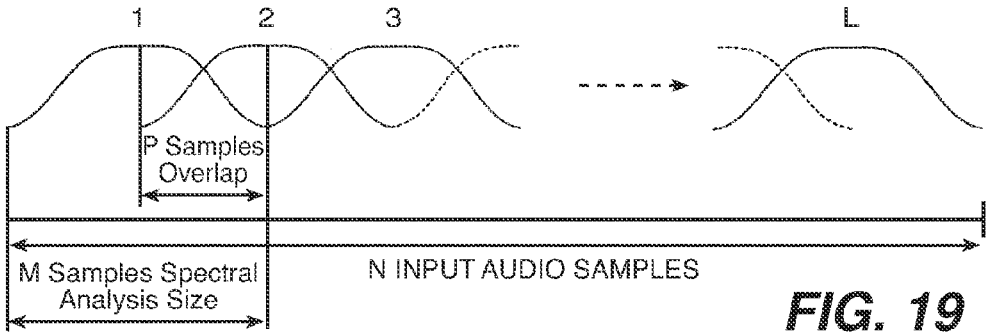
FIG. 19 is a schematic conceptual representation of a general method of calculating spectral profiles.

FIG. 19 outlines a general method of calculating the time varying spectral profiles. In FIG. 19, overlapping segments of the audio are windowed and used to compute spectral profiles of the input audio. Overlap results in finer resolution as to the location of auditory events and, also, makes it less likely to miss an event, such as a transient. However, as time resolution increases, frequency resolution decreases. Overlap also increases computational complexity. Thus, in a practical example set forth below, overlap is omitted.

The following variables may be used to compute the spectral profile of the input block:

N=number of samples in the input audio block

M=number of windowed samples used to compute spectral profile

P=number of samples of spectral computation overlap

Q=number of spectral windows/regions computed

In general, any integer numbers may be used for the variables above. However, the implementation will be more efficient if M is set equal to a power of 2 so that standard FFTs may be used for the spectral profile calculations. In addition, if N, M, and P are chosen such that Q is an integer number, this will avoid under-running or over-running audio at the end of the N sample block. In a practical embodiment of the auditory scene analysis process, the parameters listed may be set to:

N=4096 samples (or 93 msec at 44.1 kHz)

M=512 samples (or 12 msec at 44.1 kHz)

P=0 samples (no overlap)

Q=8 blocks

The above-listed values were determined experimentally and were found generally to identify with sufficient accuracy the location and duration of auditory events for the purposes of time scaling and pitch shifting. However, setting the value of P to 256 samples (50% overlap) has been found to be useful in identifying some hard-to-find events. While many different types of windows may be used to minimize spectral artifacts due to windowing, the window used in the spectral profile calculations is an M-point Hanning, Kaiser-Bessel or other suitable, preferably non-rectangular, window. The above-indicated values and Hanning window type were selected after extensive experimental analysis as they have shown to provide excellent results across a wide range of audio material. Non-rectangular windowing is preferred for the processing of audio signals with predominantly low frequency content. Rectangular windowing produces spectral artifacts that may cause incorrect detection of events.

In substep 706-1, the spectrum of each M-sample subblock may be computed by windowing the data by an M-point Hanning, Kaiser-Bessel or other suitable window, converting to the frequency domain using an M-point Fast Fourier Transform, and calculating the magnitude of the FFT coefficients. The resultant data is normalized so that the largest magnitude is set to unity, and the normalized array of M numbers is converted to the log domain. The array need not be converted to the log domain, but the conversion simplifies the calculation of the difference measure in substep 706-2. Furthermore, the log domain more closely matches the log domain amplitude nature of the human auditory system. The resulting log domain values have a range of minus infinity to zero. In a practical embodiment, a lower limit can be imposed on the range of values; the limit may be fixed, for example −60 dB, or be frequency-dependent to reflect the lower audibility of quiet sounds at low and very high frequencies. (Note that it would be possible to reduce the size of the array to M/2 in that the FFT represents negative as well as positive frequencies).

Substep 706-2 calculates a measure of the difference between the spectra of adjacent subblocks. For each subblock, each of the M (log) spectral coefficients from substep 706-1 is subtracted from the corresponding coefficient for the preceding subblock, and the magnitude of the difference calculated. These M differences are then summed to one number. Hence, for the whole audio signal, the result is an array of Q positive numbers; the greater the number the more a subblock differs in spectrum from the preceding subblock. This difference measure could also be expressed as an average difference per spectral coefficient by dividing the difference measure by the number of spectral coefficients used in the sum (in this case M coefficients).

Substep 706-3 identifies the locations of auditory event boundaries by applying a threshold to the array of difference measures from substep 706-2 with a threshold value. When a difference measure exceeds a threshold, the change in spectrum is deemed sufficient to signal a new event and the subblock number of the change is recorded as an event boundary. For the values of M, N, P and Q given above and for log domain values (in substep 706-2) expressed in units of dB, the threshold may be set equal to 2500 if the whole magnitude FFT (including the mirrored part) is compared or 1250 if half the FFT is compared (as noted above, the FFT represents negative as well as positive frequencies—for the magnitude of the FFT, one is the mirror image of the other). This value was chosen experimentally and it provides good auditory event boundary detection. This parameter value may be changed to reduce (increase the threshold) or increase (decrease the threshold) the detection of events.

The details of this practical embodiment are not critical. Other ways to calculate the spectral content of successive time segments of the audio signal, calculate the differences between successive time segments, and set auditory event boundaries at the respective boundaries between successive time segments when the difference in the spectral profile content between such successive time segments exceeds a threshold may be employed.

Figure 20A:
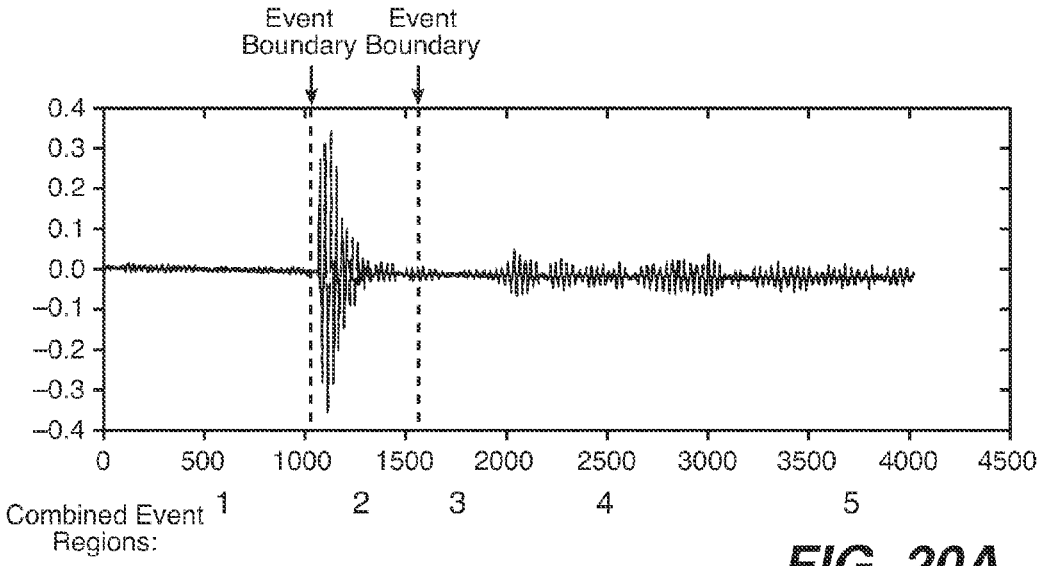
FIG. 20 is a series of idealized waveforms in two audio channels, showing auditory events in each channel and combined auditory events across the two channels.
Figure 20B:
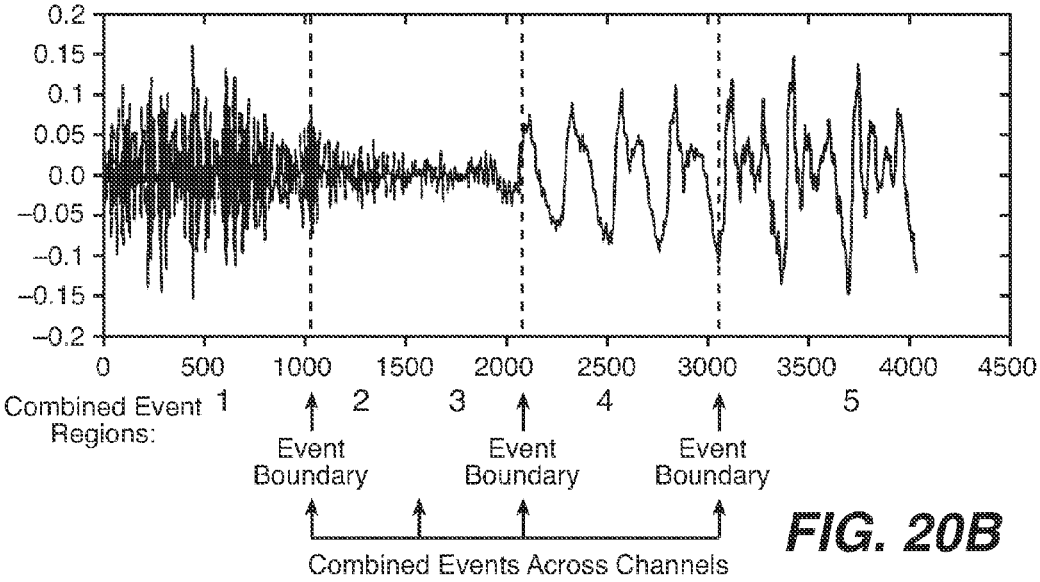

The outputs of the auditory scene analysis process of step 706 of FIG. 17 are the location of the auditory event boundaries, the number of auditory events detected in the input block and the last, or Lth, spectral profile block computed for the N point input block. As stated earlier, the auditory analysis process is performed once for each channel's input data block. As described in more detail below in connection with step 710, if more than one audio channel is being processed, the auditory event information may be combined (creating "combined auditory event" segments) to create a total auditory event overview for all channels. This facilitates phase synchronous multichannel processing. In this way, the multiple audio channels can be thought of as multiple individual audio "tracks" that are mixed together to create a single complex audio scene. An example of event detection processing for two channels is shown in FIG. 20, described below.

Psychoacoustic Analysis of Auditory Events 708 (FIG. 17)

Referring again to FIG. 17, following input data blocking and auditory scene analysis, psychoacoustic analysis is performed in each input data block for each auditory event ("Perform psychoacoustic analysis on each event of each block) (step 708). In general, the psychoacoustic characteristics remain substantially uniform in an audio channel over the length or time period of an auditory event because the audio within an auditory event is perceived to be reasonably constant. Thus, even if the audio information is examined more finely in the psychoacoustic analysis process, which looks at 64 sample subblocks in the practical example disclosed herein, than in the auditory event detection process, which looks at 512 sample subblocks in the practical example disclosed herein, the psychoacoustic analysis process generally finds only one predominant psychoacoustic condition throughout an auditory event and tags the event accordingly. The psychoacoustic analysis performed as a part of the process of FIG. 17 differs from that performed as a part of the process of FIG. 5 primarily in that it is applied to each auditory event within an input block rather than to an entire input block.

Figure 21:
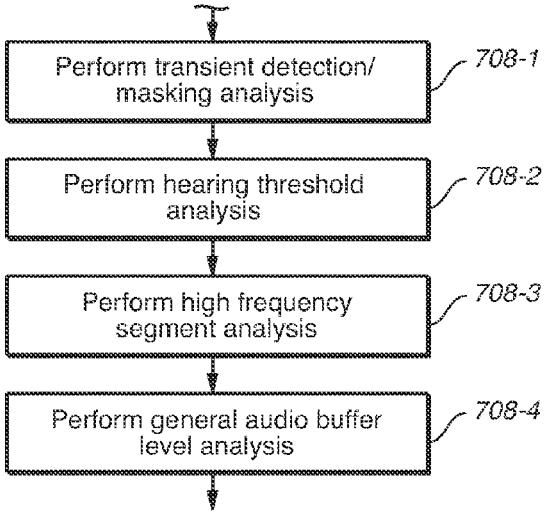
FIG. 21 is a flow chart showing details of the psychoacoustic analysis step 708 of the process of FIG. 17.
Figure 22:
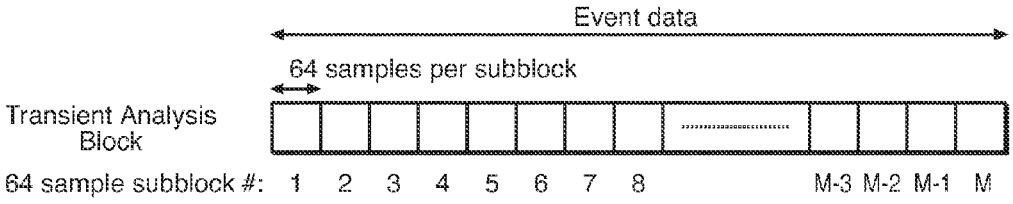
FIG. 22 is a schematic conceptual representation of a block of data samples in a transient analysis buffer. The horizontal axis is samples in the block.

In general, psychoacoustic analysis of the auditory events provides two important pieces of information—first, it identifies which of the input signal's events, if processed, are most likely to produce audible artifacts, and second, which portion of the input signal can be used advantageously to mask the processing that is performed. FIG. 21 sets forth a process similar to the process of FIG. 6, described above, used in the psychoacoustic analysis process. The psychoacoustic analysis process is composed of four general processing substeps. As mentioned above, each of the psychoacoustic processing substeps employs a psychoacoustic subblock having a size that is one-eighth of the spectral profile subblock (or one-sixty-fourth the size of the input block). Thus, in this example, the psychoacoustic subblocks are approximately 1.5 msec (or 64 samples at 44.1 kHz) as shown in FIG. 22. While the actual size of the psychoacoustic subblocks is not constrained to 1.5 msec and may have a different value, this size was chosen for practical implementation because it provides a good trade off between real-time processing requirements (as larger subblock sizes require less psychoacoustic processing overhead) and resolution of transient location (smaller subblocks provide more detailed information on the location of transients). In principle, the psychoacoustic subblock size need not be the same for every type of psychoacoustic analysis, but in practical embodiments for ease of implementation, this is preferred.

Transient Detection 708-1 (FIG. 21)

Referring to FIG. 21, the first substep 708-1 ("Perform transient detection/masking analysis") analyzes each auditory event segment in each audio channel's input block to determine if each such segment contains a transient. This is necessary even though the spectral change aspect of the ASA process inherently takes into account transients and may have identified an audio segment containing a transient as an auditory event (inasmuch as transients cause spectral changes), because the spectrum-based ASA process described herein does not identify an auditory event by whether or not it contains a transient. The resulting temporal transient information is used in masking analysis and helps in the placement of the provisional or common splice point location. As discussed above, it is well known that transients introduce temporal masking (hiding audio information both before and after the occurrence of transients). An auditory event segment in a particular block preferably is tagged as a transient whether or not the transient occupies the entire length or time period of the event. The transient detection process in the psychoacoustic analysis step is essentially the same as the transient detection process described above except that it analyzes only the segment of an input block that constitutes an auditory event. Thus, reference may be made to the process flowchart of FIG. 8, described above, for details of the transient detection process.

Hearing Threshold Analysis 708-3 (FIG. 21)

Referring again to FIG. 21, the second step 708-2 in the psychoacoustic analysis process, the "Perform hearing threshold analysis" substep, analyzes each auditory event segment in each audio channel's input block to determine if each such segment is predominantly a low enough signal strength that it can be considered to be at or below the hearing threshold. As mentioned above, an auditory event tends to be perceived as reasonably constant throughout its length or time period, subject, of course, to possible variations near its boundaries due to the granularity of the spectral-profile subblock size (e.g., the audio may change its character other than precisely at a possible event boundary). The hearing threshold analysis process in the psychoacoustic analysis step is essentially the same as the hearing threshold analysis process described above (see, for example, the description of substep 206-2 of FIG. 6) except that it analyzes only segments of an input block constituting an auditory event, thus reference may be made to the prior description. Auditory events are of interest because the artifacts introduced by time scaling and pitch shifting such auditory events are less likely to be audible in such regions.

High-Frequency Analysis 708-3 (FIG. 21)

The third substep 708-3 (FIG. 21) ("Perform high-frequency analysis"), analyzes each auditory event in each audio channel's input block to determine if each such segment predominantly contains high-frequency audio content. High-frequency segments are of interest in the psychoacoustic analysis because the hearing threshold in quiet increases rapidly above approximately 10-12 kHz and because the ear is less sensitive to discontinuities in a predominantly high-frequency waveform than to discontinuities in waveforms predominantly of lower frequencies. While there are many methods available to determine whether an audio signal consists mostly of high-frequency energy, the method described above in connection with substep 206-3 of FIG. 6 provides good detection results, minimizes computational requirements and may be applied to analyzing segments constituting auditory events.

Audio Level Analysis 708-4 (FIG. 21)

Figure 23:
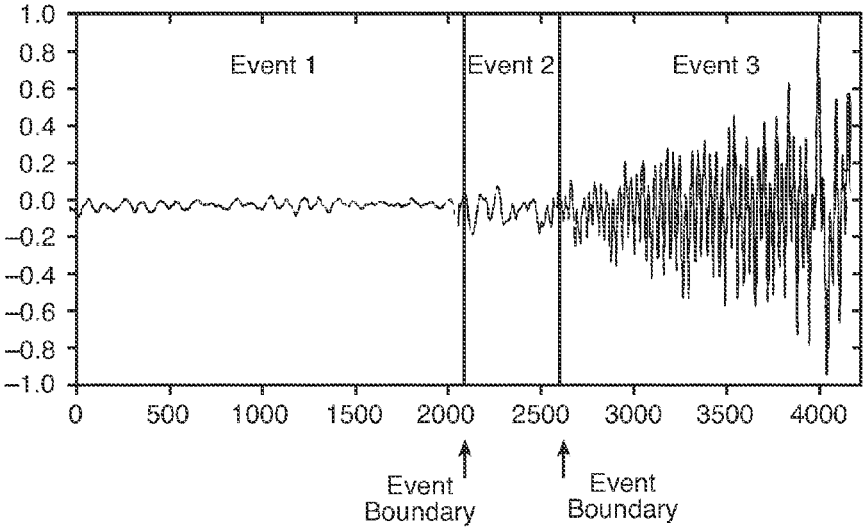
FIG. 23 is an idealized waveform of a single channel of orchestral music illustrating auditory events and psychoacoustic criteria.

The fourth substep 708-4 (FIG. 21) in the psychoacoustic analysis process, the "Perform general audio block level analysis" substep, analyzes each auditory event segment in each audio channel's input block to compute a measure of the signal strength of the event. Such information is used if the event does not have any of the above psychoacoustic characteristics that can be exploited during processing. In this case, the data compression or expansion processing may favor the lowest level or quietest auditory events in an input data block based on the rationale that lower level segments of audio generate low-level processing artifacts that are less likely to be audible. A simple example using a single channel of orchestral music is shown in FIG. 23. The spectral changes that occur as a new note is played trigger the new events 2 and 3 at samples 2048 and 2560, respectively. The orchestral signal shown in FIG. 23 contains no transients, below hearing threshold or high-frequency content. However, the first auditory event of the signal is lower in level than the second and third events of the block. It is believed that the audible processing artifacts are minimized by choosing such a quieter event for data expansion or compression processing rather than the louder, subsequent events.

To compute the general level of an auditory event, substep 708-4 takes the data within the event divided into 64-sample subblocks, finds the magnitude of the greatest sample in each subblock, and takes the average of those greatest magnitudes over the number of 64-sample subblocks in the event. The general audio level of each event is stored for later comparison.

Determining Combined Auditory Events and Setting a Common Splice Point 710 (FIG. 17)

As shown in FIG. 17, following auditory scene analysis and psychoacoustic analysis of each segment constituting an auditory event in each block, the next step 710 ("Determine Combined Auditory Events and Set Common Splice Point") in processing is to determine the boundaries of combined auditory events in concurrent blocks across all channels (combined auditory events are described further below in connection with FIG. 20), determine a common splice point in concurrent blocks across all channels for one or more combined auditory event segments in each set of concurrent blocks, and rank the psychoacoustic quality of the auditory events in the combined auditory event segments. Such a ranking may be based on the hierarchy of psychoacoustic criteria set forth above. In the event that a single channel is being processed, the auditory events in that channel are treated in the same manner as the combined auditory events of multiple channels in this description.

The setting of one or more common splice points is done generally in the manner described above in connection with the description of FIG. 5 except that combined auditory events are taken into account rather than a common overlap of identified regions. Thus, for example, a common splice point may typically be set early in a combined auditory event period in the case of compression and late in the combined auditory event period for the case of expansion. A default time of 5 msec after the start of a combined auditory event may be employed, for example.

The psychoacoustic quality of the combined auditory event segments in each channel may be taken into account in order to determine if data compression or expansion processing should occur within a particular combined auditory event. In principle, the psychoacoustic quality determination may be performed after setting a common splice point in each combined event segment or it may be performed prior to setting a common splice point in each combined event segment (in which case no common splice point need be set for a combined event having such a negative psychoacoustic quality ranking that it is skipped based on complexity).

The psychoacoustic quality ranking of a combined event may be based on the psychoacoustic characteristics of the audio in the various channels during the combined event time segment (a combined event in which each channel is masked by a transient might have the highest psychoacoustic quality ranking while a combined event in which none of the channels satisfy any psychoacoustic criteria might have the lowest psychoacoustic quality ranking). For example, the hierarchy of psychoacoustic criteria described above may be employed. The relative psychoacoustic quality rankings of the combined events may then be employed in connection with a first decision step described further below (step 712) that takes complexity of the combined event segment in the various channels into account. A complex segment is one in which performing data compression or expansion would be likely to cause audible artifacts. For example, a complex segment may be one in which at least one of the channels does not satisfy any psychoacoustic criteria (as described above) or contains a transient (as mentioned above, it is undesirable to change a transient). At the extreme of complexity, for example, every channel fails to satisfy a psychoacoustic criterion or contains a transient. A second decision step described below (step 718) takes the length of the target segment (which is affected by the length of the combined event segment) into account. In the case of a single channel, the event is ranked according to its psychoacoustic criteria to determine if it should be skipped.

Combined auditory events may be better understood by reference to FIG. 20 that shows the auditory scene analysis results for a two channel audio signal. FIG. 20 shows concurrent blocks of audio data in two channels. ASA processing of the audio in a first channel, the top waveform of FIG. 20, identifies auditory event boundaries at samples that are multiples of the spectral-profile subblock size, 1024 and 1536 samples in this example. The lower waveform of FIG. 20 is a second channel and ASA processing results in event boundaries at samples that are also multiples of the spectral-profile subblock size, at samples 1024, 2048 and 3072 in this example. A combined auditory event analysis for both channels results in combined auditory event segments with boundaries at samples 1024, 1536, 2048 and 3072 (the auditory event boundaries of every channel are "ORed" together). It will be appreciated that in practice the accuracy of auditory event boundaries depends on the size of the spectral-profile subblock size (N is 512 samples in this practical embodiment) because event boundaries can occur only at subblock boundaries. Nevertheless, a subblock size of 512 samples has been found to determine auditory event boundaries with sufficient accuracy as to provide satisfactory results.

Still referring to FIG. 20, if only the single channel of audio containing a transient in the top of the diagram were being processed, then three individual auditory events would be available for data compression or expansion processing. These events include the (1) quiet portion of audio before the transient, (2) the transient event, and (3) the echo/sustain portion of the audio transient. Similarly, if only the speech signal represented in the lower portion of the diagram is processed, then four individual auditory events would be available for data compression or expansion processing. These events include the predominantly high-frequency sibilance event, the event as the sibilance evolves or "morphs" into the vowel, the first half of the vowel, and the second half of the vowel.

FIG. 20 also shows the combined event boundaries when the auditory event data is shared across the concurrent data blocks of two channels. Such event segmentation provides five combined auditory event regions in which data compression or expansion processing can occur (the event boundaries are ORed together). Processing within a combined auditory event segment assures that processing occurs with an auditory event in every channel. Note that, depending upon the method of data compression or expansion used and the contents of the audio data, it may be most appropriate to process only the data in the two channels that are within one combined event or only some of the combined events (rather than all of the combined events). It should be noted that the combined auditory event boundaries, although they result from ORing the event boundaries of all the audio channels, are used to define segments for data compression or expansion processing that is performed independently on the data in each concurrent input channel block. Thus, if only a single combined event is chosen for processing, the data for each audio channel is processed within the length or time segment of that combined event. For example, in FIG. 20, if the desired overall time scaling amount is 10%, then the least amount of audible artifacts may be introduced if only combined event region four is processed in each channel and the number of samples in combined event region four is changed sufficiently so that the length of the entire N samples is changed by 0.10*N samples. However, it may also be possible to distribute the processing and process each of the combined events such that among all combined events the total change in length sums to 0.10*N samples. The number and which ones of the combined events are chosen for processing is determined in step 718, described below.

Figure 24:
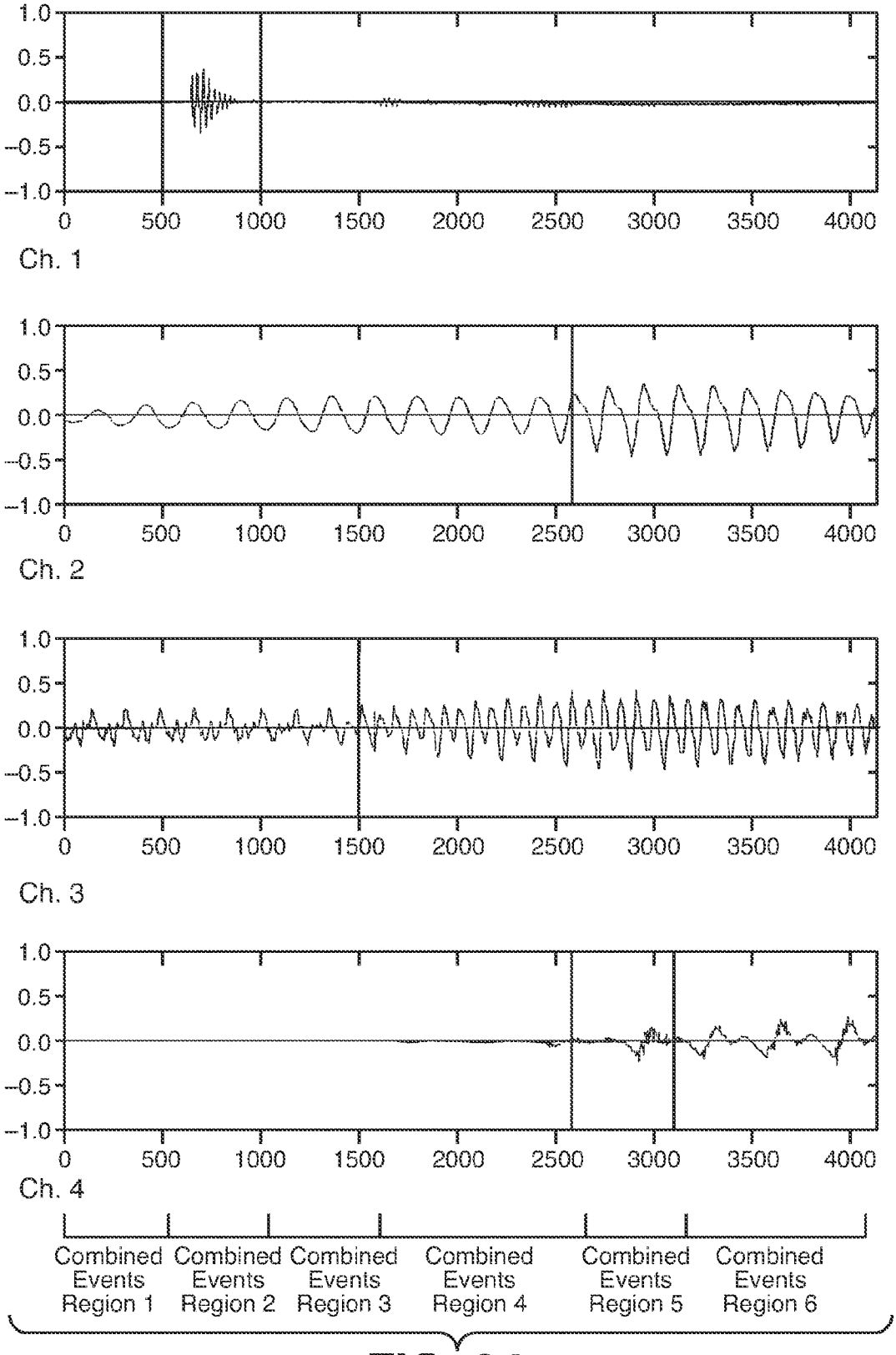
FIG. 24 is a series of idealized waveforms in four audio channels, illustrating auditory events, psychoacoustic criteria and the ranking of combined auditory events.

FIG. 24 shows an example of a four channel input signal. Channels 1 and 4 each contain three auditory events and channels 2 and 3 each contain two auditory events. The combined auditory event boundaries for the concurrent data blocks across all four channels are located at sample numbers 512, 1024, 1536, 2560 and 3072 as indicated at the bottom of the FIG. 24. This implies that all six combined auditory events may be processed across the four channels. However, some of the combined auditory events may have such a low relative psychoacoustic ranking (i.e. they may be too complex) or may be so short that it is not desirable to process within them. In the example of FIG. 24, the most desirable combined auditory event for processing is Combined Events Region 4, with Combined Events Region 6 the next most desirable. The other three Combined Events Regions are all of minimum size. Moreover, Combined Events Region 2 contains a transient in Channel 1. As noted above, it is best to avoid processing during a transient. Combined Events Region 4 is desirable because it is the longest and the psychoacoustic characteristics of each of its channels are satisfactory—it has transient postmasking in Channel 1, Channel 4 is below hearing threshold and Channels 2 and 3 are relatively low level.

The maximum correlation processing length and the crossfade length limit the maximum amount of audio that can be removed or repeated within a combined auditory event time segment. The maximum correlation processing length is limited by the length of the combined auditory event time segment or a predetermined value, whichever is less. The maximum correlation processing length should be such that data compression or expansion processing is within the starting and ending boundaries of an event. Failure to do so causes a "smearing" or "blurring" of the event boundaries, which may be audible.

Figure 25:
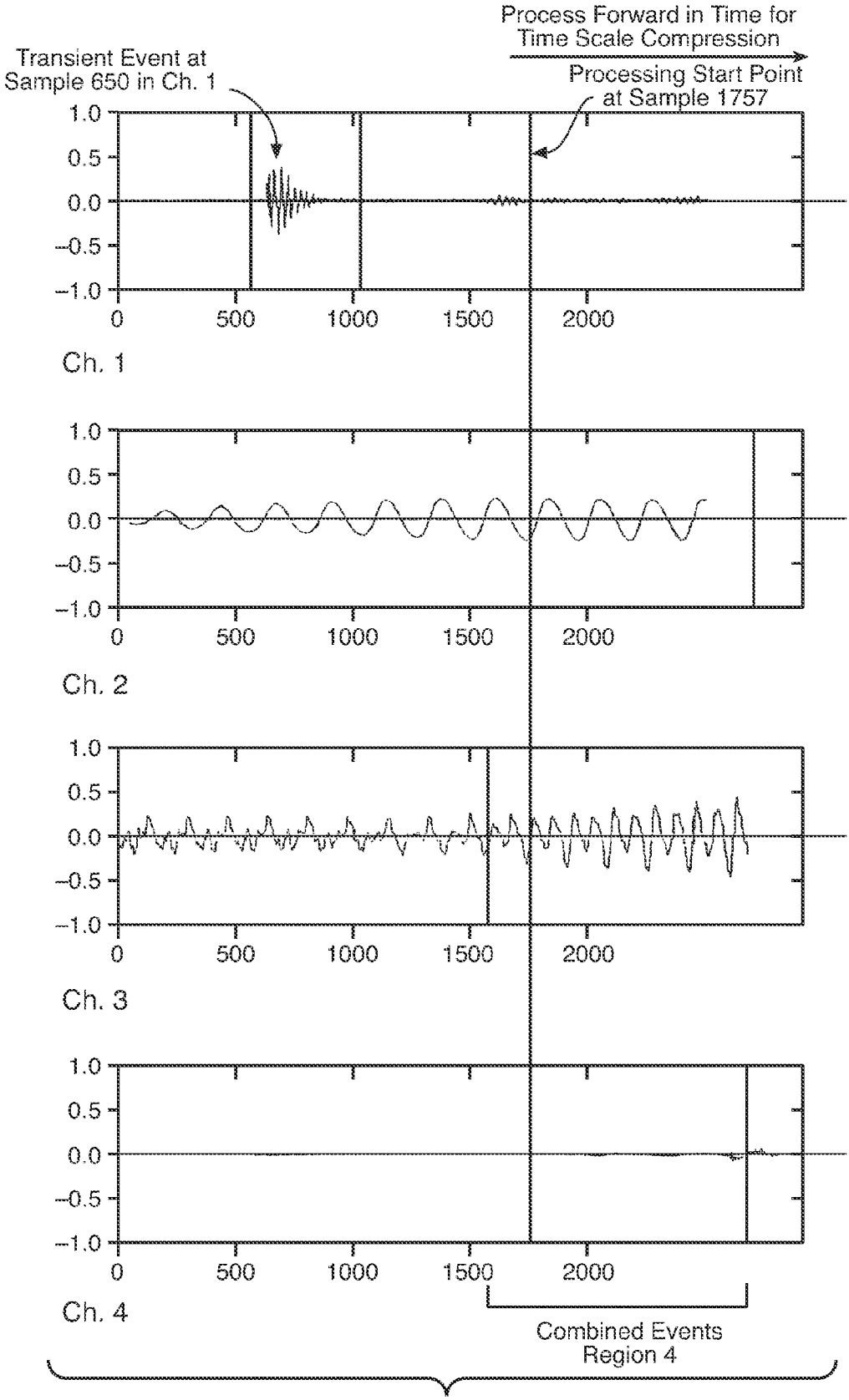
FIG. 25 shows one combined auditory event of FIG. 24 in greater detail.

FIG. 25 shows details of the four-channel data compression processing example of FIG. 24 using the fourth combined auditory event time segment of the channels as a segment to be processed. In this example, Ch. 1 contains a single transient in Combined Event 2. For this example, the splice point location is selected to be sample 1757 located in the largest combined auditory event following the transient at sample 650 in audio Ch. 1. This splice point location was chosen based upon placing it 5 msec (half the length of the crossfade or 221 samples, at 44.1 kHz) after the earlier combined event boundary to avoid smearing the event boundary during crossfading. Placing the splice point location in this segment also takes advantage of the post-masking provided by the transient in combined event 2.

In the example shown in FIG. 25, the maximum processing length takes into account the location of a combined, multichannel auditory event boundary at sample 2560 that should be avoided during processing and cross-fading. As part of step 710, the maximum processing length is set to 582 samples. This value is computed assuming a 5 msec half crossfade length (221 samples at 44.1 kHz) as follows:

///

///

Max processing length=Event boundary−Crossfade length−Processing splice point location
582=2560−221−1757

The output of step 710 is the boundaries of each combined auditory event, a common splice point in the concurrent data blocks across the channels for each combined auditory event, the psychoacoustic quality ranking of the combined auditory event, crossfade parameter information and the maximum processing length across the channels for each combined auditory event.

Figure 26:
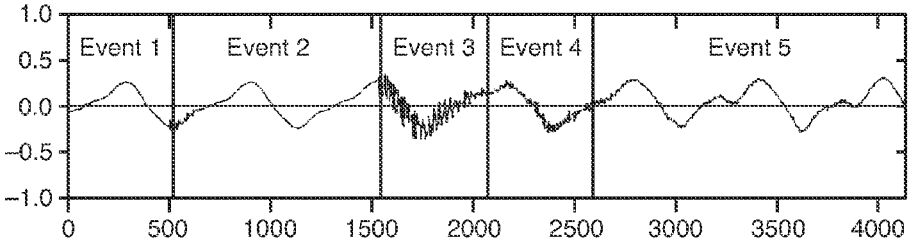
FIG. 26 is an idealized waveform of single channel, illustrating examples of auditory events of low psychoacoustic quality ranking that may be skipped.

As explained above, a combined auditory event having a low psychoacoustic quality ranking indicates that no data compression or expansion should take place in that segment across the audio channels. For example, as shown in FIG. 26, which considers only a single channel, the audio in events 3 and 4, each 512 samples long, contain predominantly low frequency content, which is not appropriate for data compression or expansion processing (there is not enough periodicity of the predominant frequencies to be useful). Such events may be assigned a low psychoacoustic quality ranking and may be skipped.

Skip Based on Complexity 712 (FIG. 17)

Thus, step 712 ("Skip based on complexity?") sets a skip flag when the psychoacoustic quality ranking is low (indicating high complexity). By making this complexity decision before rather than after the correlation processing of step 714, described below, one avoids performing needless correlation processing. Note that step 718, described below, makes a further decision as to whether the audio across the various channels during a particular combined auditory event segment should be processed. Step 718 takes into consideration the length of the target segment in the combined auditory event with respect to the current processing length requirements. The length of the target segment is not known until the common end point is determined in the correlation step 714, which is about to be described.

Correlation Processing

For each common splice point, an appropriate common end point is needed in order to determine a target segment. If it is decided (step 712) that input data for the current combined auditory event segment is to be processed, then, as shown in FIG. 17, two types of correlation processing (step 714) take place, consisting of correlation processing of the time domain data (steps 714-1 and 714-2) and correlation processing of the input signals' phase information (steps 714-3 and 714-4). It is believed that using the combined phase and time domain information of the input data provides a high quality time scaling result for signals ranging from speech to complex music compared to using time-domain information alone. Details of the processing step 714, including its substeps 714-1, 2, 3 and 4 and the multiple correlation step 716, are essentially the same as described above in connection with steps 214 (and its substeps 214-1, 2, 3, and 4) and 216 except that in steps 714 and 716 the processing is of combined auditory event segments rather than psychoacoustically identified regions.

Alternative Splice Point and End Point Selection Process

As mentioned above, aspects of the invention contemplate an alternative method for selecting a splice point location and a companion end point location. The processes described above choose a splice point somewhat arbitrarily and then chooses an end point based on average periodicity (essentially, one degree of freedom). An alternative method, which is about to be described, instead ideally chooses a splice point/end point pair based on a goal of providing the best possible crossfade with minimal audible artifacts through the splice point (two degrees of freedom).

Figure 27:
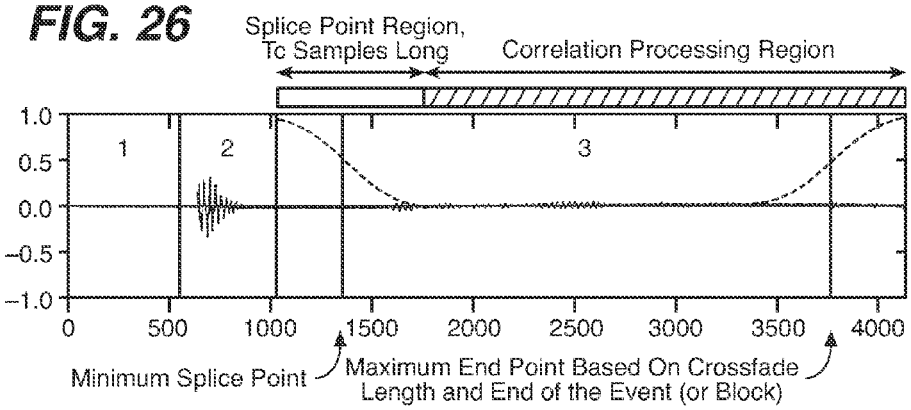
FIG. 27 is a schematic conceptual representation, including an idealized waveform in a single channel, illustrating an initial step in selecting, for a single channel of audio, splice point and end point locations in accordance with an alternative aspect of the invention.

FIG. 27 shows a first step in selecting, for a single channel of audio, splice point and end point locations in accordance this alternative aspect of the invention. In FIG. 27, the signal is comprised of three auditory events. Psychoacoustic analysis of the events reveals that event 2 contains a transient that provides temporal masking, predominantly post-masking, which extends into event 3. Event 3 is also the largest event, thereby providing the longest processing region. In order to determine the optimal splice point location, a region of data Tc ("time of crossfade) samples long (equal to the crossfade length) is correlated against data in a processing region. The splice point of interest should be located in the middle of the Tc splice point region.

The cross-correlation of the splice point region and the processing region results in a correlation measure used to determine the best end point (in a manner similar to the first alternative method), where the best end point for a particular splice point is determined by finding the maximum correlation value within the calculated correlation function. In accordance with this second alternative method, an optimized splice point/end point pair may be determined by correlating a series of trial splice points against correlation processing regions adjacent to the trial splice points.

Figure 28:
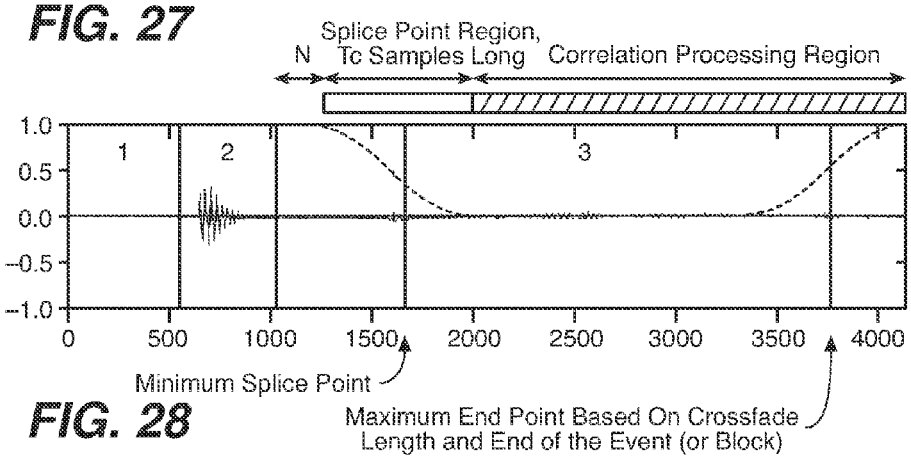
FIG. 28 is like FIG. 27 except that it shows the Splice Point Region Tc shifted by N samples.
Figure 30:
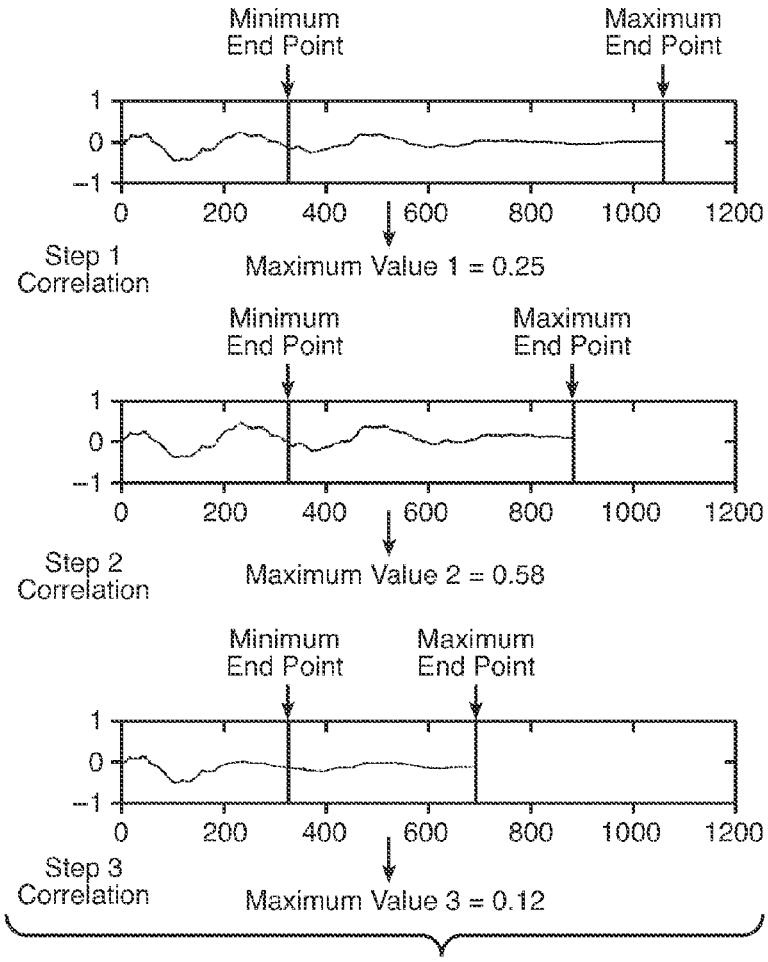
FIG. 30 has three portions. The upper portion of FIG. 30 is an idealized correlation function for the case of the first Splice Point Region Tc location shown in FIG. 29. The middle portion of FIG. 30 is an idealized correlation function for the case of the second Splice Point Region Tc location shown in FIG. 29. The lower portion of FIG. 30 is an idealized correlation function for the case of the third Splice Point Region Tc location shown in FIG. 29.

As shown in FIGS. 30A-C, this best end point preferably is after a minimum end point. The minimum end point may be set so that a minimum number of samples are always processed (added or removed). The best end point preferably is at or before a maximum end point. As shown in FIG. 28, the maximum end point is no closer than half the crossfade length away from the end of the event segment being processed. As mentioned above, in the practical implementation described, no auditory events may exceed the end of the input block. This is the case for event 3 in FIG. 28, which is limited to the end of the 4096 sample input block.

The value of the correlation function at its maximum between the minimum and maximum end points determines how similar the splice point is to the optimum end point for the particular splice point. In order to optimize the splice point/end point pair (rather than merely optimizing the end point for a particular splice point), a series of correlations are computed by choosing other Tc sample splice point regions each located N samples to the right of the previous region and by recomputing the correlation function as shown in FIG. 28.

Figure 29:
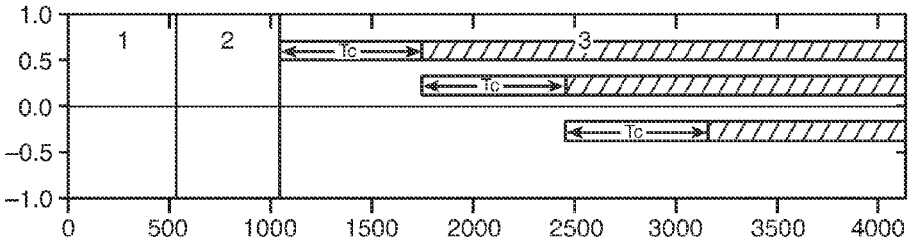
FIG. 29 is a schematic conceptual representation showing an example of multiple correlation calculations when the splice point region is consecutively advanced by Tc samples. The three processing steps are superimposed over the audio data block data plot. The processing shown in FIG. 29 results in three correlation functions each with a maximum value as shown in FIGS. 30A-C, respectively.

The minimum number of samples that N can be is one sample. However, selecting N to be one sample greatly increases the number of correlations that need to be computed, which would greatly hinder real-time implementations. A simplification can be made whereby N is set equal to a larger number of samples, such as Tc samples, the length of the crossfade. This still provides good results and reduces the processing required. FIG. 29 shows conceptually an example of the multiple correlation calculations that are required when the splice point region is consecutively advanced by Tc samples. The three processing steps are superimposed over the audio data block data plot. The processing shown in FIG. 29 results in three correlation functions each with a maximum value as shown in FIGS. 30A-C, respectively.

As shown in FIG. 30B, the maximum correlation value comes from the second splice point iteration. This implies that the second splice point and its associated maximum value determined by the correlation should be used as the distance from the splice point to the end point.

In performing the correlation, conceptually, the Tc samples are slid to the right, index number by index number, and corresponding sample values in Tc and in the processing region are multiplied together. The Tc samples are windowed, a rectangular window in this example, around the trial splice point. A window shape that gives more emphasis to the trial splice point and less emphasis to the regions spaced from the trial splice point may provide better results. Initially (no slide, no overlap), the correlation function is, by definition, zero. It rises and falls until it finally drops to zero again when the sliding has gone so far that there is again no overlap. In practical implementations, FFTs may be employed to compute the correlations. The correlation functions shown in FIGS. 30A-C are limited to ±1. These values are not a function of any normalization. Normalization of the correlation would discard the relative weighting between the correlations employed to choose the best splice point and end point. When determining the best splice point, one compares the un-normalized maximum correlation values between the minimum and maximum processing point locations. The maximum correlation value with the largest value indicates the best splice and end point combination.

This alternative splice point and end point location method has been described for the case of data compression in which the end point is after the splice point. However, it is equally applicable to the case of data expansion. For data expansion, there are two alternatives. According to the first alternative, an optimized splice point/end point pair is determined as explained above. Then, the identities of the splice point and end point are reversed such that the splice point becomes the end point and vice-versa. According to a second alternative, the region around the trial splice points are correlated "backward" rather than "forward" in order to determine an optimized end point/splice point pair in which the end point is "earlier" than the splice point.

Multichannel processing is performed in a manner similar to that described above. After the auditory event regions are combined, the correlations from each channel are combined for each splice point evaluation step and the combined correlations are used to determine the maximum value and thus the best pair of splice and end points.

An additional reduction in processing may be provided by decimating the time domain data by a factor of M. This reduces the computational intensity by a factor of ten but only provides a coarse end point (within M samples). Fine-tuning may be accomplished after coarse, decimated processing by performing another correlation using all of the undecimated audio to find the best end point to the resolution of one sample, for example.

A further alternative is to correlate a windowed region around trial splice point locations with respect to a windowed region around trial end point locations instead of with respect to a larger un-windowed correlation region. Although it is not computationally intense to perform cross correlation between a windowed trial splice point region and an un-windowed correlation region (such a correlation may be performed in the time domain prior to conversion to the frequency domain for remaining correlation computations), it would be computationally demanding to cross correlate two windowed regions in the time domain.

Although this alternative splice point/end point selection process has been described in the context of an embodiment in which the audio signals are divided into auditory events, the principles of this alternative process are equally applicable to other environments, including the process of FIG. 5. In the FIG. 5 environment, the splice point and end point would be within a psycho-acoustically identified region or overlap of identified regions rather than within an auditory event or a combined auditory event.

Event Processing Decision

Returning to the description of FIG. 17, the next step in processing is the Event Block Processing Decision step 718 ("Process Combined Event?"). Because the time scaling process makes use of the periodicity of the time domain or time domain and phase information and takes advantage of this information to process the audio signal data, the output time scaling factor is not linear over time and varies by a slight amount around the requested input time scaling factor. Among other functions, the Event Processing Decision compares how much the preceding data has been time scaled to the requested amount of time scaling. If processing up to the time of this combined auditory event segment exceeds the desired amount of time scaling, then this combined auditory event segment may be skipped (i.e., not processed). However, if the amount of time scaling performed up to this time is below the desired amount, then the combined auditory event segment is processed.

For the case in which the combined auditory event segment should be processed (according to step 712), the Event Processing decision step compares the requested time scaling factor to the output time scaling factor that would be accomplished by processing the current combined auditory event segment. The decision step then decides whether to process the current combined auditory event segment in the input data block. Note that the actual processing is of a target segment, which is contained within the combined auditory event segment. An example of how this works on the event level for an input block is shown in FIG. 31.

Figure 31:
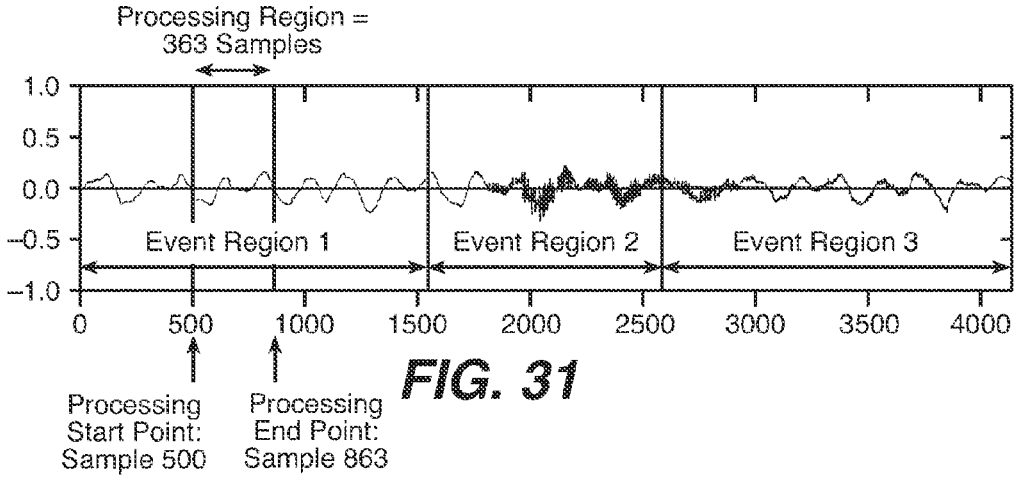
FIG. 31 is an idealized audio waveform having three combined auditory event regions, showing an example in which a target segment of 363 samples in the first combined event region is selected.

FIG. 31 shows an example where the overall input block length is 4096 samples. The audio in this block contains three auditory events (or combined auditory events, in which case the figure shows only one of multiple channels), which are 1536, 1024 and 1536 samples in length, respectively. As indicated in FIG. 17, each auditory event or combined auditory event is processed individually, so the 1536 sample auditory event at the beginning of the block is processed first. In the example above, the splice point and correlation analysis have found that, when beginning at splice point sample 500, the process can remove or repeat 363 samples of audio (the target segment) with minimal audible artifacts. This provides a time scaling factor of $$363 \text{ samples}/4096 \text{ samples}=8.86\%$$

for the current 4096 sample input block. If the combination of this 363 samples of available processing along with the processing provided from subsequent auditory event or combined auditory event segments is greater than or equal to the desired amount of time scaling processing, then only processing the first auditory event or combined auditory event segment should be sufficient and the remaining auditory event or combined auditory event segments in the block may be skipped. However, if the 363 samples processed in the first auditory event are not enough to meet the desired time scaling amount, then the second and third events may also be considered for processing.

Splice and Crossfade Processing 720 (FIG. 5)

Following the determination of the splice and end points, each combined auditory event that has not been rejected by step 712 or step 718 is processed by the "Splice and Crossfade" step 720 (FIG. 17). This step receives each event or combined event data segment, the splice point location, the processing end points and the crossfade parameters. Step 720 operates generally in the manner of step 218 of the process of FIG. 5, described above, except that it acts on auditory events or combined auditory events and the length of the crossfade may be longer.

The crossfade parameter information is affected not only by the presence of a transient event, which allows shorter crossfades to be used, but is also affected by the overall length of the combined auditory event in which the common splice point location is placed. In a practical implementation, the crossfade length may be scaled proportionally to the size of the auditory event or combined auditory event segment in which data compression or expansion processing is to take place. As explained above, in a practical embodiment, the smallest auditory event allowed is 512 points, with the size of the events increasing by 512 sample increments to a maximum size of the input block size of 4096 samples. The crossfade length may be set to 10 msec for the smallest (512 point) auditory event. The length of the crossfade may increase proportionally with the size of the auditory event to a maximum or 30-35 msec. Such scaling is useful because, as discussed previously, longer crossfades tend to mask artifacts but also cause problems when the audio is changing rapidly. Since the auditory events bound the elements that comprise the audio, the crossfading can take advantage of the fact that the audio is predominantly stationary within an auditory event and longer crossfades can be used without introducing audible artifacts. Although the above-mentioned block sizes and crossfade times have been found to provide useful results, they are not critical to the invention.

Pitch Scaling Processing 722 (FIG. 5)

Following the splice/crossfade processing of combined auditory events, a decision step 722 ("Pitch scale?") is checked to determine whether pitch shifting is to be performed. As discussed previously, time scaling cannot be done in real-time due to block underflow or overflow. Pitch scaling can be performed in real-time because of the resampling step 724 ("Resample all data blocks"). The resampling step resamples the time scaled input signal resulting in a pitch scaled signal that has the same time evolution as the input signal but with altered spectral information. For real-time implementations, the resampling may be performed with dedicated hardware sample-rate converters to reduce computational requirements.

Following the pitch scaling determination and possible resampling, all processed input data blocks are output either to file, for non-real time operation, or to an output data buffer for real-time operation ("Output processed data blocks") (step 726). The process flow then checks for additional input data ("Input data?") and continues processing.

It should be understood that implementation of other variations and modifications of the invention and its various aspects will be apparent to those skilled in the art, and that the invention is not limited by these specific embodiments described. It is therefore contemplated to cover by the present invention any and all modifications, variations, or equivalents that fall within the true spirit and scope of the basic underlying principles disclosed and claimed herein.

The present invention and its various aspects may be implemented as software functions performed in digital signal processors, programmed general-purpose digital computers, and/or special purpose digital computers. Interfaces between analog and digital signal streams may be performed in appropriate hardware and/or as functions in software and/or firmware.

The invention claimed is:

1. A method for processing an audio signal, comprising dividing said audio signal into auditory events, and processing the audio signal within an auditory event, wherein said dividing said audio signal into auditory events comprises identifying a continuous succession of auditory event boundaries in the audio signal, in which every change in spectral content with respect to time exceeding a threshold defines a boundary, wherein each auditory event is an audio segment between adjacent boundaries and there is only one auditory event between such adjacent boundaries, each boundary representing the end of the preceding event and the beginning of the next event such that a continuous succession of auditory events is obtained, wherein neither auditory event boundaries, auditory events, nor any characteristics of an auditory event are known in advance of identifying the continuous succession of auditory event boundaries and obtaining the continuous succession of auditory events.

2. A method for processing a plurality of audio signal channels, comprising dividing the audio signal in each channel into auditory events, determining combined auditory events, each having a boundary where an auditory event boundary occurs in any of the audio signal channels, and processing all of said audio signal channels within a combined auditory event, whereby processing is within an auditory event in each channel, wherein said dividing the audio signal in each channel into auditory events comprises, in each channel, identifying a continuous succession of auditory event boundaries in the audio signal, in which every change in spectral content with respect to time exceeding a threshold defines a boundary, wherein each auditory event is an audio segment between adjacent boundaries and there is only one auditory event between such adjacent boundaries, each boundary representing the end of the preceding event and the beginning of the next event such that a continuous succession of auditory events is obtained, wherein neither auditory event boundaries, auditory events, nor any characteristics of an auditory event are known in advance of identifying the continuous succession of auditory event boundaries and obtaining the continuous succession of auditory events.

3. A method for processing an audio signal, comprising dividing said audio signal into auditory events, analyzing said auditory events using at least one psychoacoustic criterion to identify those auditory events in which the processing of the audio signal would be inaudible or minimally audible, and processing within an auditory event identified as one in which the processing of the audio signal would be inaudible or minimally audible, wherein said dividing said audio signal into auditory events comprises identifying a continuous succession of auditory event boundaries in the audio signal, in which every change in spectral content with respect to time exceeding a threshold defines a boundary, wherein each auditory event is an audio segment between adjacent boundaries and there is only one auditory event between such adjacent boundaries, each boundary representing the end of the preceding event and the beginning of the next event such that a continuous succession of auditory events is obtained, wherein neither auditory event boundaries, auditory events, nor any characteristics of an auditory event are known in advance of identifying the continuous succession of auditory event boundaries and obtaining the continuous succession of auditory events.

4. The method of claim 3 wherein said at least one psychoacoustic criterion is a criterion of a group of psychoacoustic criteria.

5. The method of claim 4 wherein said psychoacoustic criteria include at least one of the following:

the identified region of said audio signal is substantially premasked or postmasked as the result of a transient, the identified region of said audio signal is substantially inaudible, the identified region of said audio signal is predominantly at high frequencies, and the identified region of said audio signal is a quieter portion of a segment of the audio signal in which a portion or portions of the segment preceding and/or following the region is louder.

6. A method for processing multiple channels of audio signals, comprising dividing the audio signal in each channel into auditory events, analyzing said auditory events using at least one psychoacoustic criterion to identify those auditory events in which the processing of the audio signal would be inaudible or minimally audible, determining combined auditory events, each having a boundary where an auditory event boundary occurs in the audio signal of any of the channels, and processing within a combined auditory event identified as one in which the processing in the multiple channels of audio signals would be inaudible or minimally audible, wherein said dividing the audio signal in each channel into auditory events comprises, in each channel, identifying a continuous succession of auditory event boundaries in the audio signal, in which every change in spectral content with respect to time exceeding a threshold defines a boundary, wherein each auditory event is an audio segment between adjacent boundaries and there is only one auditory event between such adjacent boundaries, each boundary representing the end of the preceding event and the beginning of the next event such that a continuous succession of auditory events is obtained, wherein neither auditory event boundaries, auditory events, nor any characteristics of an auditory event are known in advance of identifying the continuous succession of auditory event boundaries and obtaining the continuous succession of auditory events.

7. The method of claim 6 wherein the combined auditory event is identified as one in which the processing of the multiple channels of audio would be inaudible or minimally audible based on the psychoacoustic characteristics of the audio in each of the multiple channels during the combined auditory event time segment.

8. The method of claim 7 wherein a psychoacoustic quality ranking of the combined auditory event is determined by applying a hierarchy of psychoacoustic criteria to the audio in each of the various channels during the combined auditory event.

9. The method of claim 6 wherein said at least one psychoacoustic criterion is a criterion of a group of psychoacoustic criteria.

10. The method of claim 9 wherein said psychoacoustic criteria include at least one of the following:

the identified region of said audio signal is substantially premasked or postmasked as the result of a transient, the identified region of said audio signal is substantially inaudible, the identified region of said audio signal is predominantly at high frequencies, and the identified region of said audio signal is a quieter portion of a segment of the audio signal in which a portion or portions of the segment preceding and/or following the region is louder.

11. A method for processing an audio signal, comprising dividing said audio signal into auditory events, wherein said dividing comprises identifying a continuous succession of auditory event boundaries in the audio signal, in which every change in spectral content with respect to time exceeding a threshold defines a boundary, wherein each auditory event is an audio segment between adjacent boundaries and there is only one auditory event between such adjacent boundaries, each boundary representing the end of the preceding event and the beginning of the next event such that a continuous succession of auditory events is obtained, wherein neither auditory event boundaries, auditory events, nor any characteristics of an auditory event are known in advance of identifying the continuous succession of auditory event boundaries and obtaining the continuous succession of auditory events, and processing the signal so that it is processed temporally in response to auditory event boundaries.

* * * * *